US011790725B2

(12) United States Patent
Nguyen

(10) Patent No.: US 11,790,725 B2
(45) Date of Patent: Oct. 17, 2023

(54) GAMING MONETARY INSTRUMENT TRACKING SYSTEM

(71) Applicant: Aristocrat Technologies, Inc. (ATI), Las Vegas, NV (US)

(72) Inventor: Binh T. Nguyen, Reno, NV (US)

(73) Assignee: Aristocrat Technologies, Inc. (ATI), Las Vegas, NV (US)

( * ) Notice: Subject to any disclaimer, the term of this patent is extended or adjusted under 35 U.S.C. 154(b) by 0 days.

(21) Appl. No.: 17/856,889

(22) Filed: Jul. 1, 2022

(65) Prior Publication Data

US 2022/0335783 A1 Oct. 20, 2022

Related U.S. Application Data

(63) Continuation of application No. 16/168,813, filed on Oct. 23, 2018, now Pat. No. 11,386,747.

(60) Provisional application No. 62/576,048, filed on Oct. 23, 2017.

(51) Int. Cl.
*G07F 17/32* (2006.01)

(52) U.S. Cl.
CPC ..... *G07F 17/3241* (2013.01); *G07F 17/3223* (2013.01); *G07F 17/3239* (2013.01); *G07F 17/3248* (2013.01)

(58) Field of Classification Search
None
See application file for complete search history.

(56) References Cited

U.S. PATENT DOCUMENTS

| | | | |
|---|---|---|---|
| 2,033,638 | A | 3/1936 | Koppl |
| 2,062,923 | A | 12/1936 | Nagy |
| 4,741,539 | A | 5/1988 | Sutton |
| 4,948,138 | A | 8/1990 | Pease |

(Continued)

FOREIGN PATENT DOCUMENTS

| | | | |
|---|---|---|---|
| GB | 2033638 | A | 5/1980 |
| GB | 2062923 | A | 5/1981 |

(Continued)

OTHER PUBLICATIONS

U.S. Appl. No. 13/801,171, filed Mar. 13, 2013.

(Continued)

*Primary Examiner* — Tramar Harper
(74) *Attorney, Agent, or Firm* — McAndrews, Held & Malloy, Ltd.

(57) ABSTRACT

A gaming monetary instrument tracking system is configured to track sources for the monetary value of a monetary instrument across multiple previous gaming transactions. The system can include a plurality of system nodes in communication with a system server. The system nodes can be electronic gaming devices, which can generate data with respect to gaming monetary instruments that each have a monetary value, and some of the system nodes can also issue new gaming monetary instruments. The system server can receive data generated by the system nodes and create data structures that link multiple gaming monetary instruments with each other according to multiple different transactions regarding the instruments at different times and across multiple different nodes. A historical record for each instrument can provide data regarding related previous transactions and instruments.

20 Claims, 22 Drawing Sheets

(56) References Cited

U.S. PATENT DOCUMENTS 4,969,183 A * 11/1990 Reese ..... A63F 3/081 463/41
5,067,712 A 11/1991 Georgilas
5,275,400 A 1/1994 Weingardt
5,429,361 A 7/1995 Raven
5,489,103 A 2/1996 Okamoto
5,618,232 A 4/1997 Martin
5,630,757 A 5/1997 Gagin
5,655,961 A 8/1997 Acres
5,704,835 A 1/1998 Dietz, II
5,727,786 A 3/1998 Weingardt
5,833,537 A 11/1998 Barrie
5,842,921 A 12/1998 Mindes
5,919,091 A 7/1999 Bell
5,947,820 A 9/1999 Morro
5,997,401 A 12/1999 Crawford
6,001,016 A 12/1999 Walker
6,039,648 A 3/2000 Guinn
6,059,289 A 5/2000 Vancura
6,089,977 A 7/2000 Bennett
6,095,920 A 8/2000 Sadahiro
6,110,041 A 8/2000 Walker
6,142,872 A 11/2000 Walker
6,146,271 A 11/2000 Kadlic
6,146,273 A 11/2000 Olsen
6,165,071 A 12/2000 Weiss
6,231,445 B1 5/2001 Acres
6,244,958 B1 6/2001 Acres
6,270,412 B1 8/2001 Crawford
6,290,600 B1 9/2001 Glasson
6,293,866 B1 9/2001 Walker
6,353,390 B1 3/2002 Beri
6,364,768 B1 4/2002 Acres
6,404,884 B1 6/2002 Marwell
6,416,406 B1 7/2002 Duhamel
6,416,409 B1 7/2002 Jordan
6,443,452 B1 9/2002 Brune
6,491,584 B2 12/2002 Graham
6,500,067 B1 * 12/2002 Luciano ..... G07F 17/3248 463/19
6,505,095 B1 1/2003 Kolls
6,508,710 B1 1/2003 Paravia
6,561,900 B1 5/2003 Baerlocher
6,592,457 B1 7/2003 Frohm
6,612,574 B1 9/2003 Cole
6,620,046 B2 9/2003 Rowe
6,641,477 B1 11/2003 Dietz, II
6,645,078 B1 11/2003 Mattice
6,675,152 B1 * 1/2004 Prasad ..... G07F 17/3241 705/64
6,699,128 B1 3/2004 Beadell
6,719,630 B1 4/2004 Seelig
6,749,510 B2 6/2004 Giobbi
6,758,757 B2 7/2004 Luciano, Jr.
6,773,345 B2 8/2004 Walker
6,778,820 B2 8/2004 Tendler
6,780,111 B2 8/2004 Cannon
6,799,032 B2 9/2004 McDonnell
6,800,027 B2 10/2004 Giobbi
6,804,763 B1 10/2004 Stockdale
6,811,486 B1 11/2004 Luciano, Jr.
6,843,725 B2 1/2005 Nelson
6,846,238 B2 1/2005 Wells
6,848,995 B1 2/2005 Walker
6,852,029 B2 2/2005 Baltz
6,869,361 B2 3/2005 Sharpless
6,875,106 B2 4/2005 Weiss
6,884,170 B2 4/2005 Rowe
6,884,172 B1 4/2005 Lloyd
6,902,484 B2 6/2005 Idaka
6,908,390 B2 6/2005 Nguyen
6,913,532 B2 7/2005 Baerlocher
6,923,721 B2 8/2005 Luciano
6,935,958 B2 8/2005 Nelson
6,949,022 B1 9/2005 Showers
6,955,600 B2 10/2005 Glavich
6,971,956 B2 12/2005 Rowe
6,984,174 B2 1/2006 Cannon
6,997,803 B2 2/2006 Lemay
7,018,292 B2 3/2006 Tracy
7,032,115 B2 4/2006 Kashani
7,033,276 B2 4/2006 Walker
7,035,626 B1 4/2006 Luciano, Jr.
7,037,195 B2 5/2006 Schneider
7,048,628 B2 5/2006 Schneider
7,048,630 B2 5/2006 Berg
7,063,617 B2 6/2006 Brosnan
7,076,329 B1 7/2006 Kolls
7,089,264 B1 8/2006 Guido
7,094,148 B2 8/2006 Baerlocher
7,105,736 B2 9/2006 Laakso
7,111,141 B2 9/2006 Nelson
7,144,321 B2 12/2006 Mayeroff
7,152,783 B2 12/2006 Charrin
7,169,041 B2 1/2007 Tessmer
7,169,052 B2 1/2007 Beaulieu
7,175,523 B2 2/2007 Gilmore
7,181,228 B2 2/2007 Boesch
7,182,690 B2 2/2007 Giobbi
7,198,571 B2 4/2007 Lemay
RE39,644 E 5/2007 Alcorn
7,217,191 B2 5/2007 Cordell
7,243,104 B2 7/2007 Bill
7,247,098 B1 7/2007 Bradford
7,259,718 B2 8/2007 Patterson
7,275,989 B2 10/2007 Moody
7,285,047 B2 10/2007 Gelb
7,311,608 B1 12/2007 Danieli
7,314,408 B2 1/2008 Cannon
7,316,615 B2 1/2008 Soltys
7,316,619 B2 1/2008 Nelson
7,318,775 B2 1/2008 Brosnan
7,326,116 B2 2/2008 O'Donovan
7,330,108 B2 2/2008 Thomas
7,346,358 B2 3/2008 Wood
7,355,112 B2 4/2008 Laakso
7,384,338 B2 6/2008 Rothschild
7,387,571 B2 6/2008 Walker
7,393,278 B2 7/2008 Gerson
7,396,990 B2 7/2008 Lu
7,415,426 B2 8/2008 Williams
7,425,177 B2 9/2008 Rodgers
7,427,234 B2 9/2008 Soltys
7,427,236 B2 9/2008 Kaminkow
7,427,708 B2 9/2008 Ohmura
7,431,650 B2 10/2008 Kessman
7,448,949 B2 11/2008 Kaminkow
7,500,913 B2 3/2009 Baerlocher
7,510,474 B2 3/2009 Carter, Sr.
7,513,828 B2 4/2009 Nguyen
7,519,838 B1 4/2009 Suurballe
7,559,838 B2 7/2009 Walker
7,563,167 B2 7/2009 Walker
7,572,183 B2 8/2009 Olivas
7,585,222 B2 9/2009 Muir
7,602,298 B2 10/2009 Thomas
7,607,174 B1 10/2009 Kashchenko
7,611,409 B2 11/2009 Muir
7,637,810 B2 12/2009 Amaitis
7,644,861 B2 1/2010 Alderucci
7,653,757 B1 1/2010 Fernald
7,693,306 B2 4/2010 Huber
7,699,703 B2 4/2010 Muir
7,722,453 B2 5/2010 Lark
7,742,996 B1 6/2010 Kwan
7,758,423 B2 7/2010 Foster
7,771,271 B2 8/2010 Walker
7,780,529 B2 8/2010 Rowe
7,780,531 B2 8/2010 Englman
7,785,192 B2 8/2010 Canterbury
7,811,172 B2 10/2010 Asher
7,819,749 B1 10/2010 Fish
7,822,688 B2 10/2010 Labrou
7,828,652 B2 11/2010 Nguyen

(56) References Cited

U.S. PATENT DOCUMENTS 7,828,654 B2 11/2010 Carter, Sr.
7,828,661 B1 11/2010 Fish
7,850,528 B2 12/2010 Wells
7,874,919 B2 1/2011 Paulsen
7,877,798 B2 1/2011 Saunders
7,883,413 B2 2/2011 Paulsen
7,892,097 B2 2/2011 Muir
7,909,692 B2 3/2011 Nguyen
7,909,699 B2 3/2011 Parrott
7,918,728 B2 4/2011 Nguyen
7,927,211 B2 4/2011 Rowe
7,927,212 B2 4/2011 Hedrick
7,951,008 B2 5/2011 Wolf
8,057,298 B2 11/2011 Nguyen
8,057,303 B2 11/2011 Rasmussen
8,087,988 B2 1/2012 Nguyen
8,117,608 B1 2/2012 Slettehaugh
8,133,113 B2 3/2012 Nguyen
8,182,326 B2 5/2012 Speer, II
8,210,927 B2 7/2012 Hedrick
8,221,245 B2 7/2012 Walker
8,226,459 B2 7/2012 Barrett
8,226,474 B2 7/2012 Nguyen
8,231,456 B2 7/2012 Zielinski
8,235,803 B2 8/2012 Loose
8,276,010 B2 9/2012 Vavilala
8,282,475 B2 10/2012 Nguyen
8,323,099 B2 12/2012 Durham
8,337,290 B2 12/2012 Nguyen
8,342,946 B2 1/2013 Amaitis
8,393,948 B2 3/2013 Allen
8,403,758 B2 3/2013 Hornik
8,430,745 B2 4/2013 Agarwal
8,461,958 B2 6/2013 Saenz
8,465,368 B2 6/2013 Hardy
8,469,813 B2 6/2013 Joshi
8,529,345 B2 9/2013 Nguyen
8,597,108 B2 12/2013 Nguyen
8,602,875 B2 12/2013 Nguyen
8,613,655 B2 12/2013 Kisenwether
8,613,659 B2 12/2013 Nelson
8,678,901 B1 3/2014 Kelly
8,696,470 B2 4/2014 Nguyen
8,745,417 B2 6/2014 Huang
8,821,255 B1 * 9/2014 Friedman ..... G07F 17/3255 463/25
8,834,254 B2 9/2014 Buchholz
8,858,323 B2 10/2014 Nguyen
8,864,586 B2 10/2014 Nguyen
8,942,995 B1 1/2015 Kerr
9,039,507 B2 5/2015 Allen
9,235,952 B2 1/2016 Nguyen
9,292,996 B2 3/2016 Davis
9,325,203 B2 4/2016 Nguyen
9,466,171 B2 10/2016 Hornik
9,483,901 B2 11/2016 Nguyen
9,486,697 B2 11/2016 Nguyen
9,486,704 B2 11/2016 Nguyen
9,530,277 B2 12/2016 Nelson
9,576,425 B2 2/2017 Nguyen
9,626,826 B2 4/2017 Nguyen
9,666,015 B2 5/2017 Acres
9,666,021 B2 5/2017 Nguyen
9,672,686 B2 6/2017 Nguyen
9,741,205 B2 8/2017 Nguyen
9,811,973 B2 11/2017 Nguyen
9,814,970 B2 11/2017 Nguyen
9,842,462 B2 12/2017 Nguyen
9,875,606 B2 1/2018 Nguyen
9,875,609 B2 1/2018 Nguyen
9,981,180 B2 5/2018 Koyanagi
10,068,429 B2 9/2018 Gagner
10,115,270 B2 10/2018 Gagner
10,140,816 B2 11/2018 Nguyen
10,325,447 B2 6/2019 Malek
10,421,010 B2 9/2019 Nguyen
10,438,446 B2 10/2019 Nguyen
10,445,978 B2 10/2019 Nguyen
10,796,679 B1 10/2020 Powell
10,818,133 B2 10/2020 Nguyen
2001/0004607 A1 6/2001 Olsen
2001/0016516 A1 8/2001 Takatsuka
2001/0024971 A1 9/2001 Brossard
2001/0025272 A1 9/2001 Mori
2001/0031659 A1 10/2001 Perrie
2001/0047291 A1 11/2001 Garahi
2002/0006822 A1 1/2002 Krintzman
2002/0042295 A1 4/2002 Walker
2002/0043759 A1 4/2002 Vancura
2002/0045474 A1 4/2002 Singer
2002/0045476 A1 * 4/2002 Poole ..... G07F 17/3244 463/25
2002/0107065 A1 8/2002 Rowe
2002/0107799 A1 * 8/2002 Hoshino ..... G06Q 30/06 705/41
2002/0111210 A1 8/2002 Luciano
2002/0111213 A1 8/2002 McEntee
2002/0113369 A1 8/2002 Weingardt
2002/0116615 A1 8/2002 Nguyen
2002/0133418 A1 9/2002 Hammond
2002/0137217 A1 9/2002 Rowe
2002/0142825 A1 10/2002 Lark
2002/0145051 A1 10/2002 Charrin
2002/0147047 A1 10/2002 Letovsky
2002/0147049 A1 10/2002 Carter
2002/0151366 A1 10/2002 Walker
2002/0152120 A1 10/2002 Howington
2002/0167536 A1 11/2002 Valdes
2002/0177483 A1 11/2002 Cannon
2002/0183105 A1 12/2002 Cannon
2003/0001338 A1 1/2003 Bennett
2003/0003996 A1 1/2003 Nguyen
2003/0004871 A1 1/2003 Rowe
2003/0008696 A1 1/2003 Abecassis
2003/0013531 A1 * 1/2003 Rowe ..... G07F 17/3248 463/42
2003/0027635 A1 2/2003 Walker
2003/0064805 A1 4/2003 Wells
2003/0064807 A1 4/2003 Walker
2003/0078094 A1 * 4/2003 Gatto ..... G07F 19/211 463/25
2003/0092480 A1 5/2003 White
2003/0100361 A1 5/2003 Sharpless
2003/0104860 A1 6/2003 Cannon
2003/0104865 A1 6/2003 Itkis
2003/0148809 A1 8/2003 Nelson
2003/0162588 A1 8/2003 Brosnan
2003/0195024 A1 10/2003 Slattery
2003/0199295 A1 10/2003 Vancura
2003/0224852 A1 12/2003 Walker
2003/0224854 A1 12/2003 Joao
2004/0002386 A1 1/2004 Wolfe
2004/0005919 A1 1/2004 Walker
2004/0015619 A1 1/2004 Brown
2004/0023709 A1 2/2004 Beaulieu
2004/0023716 A1 2/2004 Gauselmann
2004/0038736 A1 2/2004 Bryant
2004/0043813 A1 * 3/2004 Chamberlain ..... G07G 5/00 463/25
2004/0048650 A1 3/2004 Mierau
2004/0068460 A1 4/2004 Feeley
2004/0082377 A1 * 4/2004 Seelig ..... G07F 17/32 463/17
2004/0082384 A1 4/2004 Walker
2004/0082385 A1 4/2004 Silva
2004/0094624 A1 5/2004 Fernandes
2004/0106449 A1 6/2004 Walker
2004/0127277 A1 7/2004 Walker
2004/0127290 A1 7/2004 Walker
2004/0137987 A1 7/2004 Nguyen
2004/0142744 A1 7/2004 Atkinson
2004/0147308 A1 7/2004 Walker
2004/0152508 A1 8/2004 Lind
2004/0199631 A1 10/2004 Natsume

(56) References Cited

U.S. PATENT DOCUMENTS

2004/0204233 A1* 10/2004 Saffari ..... G07F 17/32 463/25
2004/0214622 A1 10/2004 Atkinson
2004/0224753 A1 11/2004 O'Donovan
2004/0229671 A1 11/2004 Stronach
2004/0256803 A1 12/2004 Ko
2004/0259633 A1 12/2004 Gentles
2005/0003890 A1 1/2005 Hedrick
2005/0004980 A1 1/2005 Vadjinia
2005/0026696 A1 2/2005 Hashimoto
2005/0033651 A1* 2/2005 Kogan ..... G06Q 30/06 705/26.1
2005/0043996 A1 2/2005 Silver
2005/0054446 A1 3/2005 Kammler
2005/0101376 A1 5/2005 Walker
2005/0101383 A1 5/2005 Wells
2005/0130728 A1 6/2005 Nguyen
2005/0130731 A1 6/2005 Englman
2005/0137014 A1 6/2005 Vetelainen
2005/0143169 A1* 6/2005 Nguyen ..... G07F 17/3209 463/25
2005/0167921 A1* 8/2005 Finocchio ..... A63F 3/06 273/292
2005/0170883 A1 8/2005 Muskin
2005/0181865 A1 8/2005 Luciano, Jr.
2005/0181870 A1 8/2005 Nguyen
2005/0181875 A1 8/2005 Hoehne
2005/0187020 A1 8/2005 Amaitis
2005/0202865 A1* 9/2005 Kim ..... G06Q 30/02 463/17
2005/0202875 A1 9/2005 Murphy
2005/0208993 A1 9/2005 Yoshizawa
2005/0209002 A1 9/2005 Blythe
2005/0221881 A1 10/2005 Lannert
2005/0223219 A1 10/2005 Gatto
2005/0239546 A1 10/2005 Hedrick
2005/0255919 A1 11/2005 Nelson
2005/0273635 A1 12/2005 Wilcox
2005/0277471 A1 12/2005 Russell
2005/0282637 A1 12/2005 Gatto
2006/0009283 A1 1/2006 Englman
2006/0036874 A1 2/2006 Cockerille
2006/0046822 A1 3/2006 Kaminkow
2006/0046830 A1 3/2006 Webb
2006/0046849 A1 3/2006 Kovacs
2006/0068893 A1 3/2006 Jaffe
2006/0068897 A1* 3/2006 Sanford ..... G07F 17/3248 463/25
2006/0073869 A1 4/2006 Lemay
2006/0073888 A1* 4/2006 Nguyen ..... G07F 17/3227 463/27
2006/0073897 A1 4/2006 Englman
2006/0079317 A1 4/2006 Flemming
2006/0121972 A1 6/2006 Walker
2006/0126529 A1 6/2006 Hardy
2006/0148551 A1 7/2006 Walker
2006/0189382 A1 8/2006 Muir
2006/0217170 A1 9/2006 Roireau
2006/0217193 A1 9/2006 Walker
2006/0247028 A1 11/2006 Brosnan
2006/0247035 A1 11/2006 Rowe
2006/0252530 A1 11/2006 Oberberger
2006/0253481 A1 11/2006 Guido
2006/0256135 A1 11/2006 Aoyama
2006/0281525 A1 12/2006 Borissov
2006/0281541 A1 12/2006 Nguyen
2006/0287106 A1 12/2006 Jensen
2007/0004510 A1 1/2007 Underdahl
2007/0026935 A1 2/2007 Wolf
2007/0026942 A1 2/2007 Kinsley
2007/0054739 A1 3/2007 Amaitis
2007/0060254 A1 3/2007 Muir
2007/0060257 A1* 3/2007 Seelig ..... G07F 17/3244 463/16
2007/0060306 A1 3/2007 Amaitis
2007/0060319 A1 3/2007 Block
2007/0060358 A1 3/2007 Amaitis
2007/0077981 A1 4/2007 Hungate
2007/0087833 A1 4/2007 Feeney
2007/0087834 A1 4/2007 Moser
2007/0093299 A1 4/2007 Bergeron
2007/0129123 A1 6/2007 Eryou
2007/0129148 A1 6/2007 Van Luchene
2007/0149279 A1 6/2007 Norden
2007/0149286 A1 6/2007 Bemmel
2007/0159301 A1 7/2007 Hirt
2007/0161402 A1 7/2007 Ng
2007/0184896 A1 8/2007 Dickerson
2007/0184904 A1 8/2007 Lee
2007/0191109 A1 8/2007 Crowder
2007/0207852 A1 9/2007 Nelson
2007/0207854 A1 9/2007 Wolf
2007/0235521 A1* 10/2007 Mateen ..... G07F 19/20 235/379
2007/0238505 A1 10/2007 Okada
2007/0241187 A1 10/2007 Alderucci
2007/0248036 A1 10/2007 Nevalainen
2007/0257430 A1 11/2007 Hardy
2007/0259713 A1 11/2007 Fiden
2007/0259716 A1 11/2007 Mattice
2007/0259717 A1 11/2007 Mattice
2007/0265984 A1 11/2007 Santhana
2007/0270213 A1 11/2007 Nguyen
2007/0275777 A1 11/2007 Walker
2007/0275779 A1 11/2007 Amaitis
2007/0281782 A1 12/2007 Amaitis
2007/0281785 A1 12/2007 Amaitis
2007/0298858 A1* 12/2007 Toneguzzo ..... G07F 17/3237 463/16
2007/0298873 A1 12/2007 Nguyen
2008/0013906 A1 1/2008 Matsuo
2008/0015032 A1 1/2008 Bradford
2008/0020824 A1 1/2008 Cuddy
2008/0020845 A1 1/2008 Low
2008/0032787 A1 2/2008 Low
2008/0070652 A1 3/2008 Nguyen
2008/0070681 A1 3/2008 Marks
2008/0076505 A1 3/2008 Nguyen
2008/0076506 A1 3/2008 Nguyen
2008/0076548 A1 3/2008 Paulsen
2008/0076572 A1 3/2008 Nguyen
2008/0096650 A1 4/2008 Baerlocher
2008/0102916 A1 5/2008 Kovacs
2008/0102935 A1* 5/2008 Finnimore ..... G07F 17/3248 463/25
2008/0102956 A1 5/2008 Burman
2008/0102957 A1 5/2008 Burman
2008/0108401 A1 5/2008 Baerlocher
2008/0113772 A1 5/2008 Burrill
2008/0119267 A1 5/2008 Denlay
2008/0139274 A1 6/2008 Baerlocher
2008/0146321 A1 6/2008 Parente
2008/0146344 A1 6/2008 Rowe
2008/0150902 A1 6/2008 Edpalm
2008/0153583 A1 6/2008 Huntley
2008/0161110 A1 7/2008 Campbell
2008/0167106 A1 7/2008 Lutnick
2008/0167118 A1* 7/2008 Kroeckel ..... G07F 17/3244 463/31
2008/0167130 A1* 7/2008 Kroeckel ..... G07F 17/3248 463/29
2008/0182667 A1 7/2008 Davis
2008/0207307 A1 8/2008 Cunningham, II
2008/0214258 A1 9/2008 Brosnan
2008/0214310 A1 9/2008 Brunet De Courssou
2008/0215319 A1 9/2008 Lu
2008/0234047 A1 9/2008 Nguyen
2008/0238610 A1 10/2008 Rosenberg
2008/0248849 A1 10/2008 Lutnick
2008/0248865 A1 10/2008 Tedesco
2008/0252419 A1 10/2008 Batchelor
2008/0254878 A1 10/2008 Saunders
2008/0254881 A1 10/2008 Lutnick

(56) References Cited

U.S. PATENT DOCUMENTS

2008/0254883 A1 10/2008 Patel
2008/0254891 A1 10/2008 Saunders
2008/0254892 A1 10/2008 Saunders
2008/0254897 A1 10/2008 Saunders
2008/0263173 A1 10/2008 Weber
2008/0268959 A1 10/2008 Bryson
2008/0300058 A1 12/2008 Sum
2008/0305864 A1 12/2008 Kelly
2008/0305865 A1 12/2008 Kelly
2008/0305866 A1 12/2008 Kelly
2008/0311994 A1 12/2008 Amaitis
2008/0318669 A1 12/2008 Buchholz
2008/0318686 A1 12/2008 Crowder
2009/0005165 A1 1/2009 Arezina
2009/0011822 A1 1/2009 Englman
2009/0017906 A1 1/2009 Jackson
2009/0021381 A1 1/2009 Kondo
2009/0029766 A1 1/2009 Lutnick
2009/0054149 A1 2/2009 Brosnan
2009/0061990 A1* 3/2009 Schwartz ..... G07F 17/3248 463/25
2009/0069063 A1 3/2009 Thomas
2009/0077396 A1 3/2009 Tsai
2009/0088258 A1 4/2009 Saunders
2009/0098925 A1 4/2009 Gagner
2009/0104977 A1 4/2009 Zielinski
2009/0104983 A1 4/2009 Okada
2009/0118002 A1 5/2009 Lyons
2009/0118013 A1 5/2009 Finnimore
2009/0118022 A1 5/2009 Lyons
2009/0124366 A1 5/2009 Aoki
2009/0124390 A1 5/2009 Seelig
2009/0131146 A1 5/2009 Arezina
2009/0131151 A1 5/2009 Harris
2009/0131155 A1* 5/2009 Hollibaugh ..... G07F 17/3255 463/43
2009/0132163 A1 5/2009 Ashley, Jr.
2009/0137255 A1 5/2009 Ashley, Jr.
2009/0138133 A1 5/2009 Buchholz
2009/0143141 A1 6/2009 Wells
2009/0149245 A1 6/2009 Fabbri
2009/0149261 A1 6/2009 Chen
2009/0153342 A1 6/2009 Thorn
2009/0156303 A1 6/2009 Kiely
2009/0163272 A1 6/2009 Baker
2009/0176578 A1 7/2009 Herrmann
2009/0191962 A1 7/2009 Hardy
2009/0197684 A1 8/2009 Arezina
2009/0216547 A1 8/2009 Canora
2009/0219901 A1 9/2009 Bull
2009/0221342 A1 9/2009 Katz
2009/0227302 A1 9/2009 Abe
2009/0239666 A1 9/2009 Hall
2009/0264190 A1 10/2009 Davis
2009/0270166 A1 10/2009 Thukral
2009/0270170 A1 10/2009 Patton
2009/0271287 A1 10/2009 Halpern
2009/0275402 A1* 11/2009 Backover ..... G07F 17/3239 463/29
2009/0275410 A1 11/2009 Kisenwether
2009/0275411 A1 11/2009 Kisenwether
2009/0280910 A1 11/2009 Gagner
2009/0282469 A1 11/2009 Lynch
2009/0298468 A1 12/2009 Hsu
2010/0002897 A1 1/2010 Keady
2010/0004058 A1 1/2010 Acres
2010/0016069 A1 1/2010 Herrmann
2010/0049738 A1 2/2010 Mathur
2010/0056248 A1 3/2010 Acres
2010/0062833 A1 3/2010 Mattice
2010/0062840 A1 3/2010 Herrmann
2010/0079237 A1 4/2010 Falk
2010/0081501 A1 4/2010 Carpenter
2010/0081509 A1 4/2010 Burke
2010/0099499 A1 4/2010 Amaitis
2010/0105454 A1 4/2010 Weber
2010/0106612 A1 4/2010 Gupta
2010/0120486 A1 5/2010 Dewaal
2010/0124967 A1 5/2010 Lutnick
2010/0130276 A1 5/2010 Fiden
2010/0160035 A1 6/2010 Herrmann
2010/0160043 A1 6/2010 Fujimoto
2010/0178977 A1 7/2010 Kim
2010/0184509 A1 7/2010 Sylla
2010/0197383 A1 8/2010 Rader
2010/0197385 A1 8/2010 Aoki
2010/0203955 A1 8/2010 Sylla
2010/0203957 A1* 8/2010 Enzminger ..... G07F 17/32 463/25
2010/0203963 A1 8/2010 Allen
2010/0224681 A1 9/2010 Triplett
2010/0227662 A1 9/2010 Speer, II
2010/0227670 A1* 9/2010 Arezina ..... G07F 17/3248 463/25
2010/0227671 A1 9/2010 Laaroussi
2010/0227687 A1 9/2010 Speer, II
2010/0234091 A1 9/2010 Baerlocher
2010/0279764 A1 11/2010 Allen
2010/0323780 A1 12/2010 Acres
2010/0325703 A1 12/2010 Etchegoyen
2011/0009181 A1 1/2011 Speer, II
2011/0039615 A1 2/2011 Acres
2011/0053679 A1 3/2011 Canterbury
2011/0065492 A1 3/2011 Acres
2011/0076941 A1 3/2011 Taveau
2011/0086696 A1* 4/2011 MacEwan ..... G07F 17/32 463/43
2011/0105216 A1 5/2011 Cohen
2011/0111827 A1 5/2011 Nicely
2011/0111843 A1 5/2011 Nicely
2011/0111860 A1 5/2011 Nguyen
2011/0118010 A1 5/2011 Brune
2011/0159966 A1 6/2011 Gura
2011/0183732 A1 7/2011 Block
2011/0183749 A1 7/2011 Allen
2011/0207525 A1 8/2011 Allen
2011/0212711 A1 9/2011 Scott
2011/0212767 A1 9/2011 Barclay
2011/0223993 A1 9/2011 Allen
2011/0244952 A1 10/2011 Schueller
2011/0263318 A1 10/2011 Agarwal
2011/0269548 A1 11/2011 Barclay
2011/0306400 A1 12/2011 Nguyen
2011/0306426 A1 12/2011 Novak
2012/0015709 A1 1/2012 Bennett
2012/0028703 A1 2/2012 Anderson
2012/0028718 A1 2/2012 Barclay
2012/0034968 A1 2/2012 Watkins
2012/0046110 A1 2/2012 Amaitis
2012/0094769 A1 4/2012 Nguyen
2012/0100908 A1 4/2012 Wells
2012/0108319 A1 5/2012 Caputo
2012/0115591 A1 5/2012 Palermo
2012/0122561 A1 5/2012 Hedrick
2012/0122567 A1 5/2012 Gangadharan
2012/0122584 A1 5/2012 Nguyen
2012/0122590 A1 5/2012 Nguyen
2012/0172130 A1 7/2012 Acres
2012/0184362 A1 7/2012 Barclay
2012/0184363 A1 7/2012 Barclay
2012/0185398 A1 7/2012 Weis
2012/0190426 A1 7/2012 Acres
2012/0194448 A1 8/2012 Rothkopf
2012/0208618 A1 8/2012 Frerking
2012/0231885 A1 9/2012 Speer, II
2012/0239566 A1 9/2012 Everett
2012/0322563 A1 12/2012 Nguyen
2012/0330740 A1 12/2012 Pennington
2013/0005433 A1 1/2013 Holch
2013/0005443 A1 1/2013 Kosta
2013/0005453 A1 1/2013 Nguyen
2013/0059650 A1 3/2013 Sylla
2013/0065668 A1 3/2013 Lemay
2013/0103965 A1 4/2013 Golembeski, Jr.

(56) References Cited

U.S. PATENT DOCUMENTS

| | | | | |
|---|---|---|---|---|
| 2013/0104193 | A1 | 4/2013 | Gatto | |
| 2013/0130766 | A1 | 5/2013 | Harris | |
| 2013/0132745 | A1 | 5/2013 | Schoening | |
| 2013/0165210 | A1 | 6/2013 | Nelson | |
| 2013/0185559 | A1 | 7/2013 | Morel | |
| 2013/0196756 | A1 | 8/2013 | Nguyen | |
| 2013/0196776 | A1 | 8/2013 | Nguyen | |
| 2013/0210513 | A1 | 8/2013 | Nguyen | |
| 2013/0210514 | A1 | 8/2013 | Nguyen | |
| 2013/0210530 | A1 | 8/2013 | Nguyen | |
| 2013/0225279 | A1 | 8/2013 | Patceg | |
| 2013/0225282 | A1 | 8/2013 | Williams | |
| 2013/0252730 | A1 | 9/2013 | Joshi | |
| 2013/0281187 | A1* | 10/2013 | Skelton | G07F 17/3244 463/25 |
| 2013/0281188 | A1 | 10/2013 | Guinn | |
| 2013/0316808 | A1 | 11/2013 | Nelson | |
| 2013/0337878 | A1 | 12/2013 | Shepherd | |
| 2013/0337889 | A1 | 12/2013 | Gagner | |
| 2014/0006129 | A1 | 1/2014 | Heath | |
| 2014/0057716 | A1 | 2/2014 | Massing | |
| 2014/0087862 | A1 | 3/2014 | Burke | |
| 2014/0094295 | A1 | 4/2014 | Nguyen | |
| 2014/0094316 | A1 | 4/2014 | Nguyen | |
| 2014/0121005 | A1 | 5/2014 | Nelson | |
| 2014/0179431 | A1 | 6/2014 | Nguyen | |
| 2014/0274306 | A1 | 9/2014 | Crawford, III | |
| 2014/0274309 | A1 | 9/2014 | Nguyen | |
| 2014/0274319 | A1 | 9/2014 | Nguyen | |
| 2014/0274320 | A1 | 9/2014 | Nguyen | |
| 2014/0274342 | A1 | 9/2014 | Nguyen | |
| 2014/0274357 | A1 | 9/2014 | Nguyen | |
| 2014/0274360 | A1 | 9/2014 | Nguyen | |
| 2014/0274367 | A1 | 9/2014 | Nguyen | |
| 2014/0274388 | A1 | 9/2014 | Nguyen | |
| 2015/0089595 | A1 | 3/2015 | Telles | |
| 2015/0133223 | A1 | 5/2015 | Carter, Sr. | |
| 2015/0143543 | A1 | 5/2015 | Phegade | |
| 2016/0125695 | A1 | 5/2016 | Nguyen | |
| 2016/0358424 | A1* | 12/2016 | Thomas | G07F 17/3272 |
| 2017/0016819 | A1 | 1/2017 | Barwicz | |
| 2017/0116823 | A1 | 4/2017 | Nguyen | |
| 2017/0144071 | A1 | 5/2017 | Nguyen | |
| 2017/0148259 | A1 | 5/2017 | Nguyen | |
| 2017/0148261 | A1 | 5/2017 | Nguyen | |
| 2017/0148263 | A1 | 5/2017 | Nguyen | |
| 2017/0206734 | A1 | 7/2017 | Nguyen | |
| 2017/0228979 | A1 | 8/2017 | Nguyen | |
| 2017/0337770 | A1 | 11/2017 | Nguyen | |
| 2018/0144581 | A1 | 5/2018 | Nguyen | |
| 2019/0005773 | A1 | 1/2019 | Nguyen | |
| 2019/0122490 | A1 | 4/2019 | Nguyen | |
| 2019/0122492 | A1 | 4/2019 | Nguyen | |
| 2019/0213829 | A1 | 7/2019 | Nguyen | |
| 2020/0372753 | A1 | 11/2020 | Nguyen | |

FOREIGN PATENT DOCUMENTS

| | | | |
|---|---|---|---|
| GB | 2096376 | A | 10/1982 |
| GB | 2097570 | A | 11/1982 |
| GB | 2335524 | A | 9/1999 |
| JP | 12005000454 | | 5/2007 |
| WO | 2005073933 | | 8/2005 |
| WO | 2008027621 | | 3/2008 |
| WO | 2009026309 | | 2/2009 |
| WO | 2009062148 | | 5/2009 |
| WO | 2010017252 | | 2/2010 |

OTHER PUBLICATIONS

U.S. Appl. No. 13/843,087, filed Mar. 15, 2013.
U.S. Appl. No. 13/632,743, filed Oct. 1, 2012.
U.S. Appl. No. 13/632,828, filed Oct. 1, 2012.
U.S. Appl. No. 13/833,953, filed Mar. 15, 2013.
U.S. Appl. No. 12/619,672, filed Nov. 16, 2009.
U.S. Appl. No. 13/801,121, filed Mar. 13, 2013.
U.S. Appl. No. 12/581,115, filed Oct. 17, 2009.
U.S. Appl. No. 13/801,076, filed Mar. 13, 2013.
U.S. Appl. No. 13/617,717, filed Nov. 12, 2009.
U.S. Appl. No. 13/633,118, filed Oct. 1, 2012.
U.S. Appl. No. 12/797,610, filed Jun. 10, 2010.
U.S. Appl. No. 13/801,256, filed Mar. 13, 2013.
U.S. Appl. No. 12/757,968, filed Apr. 9, 2010.
U.S. Appl. No. 12/797,616, filed Jun. 10, 2010.
U.S. Appl. No. 13/557,063, filed Jul. 24, 2012.
U.S. Appl. No. 13/833,116, filed Mar. 15, 2013.
U.S. Appl. No. 13/801,271, filed Mar. 13, 2013.
Office Action for U.S. Appl. No. 12/945,888 dated Apr. 10, 2012.
Final Office Action for U.S. Appl. No. 12/945,888 dated Sep. 21, 2012.
Advisory Action for U.S. Appl. No. 12/945,888 dated Jan. 30, 2013.
Office Action for U.S. Appl. No. 12/581,115 dated Dec. 20, 2011.
Final Office Action for U.S. Appl. No. 12/581,115 dated Sep. 13, 2012.
Notice of Allowance for U.S. Appl. No. 12/581,115 dated May 24, 2013.
Office Action for U.S. Appl. No. 12/619,672 dated Dec. 20, 2011.
Final Office Action for U.S. Appl. No. 12/619,672 dated Nov. 6, 2012.
Office Action for U.S. Appl. No. 12/619,672 dated Mar. 7, 2013.
Office Action for U.S. Appl. No. 12/617,717 dated Oct. 4, 2011.
Office Action for U.S. Appl. No. 12/617,717 dated Apr. 4, 2012.
Advisory Action for U.S. Appl. No. 12/617,717 dated Jun. 12, 2011.
Office Action for U.S. Appl. No. 12/617,717, dated Jun. 17, 2013.
Office Action for U.S. Appl. No. 12/797,610 dated Dec. 8, 2011.
Final Office Action for U.S. Appl. No. 12/797,610 dated Jun. 6, 2012.
Office Action for U.S. Appl. No. 12/797,610 dated Feb. 26, 2013.
Office Action for U.S. Appl. No. 12/757,968, dated May 9, 2012.
Final Office Action for U.S. Appl. No. 12/757,968, dated Nov. 29, 2012.
Office Action for U.S. Appl. No. 12/757,968, dated Apr. 25, 2013.
Office Action for U.S. Appl. No. 12/797,616 dated Mar. 15, 2012.
Final Office Action for U.S. Appl. No. 12/797,616 dated Oct. 13, 2012.
Office Action for U.S. Appl. No. 12/797,616 dated Feb. 13, 2013.
Final Office Action for U.S. Appl. No. 12/797,616 dated May 8, 2013.
Office Action for U.S. Appl. No. 13/296,182 dated Dec. 5, 2012.
Brochure, 5000 Ft. Inc., 1 page, Nov. 2010.
Frontier Fortune game, email notification, MGM Resorts Intl., Aug. 9, 2013.
"Getting Back in the Game: Geolocation Can Ensure Compliance with New iGaming Regulations", White Paper, Quova, Inc., 2010.
Notice of Allowance of U.S. Appl. No. 12/619,672, dated Aug. 23, 2013.
Office Action for U.S. Appl. No. 13/633,118, dated Sep. 20, 2013.
Office Action for U.S. Appl. No. 13/801,256, dated Jul. 2, 2013.
Notice of Allowance for U.S. Appl. No. 12/619,672, dated Oct. 3, 2013.
Notice of Allowance for U.S. Appl. No. 12/757,968, dated Oct. 11, 2013.
Office Action for U.S. Appl. No. 12/945,888, dated Jan. 22, 2016.
Final Office Action for U.S. Appl. No. 12/797,616, dated Jun. 12, 2016.
Office Action for U.S. Appl. No. 13/843,087, dated Feb. 25, 2016.
Office Action for U.S. Appl. No. 13/800,917, dated Feb. 25, 2016.
Advisory Action for U.S. Appl. No. 13/632,828, dated Feb. 25, 2016.
Office Action for U.S. Appl. No. 13/801,234, dated Mar. 8, 2016.
Office Action for U.S. Appl. No. 14/216,986, dated Mar. 9, 2016.
Final Office Action for U.S. Appl. No. 13/801,271, dated Mar. 11, 2016.
Office Action for U.S. Appl. No. 13/622,702, dated Mar. 22, 2016.
Final Office Action for U.S. Appl. No. 13/633,118, dated Mar. 24, 2016.

(56) References Cited

OTHER PUBLICATIONS

Final Office Action for U.S. Appl. No. 14/189,948, dated Apr. 6, 2016.
Final Office Action for U.S. Appl. No. 12/797,610, dated Apr. 21, 2016.
Final Office Action for U.S. Appl. No. 14/017,150, dated Apr. 26, 2016.
Final Office Action for U.S. Appl. No. 13/801,121, dated May 11, 2016.
Final Office Action for U.S. Appl. No. 14/017,159, dated Jun. 6, 2016.
Office Action for U.S. Appl. No. 13/801,171, dated Jun. 6, 2016.
Office Action for U.S. Appl. No. 13/843,192, dated Jun. 9, 2016.
Final Office Action for U.S. Appl. No. 12/945,888, dated Jun. 28, 2016.
Notice of Allowance for U.S. Appl. No. 13/833,953, dated Jul. 6, 2016.
Office Action for U.S. Appl. No. 14/211,536, dated Jul. 13, 2016.
Notice of Allowance for U.S. Appl. No. 13/801,076, dated Jul. 11, 2016.
Office Action for U.S. Appl. No. 13/296,182, dated Jul. 20, 2016.
Restriction Requirement for U.S. Appl. No. 13/296,182, dated Oct. 12, 2012.
Advisory Action for U.S. Appl. No. 13/843,192, dated May 8, 2014.
Notice of Allowance for U.S. Appl. No. 13/843,192, dated Aug. 10, 2016.
Office Action for U.S. Appl. No. 14/217,066, dated Dec. 22, 2016.
Final Office Action for U.S. Appl. No. 14/216,986, dated Sep. 23, 2016.
Office Action for U.S. Appl. No. 14/017,159, dated Sep. 23, 2016.
Office Action for U.S. Appl. No. 13/632,743, dated Sep. 23, 2016.
Final Office Action for U.S. Appl. No. 13/801,234, dated Oct. 14, 2016.
Final Office Action for U.S. Appl. No. 13/843,087, dated Oct. 13, 2016.
Final Office Action for U.S. Appl. No. 13/622,702, dated Oct. 13, 2016.
Office Action for U.S. Appl. No. 14/189,948, dated Nov. 7, 2016.
Final Office Action for U.S. Appl. No. 14/211,536, dated Mar. 14, 2014.
Notice of Allowance for U.S. Appl. No. 13/833,116, dated Oct. 11, 2016.
Notice of Allowance for U.S. Appl. No. 13/801,271, dated Dec. 2, 2016.
Notice of Allowance for U.S. Appl. No. 12/797,610, dated Dec. 7, 2016.
Notice of Allowance for U.S. Appl. No. 13/632,828, dated Dec. 16, 2016.
Final Office Action for U.S. Appl. No. 13/801,171, dated Dec. 19, 2016.
Notice of Allowance for U.S. Appl. No. 14/211,536, dated Dec. 28, 2016.
Notice of Allowance for U.S. Appl. No. 13/801,256, dated Jan. 20, 2017.
Office Action for U.S. Appl. No. 13/800,917, dated Feb. 3, 2017.
Final Office Action for U.S. Appl. No. 12/797,616, dated Feb. 10, 2017.
Office Action for U.S. Appl. No. 12/945,888, dated Feb. 28, 2017.
Final Office Action for U.S. Appl. No. 14/189,948, dated Mar. 17, 2017.
Office Action for U.S. Appl. No. 15/400,840, dated Mar. 10, 2017.
Notice of Allowance for U.S. Appl. No. 13/801,121, dated Mar. 29, 2017.
Office Action for U.S. Appl. No. 15/270,333, dated Mar. 30, 2017.
Office Action for U.S. Appl. No. 15/402,945, dated Apr. 5, 2017.
Office Action for U.S. Appl. No. 15/271,488, dated Apr. 19, 2017.
Notice of Allowance for U.S. Appl. No. 13/633,118, dated Aug. 3, 2018.
Office Action for U.S. Appl. No. 15/671,133, dated Aug. 9, 2018.
Office Action for U.S. Appl. No. 15/427,308, dated Aug. 15, 2018.
Office Action for U.S. Appl. No. 15/798,363, dated Aug. 29, 2018.
Office Action for U.S. Appl. No. 15/428,922 dated Sep. 17, 2018.
Office Action for U.S. Appl. No. 15/495,975, dated Sep. 21, 2018.
Notice of Allowance for U.S. Appl. No. 15/271,488, dated Sep. 24, 2018.
Notice of Allowance for U.S. Appl. No. 15/876,095, dated Sep. 24, 2018.
Office Action for U.S. Appl. No. 13/622,702, dated Oct. 3, 2018.
Office Action for U.S. Appl. No. 15/293,751, dated Apr. 6, 2017.
Office Action (Notice of Allowance and Fees Due (PTOL-85)) dated Mar. 31, 2022 for U.S. Appl. No. 16/168,813 (pp. 1-10).
Office Action (Notice of Allowance and Fees Due (PTOL-85)) dated Apr. 14, 2022 for U.S. Appl. No. 16/168,813 (pp. 1-2).
Final Office Action for U.S. Appl. No. 12/797,610, dated Jul. 10, 2013.
Notice of Allowance for U.S. Appl. No. 12/757,968, dated Dec. 18, 2013.
Office Action for U.S. Appl. No. 12/945,889, dated Dec. 18, 2013.
Office Action for U.S. Appl. No. 13/632,828, dated Jul. 30, 2013.
Restriction Requirement for U.S. Appl. No. 13/801,256, dated Dec. 30, 2013.
Office Action for U.S. Appl. No. 13/801,171, dated Dec. 26, 2013.
Office Action for U.S. Appl. No. 13/801,234, dated Jan. 10, 2014.
Final Office Action for U.S. Appl. No. 13/296,182, dated Feb. 12, 2014.
Office Action for U.S. Appl. No. 12/617,717, dated Feb. 25, 2014.
Office Action for U.S. Appl. No. 13/801,076, dated Mar. 28, 2014.
Final Office Action for U.S. Appl. No. 13/633,118, dated Apr. 3, 2014.
Office Action for U.S. Appl. No. 13/843,192, dated Apr. 3, 2014.
Office Action for U.S. Appl. No. 13/632,743, dated Apr. 10, 2014.
Office Action for U.S. Appl. No. 13/801,121, dated Apr. 11, 2014.
Final Office Action for U.S. Appl. No. 12/945,889, dated Jun. 30, 2014.
Notice of Allowance for U.S. Appl. No. 12/617,717, dated Jul. 14, 2014.
Office Action for U.S. Appl. No. 13/801,121, dated Sep. 24, 2014.
Office Action for U.S. Appl. No. 13/801,171, dated Sep. 22, 2014.
Office Action for U.S. Appl. No. 13/801,234, dated Oct. 1, 2014.
Office Action for U.S. Appl. No. 13/801,271, dated Oct. 31, 2014.
Final Office Action for U.S. Appl. No. 13/843,192, dated Oct. 21, 2014.
Office Action for U.S. Appl. No. 13/632,743, dated Oct. 23, 2014.
Office Action for U.S. Appl. No. 12/945,889, dated Oct. 23, 2014.
Office Action for U.S. Appl. No. 13/632,828, dated Nov. 7, 2014.
Office Action for U.S. Appl. No. 12/797,610, dated Dec. 15, 2014.
Final Office Action for U.S. Appl. No. 12/945,889, dated Feb. 12, 2015.
Final Office Action for U.S. Appl. No. 13/801,171, dated Mar. 16, 2015.
Office Action for U.S. Appl. No. 13/833,116, dated Mar. 27, 2015.
Office Action for U.S. Appl. No. 13/632,828, dated Apr. 10, 2015.
Final Office Action for U.S. Appl. No. 13/801,121, dated Apr. 21, 2015.
Final Office Action for U.S. Appl. No. 13/557,063, dated Apr. 28, 2015.
Office Action for U.S. Appl. No. 13/296,182, dated Jun. 5, 2015.
Office Action for U.S. Appl. No. 13/843,192, dated Jun. 19, 2015.
Office Action for U.S. Appl. No. 12/797,610, dated Jul. 14, 2015.
Final Office Action for U.S. Appl. No. 13/833,953, dated Jul. 17, 2015.
Notice of Allowance for U.S. Appl. No. 12/945,889, dated Jul. 22, 2015.
Office Action for U.S. Appl. No. 12/797,616, dated Aug. 10, 2015.
Final Office Action for U.S. Appl. No. 13/801,234, dated Aug. 14, 2015.
Final Office Action for U.S. Appl. No. 13/833,116, dated Sep. 24, 2015.
Office Action for U.S. Appl. No. 13/801,121, dated Oct. 2, 2015.
Office Action for U.S. Appl. No. 14/017,150, dated Oct. 7, 2015.
Office Action for U.S. Appl. No. 14/017,159, dated Oct. 7, 2015.
Office Action for U.S. Appl. No. 13/801,271 dated Oct. 19, 2015.
Office Action for U.S. Appl. No. 14/211,536 dated Oct. 19, 2015.

(56) References Cited

OTHER PUBLICATIONS

Final Office Action for U.S. Appl. No. 13/632,828, dated Oct. 22, 2015.
Office Action for U.S. Appl. No. 14/217,066, dated Dec. 17, 2015.
Notice of Allowance for U.S. Appl. No. 13/557,063, dated Dec. 23, 2015.
Office Action for U.S. Appl. No. 13/296,182, dated Dec. 23, 2015.
Final Office Action for U.S. Appl. No. 13/843,192, dated Dec. 30, 2015.
Office Action for U.S. Appl. No. 13/801,076, dated Jan. 11, 2016.
Final Office Action for U.S. Appl. No. 14/217,066, dated Apr. 21, 2017.
Office Action for U.S. Appl. No. 14/216,986 dated Apr. 26, 2017.
Office Action for U.S. Appl. No. 13/801,171, dated Jun. 14, 2017.
Office Action for U.S. Appl. No. 14/017,159, dated Jun. 29, 2017.
Notice of Allowance for U.S. Appl. No. 15/270,333, dated Jul. 5, 2017.
Final Office Action for U.S. Appl. No. 13/800,917, dated Jul. 13, 2017.
Notice of Allowance for U.S. Appl. No. 13/801,234, dated Jul. 5, 2017.
Notice of Allowance for U.S. Appl. No. 14/217,066, dated Jul. 14, 2017.
Final Office Action for U.S. Appl. No. 14/518,909, dated Jul. 19, 2017.
Non-Final Office Action for U.S. Appl. No. 13/801,121, dated Sep. 15, 2016.
Advisory Action for U.S. Appl. No. 13/801,121, dated Jul. 17, 2015.
Advisory Action for U.S. Appl. No. 13/801,121, dated Jul. 19, 2016.
Notice of Allowance for U.S. Appl. No. 15/293,751, dated Aug. 4, 2017.
Advisory Action for U.S. Appl. No. 14/189,948, dated Jul. 28, 2017.
Final Office Action for U.S. Appl. No. 13/801,256, dated Aug. 15, 2014.
Final Office Action for U.S. Appl. No. 13/801,256, dated Feb. 18, 2015.
Advisory Action for U.S. Appl. No. 13/801,256, dated Dec. 5, 2014.
Office Action for U.S. Appl. No. 13/801,256, dated Jan. 12, 2016.
Final Office Action for U.S. Appl. No. 13/801,256, dated Aug. 16, 2016.
Office Action for U.S. Appl. No. 13/622,702, dated Aug. 31, 2017.
Office Action for U.S. Appl. No. 12/945,888, dated Sep. 1, 2017.
Office Action for U.S. Appl. No. 14/017,150, dated Sep. 7, 2017.
Notice of Allowance for U.S. Appl. No. 14/189,948, dated Sep. 13, 2017.
Office Action for U.S. Appl. No. 15/138,086, dated Oct. 19, 2017.
Notice of Allowance for U.S. Appl. No. 15/402,945 dated Nov. 21, 2017.
Final Office Action for U.S. Appl. No. 13/801,171, dated Dec. 13, 2017.
Final Office Action for U.S. Appl. No. 15/271,488, dated Dec. 21, 2017.
Office Action for U.S. Appl. No. 15/671,133, dated Dec. 22, 2017.
Final Office Action for U.S. Appl. No. 14/216,986, dated Dec. 26, 2017.
Restriction Requirement for U.S. Appl. No. 15/427,307, dated Jan. 17, 2018.
Office Action for U.S. Appl. No. 15/798,363, dated Jan. 26, 2018.
Office Action for U.S. Appl. No. 15/427,291, dated Jan. 29, 2018.
Final Office Action for U.S. Appl. No. 14/017,159, dated Feb. 1, 2018.
Final Office Action for U.S. Appl. No. 13/622,702, dated Feb. 22, 2018.
Office Action for U.S. Appl. No. 15/811,654, dated Feb. 22, 2018.
Final Office Action for U.S. Appl. No. 13/622,702, dated Feb. 27, 2018.
Final Office Action for U.S. Appl. No. 15/427,308, dated Mar. 19, 2018.
Office Action for U.S. Appl. No. 15/876,095, dated Apr. 3, 2018.
Office Action for U.S. Appl. No. 15/835,448, dated Apr. 4, 2018.
Office Action for U.S. Appl. No. 15/427,307, dated Apr. 9, 2018.
Office Action for U.S. Appl. No. 14/216,986, dated Apr. 6, 2018.
Office Action for U.S. Appl. No. 15/426,898 dated Apr. 16, 2018.
Notice of Allowance for U.S. Appl. No. 15/402,945, dated May 25, 2018.
Office Action for U.S. Appl. No. 15/495,973, dated Jun. 4, 2018.
Notice of Allowance for U.S. Appl. No. 15/427,291 dated Jun. 18, 2018.
Notice of Allowance for U.S. Appl. No. 15/271,488, dated Jun. 19, 2018.
Notice of Allowance for U.S. Appl. No. 15/480,295, dated Jun. 20, 2018.
Office Action for U.S. Appl. No. 14/963,106, dated Jun. 22, 2018.
Office Action for U.S. Appl. No. 14/993,055, dated Jun. 22, 2018.
Final Office Action for U.S. Appl. No. 15/427,307, dated Jul. 9, 2018.
Office Action for U.S. Appl. No. 15/674,480, dated Mar. 25, 2021.
Final Office Action for U.S. Appl. No. 16/219,940, dated Mar. 26, 2021.
Office Action for U.S. Appl. No. 16/183,632, dated May 4, 2021.
Office Action for U.S. Appl. No. 16/559,553, dated Jun. 1, 2021.
Notice of Allowance for U.S. Appl. No. 16/579,754, dated Jul. 16, 2021.
Office Action for U.S. Appl. No. 13/622,702, dated Jul. 19, 2021.
Office Action for U.S. Appl. No. 16/357,316, dated Jul. 20, 2021.
Office Action for U.S. Appl. No. 16/993,154, dated Jul. 28, 2021.
Final Office Action for U.S. Appl. No. 16/351,416, dated Sep. 1, 2021.
Office Action for U.S. Appl. No. 15/671,133, dated Sep. 2, 2021.
Notice of Allowance for U.S. Appl. No. 16/794,212, dated Sep. 3, 2021.
Office Action for U.S. Appl. No. 17/020,761, dated Sep. 9, 2021.
Office Action for U.S. Appl. No. 16/916,001, dated Sep. 17, 2021.
Notice of Allowance for U.S. Appl. No. 13/801,171, dated Oct. 31, 2018.
Final Office Action for U.S. Appl. No. 15/835,448, dated Nov. 2, 2018.
Office Action for U.S. Appl. No. 15/480,295, dated Nov. 7, 2018.
Final Office Action for U.S. Appl. No. 14/963,106, dated Dec. 14, 2018.
Final Office Action for U.S. Appl. No. 14/993,055, dated Dec. 14, 2018.
Office Action for U.S. Appl. No. 16/190,050, dated Jun. 1, 2020.
Notice of Allowance for U.S. Appl. No. 15/480,295, dated Jun. 15, 2020.
Office Action for U.S. Appl. No. 16/219,940, dated Jul. 22, 2020.
Office Action for U.S. Appl. No. 16/559,553, dated Sep. 11, 2020.
Office Action for U.S. Appl. No. 16/794,212, dated Sep. 11, 2020.
Restriction Requirement for U.S. Appl. No. 16/600,395, dated Sep. 18, 2020.
Final Office Action for U.S. Appl. No. 16/248,759, dated Oct. 6, 2020.
Final Office Action for U.S. Appl. No. 15/671,133, dated Oct. 7, 2020.
Final Office Action for U.S. Appl. No. 16/357,316, dated Oct. 8, 2020.
Final Office Action for U.S. Appl. No. 16/183,632, dated Oct. 9, 2020.
Office Action for U.S. Appl. No. 16/590,347, dated Oct. 13, 2020.
"Professional Casino Slot Machine", Posted at www.vbtutor.net/VB. Sample/vbslot2.htm on Oct. 20, 2009.
Final Office Action for U.S. Appl. No. 16/559,553, dated Jan. 21, 2021.
Final Office Action for U.S. Appl. No. 16/449,717, dated Jan. 29, 2021.
Notice of Allowance for U.S. Appl. No. 15/811,654, dated Feb. 3, 2021.
Notice of Allowance for U.S. Appl. No. 14/017,150, dated Feb. 5, 2021.
Final Office Action for U.S. Appl. No. 16/794,212, dated Feb. 17, 2021.
Office Action for U.S. Appl. No. 16/351,416, dated Feb. 23, 2021.

(56) References Cited

OTHER PUBLICATIONS

Benston, Liz, "Harrahs Launches iPhone App; Caesars Bypasses Check-in," Las Vegas Sun, Las Vegas, NV. Jan. 8, 2010.
Finnegan, Amanda, "Casinos Connecting with Customers via iPhone Apps" , May 27, 2010, Las Vegas Sun, Las Vegas, NV.
Gaming Today Staff, "Slots showcased at 2009 National Indian Gaming Assoc.", GamingToday.com, Apr. 14, 2009.
Green, Marian,"Testing Texting Casino Journal", Mar. 2, 2009.
Hasan, Ragib, et al., "A Survey of Peer-to-Peer Storage Techniques for Distributed File Systems", National Center for Supercomputing Applications, Department of Computer Science, University of Illinois at Urbana Champaign, Jun. 27, 2005.
Jones, Trahern, "Telecon-equipped drones could revolutionize wireless market", azcentral.com, http://www.azcentral.com/business/news/articles/20130424telecom-equipped-drones-could-revolutionize-wireless-market.html, downloaded Jul. 2, 2013, 2 pages.
Yancey, Kitty Bean, "Navigate Around Vegas with New iPhone Apps", USA Today, Jun. 3, 2010.
IAPS, Daily Systems LLC, 2010.
U.S. Appl. No. 12/945,888, filed Nov. 14, 2010.
U.S. Appl. No. 12/945,889, filed Nov. 14, 2010.
U.S. Appl. No. 13/622,702, filed Sep. 19, 2012.
U.S. Appl. No. 13/800,917, filed Mar. 13, 2013.
U.S. Appl. No. 13/296,182, filed Nov. 15, 2011.
U.S. Appl. No. 13/801,234, filed Mar. 13, 2013.

* cited by examiner

| | | |
|---|---|---|
| 1902 | **Voucher ID** | **B** |
| 1904 | Forward Reference | Voucher C |
| 1906 | Backward Reference | Voucher A |
| 1908 | Time of Issuance | Tuesday, March 15, 2016; 9:02pm |
| 1910 | Location | Casino ABC, 2nd Floor, Section 8, Row 27 |
| 1912 | Node Type | Slot Machine, ID = #1234 |
| 1914 | Voucher Credit Amount | $60 |
| 1916 | Player ID | Anonymous |
| 1918 | Redeem Confirmation No | |

FIG. 19

| | | |
|---|---|---|
| 2002 | **Voucher ID** | **B** |
| 2004 | Game Type | Slot |
| 2006 | Game Theme | Super Duper Double Diamonds |
| 2008 | Number of Games Played in Session | 70 |
| 2010 | Number of Games Won in Session | 30 |
| 2012 | Jackpots/Bonus Won | 0 |
| 2014 | Net Win | $40 |
| 2016 | Average Rate of Play | 4.5 seconds/game |

FIG. 20

| | | |
|---|---|---|
| 2102 | **Voucher ID** | **B** |
| 2104 | Redeem Timestamp | Tuesday, March 15, 2016; 9:02pm |
| 2106 | Location | Casino ABC, 2nd Floor, Section 8, Row 27 |
| 2108 | Redeem Amount | $60 |
| 2110 | Player ID | Anonymous |
| 2112 | Node Type | Blackjack Table, ID = #34 |
| 2114 | Voucher Credit Amount | $60 |
| 2116 | Player ID | Anonymous |
| 2118 | Redeem Confirmation No | |

FIG. 21

| | | |
|---|---|---|
| 2202 | **Voucher ID** | **K** |
| 2204 | Forward Reference(s) | Voucher L |
| 2206 | Backward Reference(s) | Voucher H; Voucher J |
| 2208 | Time of Issuance | Tuesday, March 15, 2016; 9:02pm |
| 2210 | Location | Casino ABC, 2nd Floor, Section 8, Row 27 |
| 2212 | Node Type | Slot Machine, ID = 1434 |
| 2214 | Voucher Credit Amount | $60 |
| 2216 | Player ID | Anonymous |
| 2218 | Redeem Confirmation No | |

FIG. 22

GAMING MONETARY INSTRUMENT TRACKING SYSTEM

RELATED APPLICATIONS

The present application is a continuation of and claims priority to U.S. patent application Ser. No. 16/168,813, filed Oct. 23, 2018, and entitled "Gaming Monetary Instrument Tracking System" which is claims priority to U.S. Provisional Patent Application No. 62/576,048, filed Oct. 23, 2017, and entitled "Gaming Monetary Instrument Tracking System," all of which are hereby incorporated by reference herein in their entireties.

FIELD

The present invention relates generally to gaming networks, and more particularly to financial transactions and monetary instruments for gaming networks.

BACKGROUND

It is generally well known that casinos and other gaming establishments are vulnerable to fraud and other financial crimes because of the nature of their operations. Typically casinos and gaming institutions can be fast-paced, cash-intensive businesses that provide a broad array of financial products and services, some of which are similar to those provided by depository institutions and money service businesses. A common provision involves the use of a physical instrument having a cash or monetary value, such as a printed ticket or cash voucher. Such monetary instruments can be subject to criminals wishing to engage in suspect activities, however, such as fraud or anonymous money laundering that might exploit problems with the provided monetary instrument systems. There can also be features that help promote customer services and interest, such as advertisements or coupons on printed cash vouchers.

While gaming monetary instruments and systems have worked well in practice over many years, there is always a desire to improve the security, functionality, and efficiency of these items and systems. What is desired then are improved gaming monetary systems, particularly with respect to the ability to provide greater tracking for fraud prevention and to provide improved customer services to players.

SUMMARY

It is an advantage of the present disclosure to provide useful data and tracking for monetary instruments across gaming systems. In particular, such data can be useful for tracking activity patterns regarding anonymous gaming monetary instruments, such as printed tickets or vouchers having a cash value. This can be accomplished at least in part through the use of system nodes and a system server in communication therewith, with these system items having improved abilities with respect to the generation and organization of data, data structures, and historical records that can be associated with some or all of the gaming monetary instruments used within the system.

In various embodiments of the present disclosure, a gaming monetary instrument tracking system can include a plurality of system nodes and a system server coupled thereto. Some or all of the system nodes can be configured to generate data with respect to gaming monetary instruments associated with the gaming instrument tracking system, where each of the gaming monetary instruments have a monetary value associated therewith. Some or all of the system nodes can also be configured to issue new gaming monetary instruments associated with the system. The system server can be configured to receive data generated by the system nodes and create data structures that link multiple gaming monetary instruments with each other according to multiple different transactions regarding the multiple gaming monetary instruments at different times and across multiple different nodes from the plurality of system nodes.

In various detailed embodiments, the system nodes can include electronic gaming kiosks, electronic gaming machines, and electronic gaming tables. Also, the system server can be configured to facilitate issuance at a first system node of a first gaming monetary instrument associated with the gaming instrument tracking system, to associate a first data structure with the first gaming monetary instrument, and to generate and store a first historical record for the first gaming monetary instrument. The first historical record can account for an entire monetary value of the first gaming monetary instrument, with the entire monetary value involving different transactions at different times and at different nodes from the plurality of system nodes. In some embodiments, the first historical record includes unique identifiers regarding cash value instruments used for the monetary value of the first gaming monetary instrument, which unique identifiers can include a serial number from a cash note. In various embodiments, the first gaming monetary instrument is a printed ticket having a cash value. Further, the first gaming monetary instrument can be transferable, where neither the first gaming monetary instrument nor the first historical record includes any data regarding a specific person.

In various detailed embodiments, the system server can be further configured to receive new data regarding acceptance of the first gaming monetary instrument at a second system node, and to update the first data structure with the new data. In addition, the system server can be further configured to facilitate issuance at the second system node a second gaming monetary instrument, to associate the first data structure with the second gaming monetary instrument, and to generate and store a second historical record for the second gaming monetary instrument, and wherein the second historical record includes data from the first historical record in addition to new data regarding the second system node.

In various embodiments of the present disclosure, a gaming monetary instrument tracking system can include at least a system server coupled to multiple system nodes across a gaming system, each of the multiple system nodes being configured to generate data with respect to gaming monetary instruments having monetary values associated therewith. The system server in such embodiments can be configured to at least receive data generated by the multiple system nodes, facilitate the creation of a first gaming monetary instrument at one of the multiple system nodes, the first gaming monetary instrument having a first monetary value associated therewith, create a first data structure for the first gaming monetary instrument, the first data structure including data regarding multiple different transactions at multiple different times and at multiple different nodes from the plurality of system nodes, and generate a historical record for the first gaming monetary instrument based on the first data structure, wherein the historical record accounts for the entire first monetary value and includes monetary values from at least two related, previously issued, and expired gaming monetary instruments.

In various detailed embodiments, the system server may be configured to analyze the historical record with respect to one or more predefined gaming activity patterns, provide an alert to casino personnel when the analyzing results in detection of a suspicious gaming activity pattern, and/or provide a specific reward to a player when the analyzing results in detection of a player rewardable gaming activity pattern. The system server may be configured to accept the first gaming monetary instrument at a second node of the multiple system nodes, provide a monetary credit at the second node, and update the first data structure to reflect the accepting and providing at the second node.

In still further embodiments, a computer implemented method for facilitating monetary instrument tracking in a casino gaming network can cause at least one processor to execute a plurality of instructions involving all or some of the foregoing features in any desired combination.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed inventive apparatuses, systems and methods for gaming monetary instrument tracking. These drawings in no way limit any changes in form and detail that may be made to the disclosure by one skilled in the art without departing from the spirit and scope of the disclosure.

FIG. 19 provides a chart of exemplary envelope data for a gaming monetary instrument from FIGS. 12-13 according to one embodiment of the present disclosure.

FIG. 20 provides a chart of exemplary session data for a gaming monetary instrument from FIGS. 12-13 according to one embodiment of the present disclosure.

FIG. 21 provides a chart of exemplary redemption data for a gaming monetary instrument from FIGS. 12-13 according to one embodiment of the present disclosure.

FIG. 22 provides a chart of exemplary envelope data for a gaming monetary instrument from FIGS. 14-15 according to one embodiment of the present disclosure.

DETAILED DESCRIPTION

Figure 1:
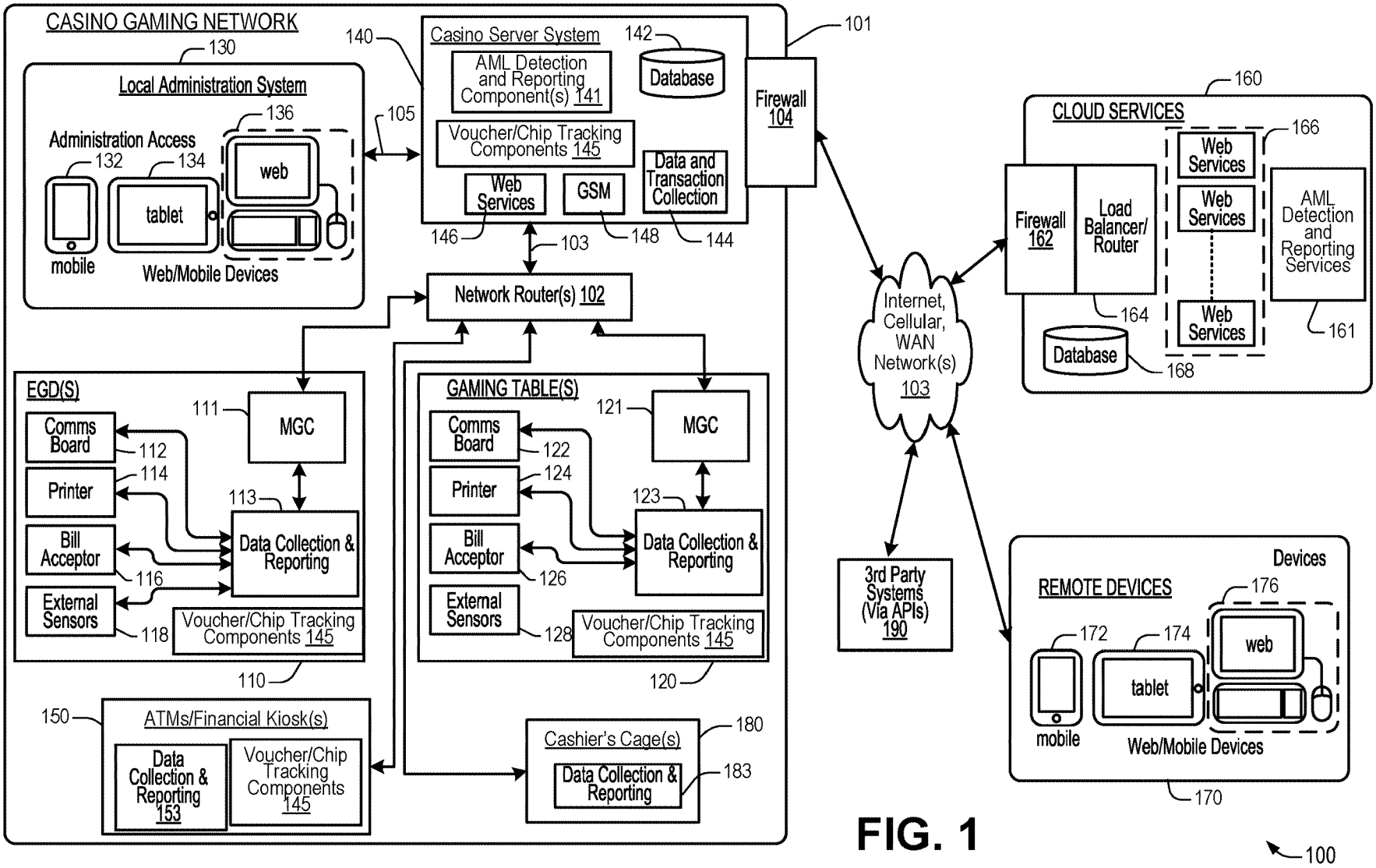
FIG. 1 illustrates in block diagram format an exemplary wide area electronic gaming network utilizing multiple financial instrument handling devices and various other system components across multiple locations according to one embodiment of the present disclosure.

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to devices, systems, and methods for providing, conducting and facilitating the automated issuance and tracking of gaming monetary instruments, creating data structures and historical records thereof so as to link transactional activities across multiple system nodes and instruments, and also providing records, alerts, and other promotions or features related thereto. One aspect disclosed herein is directed to different methods, systems, and computer program products for facilitating automated tracking, recording, and follow up activities regarding gaming monetary instrument activities implemented in and across a casino gaming network. At least one system processor may be caused to execute a plurality of instructions related to such automated tracking, recording, and follow up activities.

Casinos and other gaming establishments are vulnerable to fraud and other financial crimes because of the nature of their operations. These gaming institutions can be fast-paced, cash-intensive businesses that provide a broad array of financial products and services, some of which are similar to those provided by depository institutions and money service businesses. Moreover, these gaming institutions tend to serve a diverse and transient customer base about which they may have relatively little knowledge. Nevertheless, many gaming institutions still utilize physical instruments having a cash or monetary value, such as printed tickets or cash vouchers. Such monetary instruments can be subject to criminals wishing to engage in suspect activities, however, such as fraud or anonymous money laundering that might exploit problems with the provided monetary instrument systems. There can also be features that help promote customer services and interest, such as advertisements or coupons on printed cash vouchers.

Both state-licensed and tribal casinos typically offer games where players essentially bet against the casino or "house." Examples of such games are blackjack, roulette, slot machines, bingo, keno, and the like. Casinos also offer customers a variety of financial services, including maintaining accounts, accepting deposits into these accounts, issuing credit and receiving payments on credit, cashing checks, issuing casino checks, sending and receiving wire transfers, and exchanging currency. Many financial transactions take place at the "cage" or casino bank or window. Financial transactions may also occur at casino gaming areas, where players can buy tokens for slot machines or chips for table games. Card clubs offer many of the same financial services as traditional casinos Like casinos, card clubs may maintain a cage where cashiers conduct financial transactions. However, unlike casinos, card clubs rarely extend credit to customers.

Casinos, card clubs, and other gaming establishments that are subject to the federal Bank Secrecy Act ("BSA") may desire to implement fraud detection programs that include procedures for detecting and reporting suspicious transactions (e.g., money laundering, counterfeiting, electronic tampering, theft, etc.), and for assisting with the identification and reporting of such suspicious transactions. Various embodiments of fraud detection and reporting techniques described herein are directed to different methods and systems for enabling automated, rule-based monitoring, analysis, detection and reporting of suspicious activities relating to financial or monetary transactions (referred to herein as "financial transactions") conducted in casino gaming establishments, casino networks, and/or non-casino environments. Examples of various types of financial transactions may include, but are not limited to, one or more of the following (or combinations thereof):

- cash transactions;
- cash in transactions;
- cash out transactions;
- credit transactions;
- wagering transactions;
- money exchange transactions;
- money deposit transactions;
- money withdrawal transactions;
- wagering token transactions;
- payout transactions;
- purchase transactions;
- money transfer transactions;
- and/or other types of financial transactions which may occur at casino gaming establishments and/or casino networks.

One or more of these transactions may occur at various casino-related devices, machines, systems, and/or locations of the casino environment such as, for example, one or more of the following (or combinations thereof):

- slot machines;
- mobile gaming devices;
- gaming tables (e.g., poker, black jack, baccarat, etc.);
- electronic gaming machines (EGMs); ATMs;
- financial kiosks;
- cashier cages;

Other transactions may occur at various devices, machines, systems, and/or locations of non-casino environments such as, for example, one or more of the following (or combinations thereof):

- computer terminals;
- tablets;
- smart phones;
- and/or other types of electronic devices which may be authorized or approved to function as a wager-based gaming device.

According to different embodiments, information relating to casino-related financial transactions may be captured (e.g., in real-time or non-real-time) at the device or system where the financial transaction is taking place, and uploaded (e.g., in real-time or non-real-time) to a central server. For purposes of discussion, the devices and systems where financial transactions take place can generally be referred to as "system nodes," while the central server can be referred to as a "system server" that is in communication with the system nodes. For example, at the casino gaming devices and/or game tables, players may either deposit their money (cash and/or ticket vouchers), or put up credits (pre-established credit accounts), as well as removing them. Regardless, these types of data may be captured, uploaded, and analyzed for suspicious activities. Preferably, the capturing and uploading of the financial transaction information may be performed in real-time so as to allow the casino to detect and respond to potential fraud and other suspicious activities in a timely manner. All such criminal and suspicious activities will generally be referred to as "fraud" or "fraudulent" type activities throughout the various discussions herein. In addition, the financial transaction information can also be used to provide other benefits to the casino and players, such as with respect to anonymous player tracking and rewards provisions. Analysis, detection, and alerts can take place at the system server and/or another suitable network device.

In at least one embodiment, the uploaded financial transaction information may be analyzed at a casino server system for detection of suspicious fraudulent activities. Financial transactions which are flagged as potentially suspicious fraudulent activities may be logged, and additional analysis may be performed if specific triggering criteria is satisfied. For example, in at least one embodiment, a multi-step analysis process may be utilized for suspicious money laundering activity analysis, whereby all (or selected) financial transactions are each initially screened and analyzed for one or more triggering events/conditions which, if satisfied, may necessitate additional (in-depth) suspicious fraudulent activity analysis of the identified financial transaction. For example, in some embodiments, less than 1% of the total casino-related financial transactions analyzed may undergo in-depth suspicious fraudulent activity analysis.

By way of example, in one embodiment, in-depth suspicious fraudulent activity analysis may be triggered in response to detecting that total consecutive money cashed in (e.g., for a given player over a given time period such as, for example, 3 minutes) exceeds $3000 or some other specified threshold value.

In some embodiments, a substantial cash in (e.g., at least $3000), follow by a minimum amount of gaming (e.g., at least 3 games of at least $20 wager each), followed by a cash out, can trigger a deeper analysis for suspicious fraudulent activity.

In some embodiments, in-depth suspicious fraudulent activity analysis may be triggered in response to detecting that cumulative money cashed in for a given player over a given time period exceeds some specified threshold value. For example, frequent money-in into a gaming terminal, at 3-minute to 5-minute intervals, of $3000 or more each time, for a total of more than $10,000 in 15 minutes, may trigger a deeper analysis for suspicious fraudulent activity.

In some embodiments, in-depth suspicious fraudulent activity analysis may be triggered in response to detecting that total consecutive money cashed out (e.g., for a given player over a given time period) such exceeds some specified threshold value. For example, frequent cash-out events at a gaming terminal, at 1-minute to 5-minute intervals, of $2000 or more each time, for a total of more than $9,000 over a 20-minute time window, may trigger a deeper analysis for suspicious fraudulent activity.

In some embodiments, in-depth suspicious fraudulent activity analysis may be triggered in response to detecting that total money cashed out (for a given player over a given time period) exceeds some specified threshold value.

In yet other embodiments, the triggering of in-depth suspicious fraudulent activity analysis may be based, at least partially, on statistical information relating to one or more group(s) of gaming devices over a period of time, and/or may be based, at least partially, on statistical information relating to other types of financial transactions which occur over one or more specified time periods(s).

For example, financial transactions for a given gaming device (or a specified group of gaming devices) may be averaged over a specified time period or time interval (e.g., 90 days) to establish a relative baseline of what a "normal" transaction is for that particular gaming device (or group of gaming devices). Any detected financial transactions (new and/or historical) associated with the identified gaming device (or associated with one or more gaming devices of the identified group of gaming device) may then be compared to the baseline "normal" transaction. If, based on the results of the comparison(s), it is determined that an identified transaction exceeds predefined threshold comparison criteria (e.g., greater than 3 sigmas or 3 standard deviations higher than the baseline "normal" transaction), such a determination may trigger in-depth suspicious fraudulent activity analysis of the identified new transaction.

By way of illustration, in one example, a statistical average analysis may be performed for cash-in transactions occurring at an identified gaming device over a 3-month time period. Based on this analysis it may be determined that the baseline "normal" cash-in transaction value and standard deviation value for the identified gaming device is $300, +/−$200. In one embodiment, the $300 value may represent the baseline "normal" cash-in transaction, and the "+/−$200" value may represent one standard deviation. One of the cash-in transactions which occurred during the analyzed 3-month time period relates to a cash-in transaction for $3000. This identified transaction may be determined to be about 13.5× standard deviations higher than the calculated baseline "normal" cash-in transaction for the identified gaming device, which may cause the triggering of in-depth suspicious fraudulent activity analysis to be performed on the identified transaction. Another, (new) cash-in transaction for $1800 is detected at the identified gaming device. This newly identified transaction may be determined to be about 7.5× standard deviations higher than the calculated baseline "normal" cash-in transaction for the identified gaming device, which may cause the triggering of in-depth suspicious fraudulent activity analysis to be performed on the newly identified transaction.

Similarly, in at least one embodiment, a statistical average analysis may be performed for cash-out transactions occurring at an identified gaming device over a 200-day moving time period. Based on this analysis it may be determined that the 200-day moving average, or the baseline "normal" cash-out transaction value and standard deviation value for the identified gaming device is $200, +/−$100. In one embodiment, the $200 value may represent the baseline "normal" cash-out transaction, and the "+/−$100" value may represent one standard deviation. One of the cash-out transactions which occurred during the analyzed 200-day moving time period relates to a cash-out transaction for $2000. This identified transaction may be determined to be about 18× standard deviations higher than the calculated baseline "normal" cash-out transaction for the identified gaming device, which may cause the triggering of in-depth suspicious fraudulent activity analysis to be performed on the identified transaction. Another, (new) cash-out transaction for $800 is detected at the identified gaming device. This newly identified transaction may be determined to be about 6× standard deviations higher than the calculated baseline "normal" cash-out transaction for the identified gaming device, which may cause the triggering of in-depth suspicious fraudulent activity analysis to be performed on the newly identified transaction.

In some embodiments, multiple different types of baseline "normal" transaction values and associated standard deviation values may be calculated for a given gaming device (or given group of gaming devices), which, for example, may be based on analysis of filtered sets of financial transaction data occurring at the identified gaming device (or identified group of gaming devices) over different time periods such as, for example, one or more of the following (or combinations thereof):

Hours
Days
Weeks
Months
Weekdays
Weekends
Holidays
Specified time of day (e.g., financial transactions which occur between Bpm-2 am)
Specified day(s) of the week (e.g., financial transactions which occur on Fridays and Saturdays)
Specified month(s) of the year (e.g., financial transactions which occur in July and September)

In some embodiments, general trends relating to the fluctuation of baseline "normal" financial transactions over different time periods at a given gaming device (or given group of gaming devices) may be analyzed in order to determine one or more types of baseline "normal" transaction values and corresponding standard deviation values to be associated with the identified gaming device (or identified group of gaming devices).

For example, in some casino environments, it may be observed that the average wager amounts and/or cash-in amounts on Friday nights and Saturday nights are relatively higher than the average wager amounts and/or cash-in amounts on weekday nights. One reason for this may be attributable to the tendency for casinos to increase their minimum wager amounts at table games and/or other gaming devices on Friday nights and Saturday nights. Accordingly, in at least one embodiment, it may be desirable to calculate a separate "Friday-Saturday" baseline "normal" cash-in transaction value and related standard deviation value for an identified gaming device (or identified group of gaming devices). In one embodiment, the "Friday-Saturday" baseline "normal" cash-in transaction value and related standard deviation value may be determined by analyzing a filtered set of cash-in transactions which occur at the identified gaming device (or group of gaming devices) on Fridays and Saturdays over a specified time period (such as, for example, 3 consecutive months). If desired, a separate the "Friday-Saturday night" baseline "normal" cash-in transaction value and related standard deviation value may be determined, for example, by analyzing a filtered set of cash-in transactions which occur at the identified gaming device (or group of gaming devices) on Fridays and Saturdays between the hours of 5 μm and 2 am over a specified time period (such as, for example, the last 100 days).

Non-limiting examples of various types of baseline "normal" transaction criteria and associated standard deviation criteria which may be calculated for a given gaming device (or given group of gaming devices) may include one or more of the following (or combinations thereof):

average 3 month baseline "normal" cash-in transaction and associated standard deviation (time period: 3 consecutive months, transaction filter: all days of week)
average 6 month-weekend baseline "normal" cash-in transaction and associated standard deviation (time period: 6 consecutive months, transaction filter: only Friday and Saturday transactions)
average 12 month-Friday baseline "normal" cash-in transaction and associated standard deviation (time period: 12 consecutive months, transaction filter: only Friday transactions)
average 4 month baseline "normal" cash-out transaction and associated standard deviation (time period: 4 consecutive months, transaction filter: all days of week)
average 100 day-weekend baseline "normal" cash-out transaction and associated standard deviation (time period: last 100 days, transaction filter: only Friday and Saturday transactions)
average 12 month-Friday baseline "normal" cash-out transaction and associated standard deviation (time period: 12 consecutive months, transaction filter: only Friday transactions)

It will be appreciated that the various types of baseline "normal" transaction and standard deviation criteria which may be generated and utilized for triggering of in-depth suspicious fraudulent activity analysis may depend upon the desired types of financial transaction filter criteria to be applied (such as, for example, time period filter criteria, transaction date filter criteria, transaction day of week filter criteria, transaction time filter criteria, etc.). Additionally, in at least some embodiments, the range of acceptable standard deviation variance may also be used as a definable criteria for triggering of in-depth suspicious fraudulent activity analysis. For example, any transactions which have been identified as exceeding 4× standard deviations from the baseline "normal" transaction may be flagged for in-depth suspicious fraudulent activity analysis.

In some embodiments, one or more detected transactions occurring at a given gaming device (or group of gaming devices) may be analyzed and compared against multiple different types of baseline "normal" transaction and standard deviation criteria. For example, in one embodiment, a cash-in transaction for $1500 occurring at a specific gaming device on a Friday evening may be analyzed and compared against each of the following types of baseline "normal" transaction and standard deviation criteria:

average 3 month baseline "normal" cash-in transaction and associated standard deviation (time period: 3 consecutive months, transaction filter: all days of week): $300+/−$200; triggering of in-depth suspicious fraudulent activity analysis occurs for cash-in transactions which exceed 3× standard deviations;
average 6 month-weekend baseline "normal" cash-in transaction and associated standard deviation (time period: 6 consecutive months, transaction filter: only Friday and Saturday transactions): $425+/−$250; triggering of in-depth suspicious fraudulent activity analysis occurs for cash-in transactions which exceed 4× standard deviations;
average 12 month-Friday baseline "normal" cash-in transaction and associated standard deviation (time period: 12 consecutive months, transaction filter: only Friday transactions): $450+/−$225; triggering of in-depth suspicious fraudulent activity analysis occurs for cash-in transactions which exceed 5× standard deviations;

In at least one embodiment, the results of the baseline comparison analyses for the identified $1500 cash-in transaction may be as shown below:

i. Results of comparison to average 3 month baseline "normal" cash-in transaction: 6× standard deviation; determined to exceed 3× standard deviation criteria.

ii. Results of comparison to average 6 month-weekend baseline "normal" cash-in transaction: 4.3× standard deviation; determined to exceed 4× standard deviation criteria.

iii. Results of comparison to average 12 month-Friday baseline "normal" cash-in transaction: 4.66× standard deviation; determined not to exceed 5× standard deviation criteria;

In at least one embodiment, if, based on the baseline comparison analyses, the identified $1500 cash-in transaction is determined to exceed standard deviation criteria associated the one or more of the baseline "normal" transaction criteria (which it has, as indicated by the results of (i) and (ii) above), then the identified $1500 cash-in transaction may be flagged for in-depth suspicious fraudulent activity analysis. In other embodiments, the identified $1500 cash-in transaction may be flagged for in-depth suspicious fraudulent activity analysis only if it is determined to exceed standard deviation criteria associated the all (or some specified combination such as, for example, at least two) of the baseline "normal" transaction criteria.

According to different embodiments, the techniques for analyzing selected financial transaction information and determining the various baseline "normal" transaction and standard deviation criteria (e.g., such as those described above with respect to single or individual gaming devices) may similarly be applied to one or more sets or groups of gaming devices. For example, in some embodiments, a statistical average analysis may be performed for cash-in transactions occurring at one or more identified group(s) of gaming devices over a specified time period. Similarly, in some embodiments, a statistical average analysis may be performed for cash-out transactions occurring at one or more identified group(s) of gaming devices over a specified time period.

In some embodiments, various types of pattern recognition techniques may be utilized or employed for identifying suspicious financial transactions which may correspond to one or more different types of fraudulent activities. Non-limiting examples of pattern recognition techniques may include, but are not limited to, one or more of the following (or combinations thereof):

1) Pattern recognition by location. Example: Group of gaming devices that are within a predefined proximity to each other (e.g., 20-meter proximity), and exhibit similar suspicious fraudulent activities. Location-based analysis may also encompass larger geographical areas such as city, state, region, or even the entire country.
2) Pattern recognition by time. Example: Group of gaming devices that exhibit similar suspicious fraudulent activities over a period of time (e.g., 2 hours, weekend, New Year week, and the like).
3) Pattern recognition by transaction types. Example: Group of gaming devices that exhibit high cash-in, follow by minimal gaming activities, and then a cash out transaction.
4) Pattern recognition by the player behavior. Example: A player inserts $2500 cash into a gaming device, just short of a $3000 triggering threshold, plays $100, gets a cash-out voucher, then moves to another gaming device to insert another $2500 cash (not voucher). In this case, in addition to the data uploaded by the gaming device, a sensor such as a security camera mounted in the machine or in the gaming venue may be utilized to recognize the player and/or to identify the player's movement, recognize the player's biometric features, etc.

In some casino gaming environments, such as, for example, those allowing the user of mobile gaming devices, certain types of pattern recognition analysis may be more difficult to perform. For example, pattern recognition by location for mobile gaming devices may be difficult to implement due to the mobility of the device, particularly in casinos where the casino's system is only capable of detecting that the mobile game device is somewhere within a legal gaming location, but is not capable of determining the real-time location of a given mobile gaming device. In such situations, it may be preferable to rely more on the more effective pattern recognition techniques (e.g., pattern recognition by time, pattern recognition by player behavior, and/or pattern recognition by transaction types) and rely less on the less effective pattern recognition techniques.

Additionally, the degree of severity of an identified suspicious activity may also be assessed (e.g., in real-time) in order to determine, for example: (i) which type(s) of response action(s) should be performed (e.g., in response to detection of the identified suspicious activity), and/or (ii) the appropriate timeframe for initiating or implementing each response action to be performed.

By way of illustration, non-exhaustive examples of different types of response actions which may be automatically and dynamically initiated or implemented in response to detection of the identified suspicious activity may include, but are not limited to, one or more of the following (or combinations thereof):

- Generation and transmission of alert messages to designated recipients such as, for example, the nearest security officers, a casino manager, pit boss, etc. For example, a text message with the details of the suspicious activity may be sent to the nearest security officer's smart phone. In some embodiments, alert messages may be generated and transmitted in real-time or near real-time. In some embodiments, local casino personnel may be timely alerted of suspicious activity. In some embodiments, a GUI representation of the casino floor may also be provided to facilitate casino personnel in quickly identifying the location of suspicious activity.
- Generation and transmission of alert messages to local law enforcement.
- Generation and transmission suspicious money laundering activity reports. In some embodiments, alert messages may be generated and transmitted in real-time or near real-time.
- Electronic filing of suspicious money laundering activity reports with appropriate governing agencies such as, for example FinCEN, law enforcement officers, gaming control board officials, casino security managers, and the like.
- Capture image of player (e.g., using casino security camera and/or gaming device camera).
- Geolocation capture of suspicious transaction.
- Geolocation capture of gaming device involved in suspicious transaction.
- Geolocation capture of mobile device(s) associated with one or more persons involved with the identified suspicious activity.
- Initiate geotracking (using, for example, WiFi/Cellular/GPS tracking techniques, video analytic surveillance techniques, etc.) of one or more persons involved with the identified suspicious activity. According to different embodiments, one or more video analytic surveillance techniques may be configured or designed to include functionality for performing video surveillance analytics, such as, for example, facial surveillance, advanced object tracking, etc.

Track casino chips in possession by one or more persons involved with the identified suspicious activity.

Delay completion of the transaction (e.g., prolong the transaction time), or hold the transaction processing, pending additional verifications and/or actions.

Etc.

By way of illustration, non-exhaustive examples of different types of criteria may be considered when determining the degree of priority or urgency to be assigned to a given response action may include, but are not limited to, one or more of the following (or combinations thereof):

Time sensitivity. For example, if it is determined that there is a time sensitivity associated with a given response action, then it is preferable that the response action be implemented within an appropriate, predetermined timeframe takes into account the time sensitivity.

Amount of time which has elapsed since the detected event occurred.

Type of suspicious activity involved.

Amount of money involved.

Number of similar incidents within a given period (e.g., 48 hours).

Number of similar incidents within a geographical area (e.g., nearby gaming devices, within the casino gaming venue, within a 2-mile radius, within the city, etc.).

Transactions characteristics and/or transaction patterns that have been flagged or prioritized by law enforcement agencies.

Prior histories of person(s) involved in the suspicious activity. For example, if it is determined that the identity of one of the persons involved in the suspicious activity is a fugitive, it may be desirable to immediately notify law enforcement agencies and/or casino security personnel of the last known location of the identified fugitive.

Increased likelihood of apprehending one or more person(s) involved in the suspicious activity (e.g., if response activity is assigned high priority status).

Increased likelihood of identifying one or more person(s) involved in the suspicious activity (e.g., if response activity is assigned high priority status).

Increased likelihood of prevention of similar type(s) of suspicious activities from occurring in future (e.g., if response activity is assigned high priority status).

Some events may be assigned relatively higher priorities than other events. Assignment of relative priorities may depend upon the particular facts and/or conditions associated with each event. Additionally, in some embodiments, the degree of urgency or priority of dispatching alert(s) communications and/or notification(s) for a given event may be determined, at least partially, as a function of the priority associated with that event. For example, detection of a $9000 cash-in event at a specific gaming device, followed by an $8990 cash-out event at the same gaming device within 1 minute may be assigned a high priority, or may be assigned a relatively higher priority than detection of a $9000 cash-in event at the gaming device, followed by an $8990 cash-out event at the same gaming device 2 hours later. In the former situation, it may be determined that there is a relatively high degree of urgency to immediately send out an alert to casino security and the casino floor supervisor, alerting them of the detected fraudulent activity. In the latter situation, it may be determined that there is a relatively lower degree of priority (or no need) for sending out alert(s) communications relating to the detected event. In another example, a cash-out after a Jackpot win of $10,000 is may not be assigned as a high priority event for suspicious fraudulent activity. However, in at least one embodiment, the detection of such an event will trigger a flag for automatic reporting purposes for causing the detected event to be logged and reported to the appropriate agencies for tax reporting purposes.

Referring first to FIG. 1, an exemplary wide area electronic Gaming Network 100 utilizing multiple financial instrument handling devices and various other system components across multiple locations is shown in simplified block diagram format. As described in greater detail herein, different embodiments of gaming networks may be configured, designed, and/or operable to provide various different types of operations, functionalities, and/or features generally relating to automated gaming monetary instrument issuance, tracking, and recording techniques. Further, as described in greater detail herein, many of the various operations, functionalities, and/or features of the Gaming Network(s) and/or Gaming System(s) disclosed herein may provide may enable or provide different types of advantages and/or benefits to different entities interacting with the Gaming Network(s).

According to different embodiments, a Gaming Network 100 may include a plurality of different types of components, devices, modules, processes, systems, etc., which, for example, may be implemented and/or instantiated via the use of hardware and/or combinations of hardware and software. For example, as illustrated in the example embodiment of FIG. 1, the Gaming Network may include one or more of the following types of systems, components, devices, processes, etc. (or combinations thereof):

Internet, Cellular, and WAN Network(s) 103.

3rd Party Systems 190. In at least one embodiment, one or more 3rd Party Systems may include remote server system(s)/service(s), which, for example, may be configured or designed to provide various types of services described and/or referenced herein. In at least one embodiment, one or more 3rd Party Systems may communicate with other components, devices, systems of the Gaming Network via APIs and/or other types of standardized (and/or proprietary) communication protocols. Examples of various types of 3rd Party Systems may include, but are not limited to, one or more of the following (or combinations thereof):

Content provider servers/services

Media Streaming servers/services

Database storage/access/query servers/services

Financial transaction servers/services

Payment gateway servers/services

Electronic commerce servers/services

Event management/scheduling servers/services

Automated money laundering detection and reporting services;

Remote Database System(s) which, for example, may be operable to store and provide access to various types of information and data described herein.

Remote Device(s) 170—In at least one embodiment, the Remote Device(s) may be operable to provide administration and customer remote access to other components, devices, systems of the Gaming Network. According to different embodiments, one or more Remote Device may be configured or designed to perform and/or implement various types of functions, operations, actions, and/or other features such as those described or referenced herein (e.g., such as those illustrated and/or described with respect to FIG. 6).

Cloud Services 160—In at least one embodiment, Cloud Services may include a plurality of different public and/or provide computing clouds which, for example, may reside at different physical and/or geographic locations, and which may each be configured or designed to provide different types of services. For example, as illustrated in the example embodiment of FIG. 1, Cloud Services 160 may include functionality for performing and/or implementing fraudulent Analysis, Detection and Reporting Services such as one or more of those described herein.

According to specific embodiments, at least some of the computing clouds may include several different types of local area networks such as, for example, a backbone LAN which may be utilized for providing localized communication between various local network elements within a given computing cloud, and an internet LAN which, for example, may be utilized for providing WAN or Internet access to various local network elements within the computing cloud. In at least one embodiment, one or more of the computing clouds may be operable to host a variety of different types of applications and/or other software for performing various types of services such as, for example, one or more of those described herein. Additionally, in at least one embodiment, one or more of the computing clouds may be operable to provide various types of database services such as, for example, data storage, database queries, data access, etc. As illustrated in the example embodiment of FIG. 1, cloud services network 160 may include one or more of the following components, devices, and/or systems (or combinations thereof): firewall components 162, load balancer and router components 164, Web services components 166, database components 168, Automated Money Laundering ("AML") detection and reporting components 161.

As illustrated in the example embodiment of FIG. 1, the Casino Gaming Network 101 may include one or more of the following types of systems, components, devices, processes, etc. (or combinations thereof):

Casino Server System(s) 140
Local Administration System(s) 130
Electronic Gaming Machine(s) (EGMs) 110
Gaming Table(s) 120
ATMs/Financial Kiosk(s) 150
Cashier's Cage(s) 180
Network Router(s) 102

Figure 9:
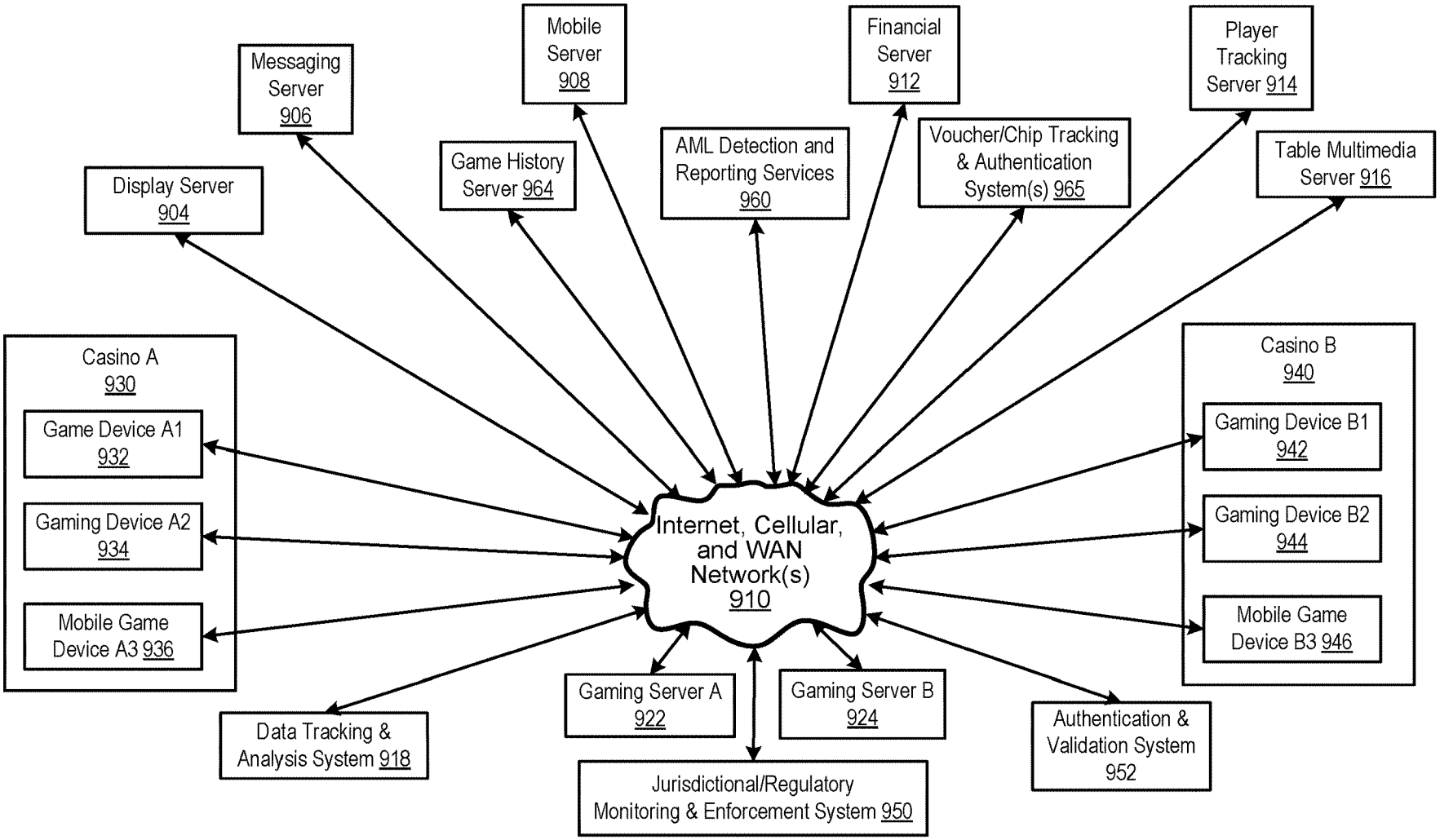
FIG. 9 illustrates in block diagram format an exemplary alternative gaming network that can be used for monetary instrument tracking according to an alternative embodiment of the present disclosure.

According to different embodiments, the Casino Server System(s) 140 may include various systems, components, and/or devices for facilitating, initiating, and/or performing various operation(s), action(s), feature(s), and/or other functionality, such as, for example, one or more of the following (or combinations thereof):

Display Server System(s) (e.g., 904, FIG. 9). In at least one embodiment, the Display Server System(s) may be configured or designed to implement and/or facilitate management of content (e.g., graphics, images, text, video fees, etc.) to be displayed and/or presented at one or more EGDs (or at one or more groups of EGDs), dealer displays, administrator displays, etc.

Table Multimedia Server System(s) (e.g., 916). In at least one embodiment, the Table Multimedia Server System(s) may be configured or designed to generate, implement and/or facilitate management of content (e.g., graphics, images, text, video fees, audio feeds, etc.), which, for example, is to be streamed or provided to one or more EGDs (or to one or more groups of EGDs).

Messaging Server System(s) (e.g., 906). In at least one embodiment, the Messaging Server System(s) may be configured or designed to implement and/or facilitate management of messaging and/or other communications among and between the various systems, components, devices, EGDs, players, dealers, administrators, and/or other personnel of the gaming network.

Mobile Server System(s) (e.g., 908). In at least one embodiment, the Mobile Server System(s) may be configured or designed to implement and/or facilitate management of communications and/or data exchanged with various types of mobile devices, including for example: player-managed mobile devices (e.g., smart phones, PDAs, tablets, mobile computers), casino-managed mobile devices (e.g., mobile gaming devices), etc.

AML Detection and Reporting Service(s) (e.g., 960). In at least one embodiment, the AML Detection and Reporting Service(s) may be configured or designed to include functionality for facilitating, enabling, initiating, and/or performing various types of AML Detection and Reporting operation(s), action(s), and/or feature(s) such as one or more of those described herein.

Financial Server System(s) (e.g., 912). In at least one embodiment, the Financial Server System(s) may be configured or designed to implement and/or facilitate tracking, management, reporting, and storage of financial data and financial transactions relating to one or more wager-based gaming sessions. For example, at least some Financial Server System(s) may be configured or designed to track of the game accounting (money in, money out) for a virtual table game being played, and may also be configured or designed to handle various financial transactions relating to player wagers and payouts. For example, in at least one embodiment, Financial Servers may be configured or designed to monitor each remote player's account information, and may also manage or handle funds transfers between each player's account and the active game server (e.g., associated with the player's game session).

Player Tracking Server System(s) (e.g., 914). In at least one embodiment, the Player Tracking Server System(s) may be configured or designed to implement and/or facilitate management and exchange of player tracking information associated with one or more EGDs, gaming sessions, etc. In at least one embodiment, a Player Tracking Server System may include at least one database that tracks each player's hands, wins/losses, bet amounts, player preferences, etc., in the network. In at least one embodiment, the presenting and/or awarding of promotions, bonuses, rewards, achievements, etc., may be based on a player's play patterns, time, games selected, bet amount for each game type, etc. A Player Tracking Server System may also help establish a player's preferences, which assists the casino in their promotional efforts to: award player comps (loyalty points); decide which promotion(s) are appropriate; generate bonuses; etc.

Data Tracking & Analysis System(s) (e.g., 918). In at least one embodiment, the Data Tracking & Analysis System(s) may be configured or designed to implement and/or facilitate management and analysis of game data. For example, in one embodiment the Data Tracking & Analysis System(s) may be configured or designed to aggregate multisite virtual game table trends, local wins, jackpots, etc.

Gaming Server System(s) (922, (e.g., 924). In at least one embodiment, different game servers may be configured or designed to be dedicated to one or more specifically designated type(s) of game(s) (e.g., Baccarat, Black Jack, Poker, Mahjong, Pai-gow, Chess, etc.). Each game server has game logic to host one of more virtual table game sessions. At least some game server(s) may also capable of keeping track of the game accounting (money in, money out, games won, game lost, etc.) for a virtual table game being played, and/or for updating the Financial Servers at the end of each game. The game servers may also operable to generate the virtual table graphics primitives (e.g., game pieces and game states), and may further be operable to update the remote EGDs when a game state change (e.g., new card dealt, player upped the ante, player folds/busts, etc.) has been detected.

Jurisdictional/Regulatory Monitoring & Enforcement System(s) (e.g., 950). In at least one embodiment, the Jurisdictional/Regulatory Monitoring & Enforcement System(s) may be configured or designed to handle tracking, monitoring, reporting, and enforcement of specific regulatory requirements relating to wager-based gameplay activities in one or more jurisdictions.

Authentication & Validation System(s) (e.g., 952). According to different embodiments, the Authentication & Validation System(s) may be configured or designed to determine and/or authenticate the identity of the current player at a given EGD. For example, in one embodiment, the current player may be required to perform a log in process at the EGD in order to access one or more features. Alternatively, the EGD may be adapted to automatically determine the identity of the current player based upon one or more external signals such as, for example, scanning of a barcode of a player tracking card, an RFID tag or badge worn by the current player which provides a wireless signal to the EGD for determining the identity of the current player. In at least one implementation, various security features may be incorporated into the EGD to prevent unauthorized players from engaging in certain types of activities at the EGD. In some embodiments, the Authentication & Validation System(s) may be configured or designed to authenticate and/or validate various types of hardware and/or software components, such as, for example, hardware/software components residing at a remote EGDs, game play information, wager information, player information and/or identity, etc. Examples of various authentication and/or validation components are described in U.S. Pat. No. 6,620,047, titled, "ELECTRONIC GAMING APPARATUS HAVING AUTHENTICATION DATA SETS," incorporated herein by reference in its entirety for all purposes.

Game History Server(s) (e.g., 964). In at least one embodiment, the Game History Server(s) may be configured or designed to track all (or selected) game types and game play history for all (or selected) virtual game tables. In at least one embodiment, a Game History Server may be configured or designed to assists the remote players in selecting a table by, for example, displaying the win/loss statistics of the tables selected by the player as potential candidates to participate. In some embodiments, a Game History Server may also assist the casino manager in case of disputes between players and the casino by, for example, providing the ability to "replay" (e.g., by virtually recreating the game events) the game in dispute, step by step, based on previously stored game states.

Voucher and Chip Tracking System(s) 965, which, for example, may be configured or designed to include functionality for generating, storing, updating, tracking, and analyzing data with respect to the issuance and redemption of printed tickets, casino chips, and other voucher items having cash or credit values.

Database components 142, which, for example, may be configured or designed to include functionality for storing and/or providing access to various types of information, events, and/or conditions such as, for example, one or more of the following (or combinations thereof): historical game-related information, suspected fraudulent activity information, suspected fraudulent activity detection rules, player ID information, gaming device ID information, location maps of gaming devices, casino-related information, historical financial transaction information, and/or other types of information described and/or referenced herein.

Web Services components 146, which, for example, may be configured or designed to include functionality for facilitating, aggregating gaming data, enabling, initiating, and/or performing various types of web-based services and communications.

Cellular (GSM/CDMA) Communication components 148, which, for example, may be configured or designed to include functionality for facilitating, enabling, initiating, and/or performing various types of cellular-based and/or wireless communications such as transporting gaming data to/from the Cloud Services 160.

Data And Transaction Collection components 144, which, for example, may be configured or designed to include functionality for facilitating, enabling, initiating, and/or performing collection of data and transactions (e.g., financial transaction events) occurring at various components and/or devices of the casino gaming network such as, for example, one or more of the following (or combinations thereof): EGM(s), gaming table(s), ATMs, financial kiosks, casino token storage tray(s), cashier cage component(s), wireless gaming devices, end user mobile device(s), remote devices (e.g., 170), etc.

Voucher and Chip Tracking Components 145, which, for example, may be configured or designed to include functionality for generating, storing, updating, tracking, and analyzing data with respect to the issuance and redemption of printed tickets, casino chips, and other voucher items having cash or credit values. These can include, for example, ticket printers, ticket readers, verification systems, databases, and the like.

Firewall component(s) 104.

Etc.

According to different embodiments, Electronic Game Device(s) (EGDs) may include one or more of the following (or combinations thereof): mechanical slot machines, electronic slot machines, electronic gaming machines, mobile gaming devices, video gaming machines, server-based gaming machines, and/or other types of devices or components which provide capabilities for enabling casino patrons to participate in gaming and/or wagering activities. In some embodiments, at least some mobile gaming devices may be implemented using personal mobile computing devices such as tablets, smartphones, laptops, PC's, and the like. As illustrated in the example embodiment of FIG. 1, one or more EGDs may be configured or designed to include one or more of the following components (or combinations thereof): at least one master gaming controller (MGC) 111, communication components 112, printer components 114, Bill/coin acceptor components 116, sensor components 118, data collection and reporting components 113. Additional EGD features and functionalities are illustrated and described with respect to FIGS. 4-6.

According to different embodiments, Gaming Tables(s) may include one or more of the following (or combinations thereof): traditional casino gaming tables (e.g., craps, baccarat at, blackjack, roulette, etc.), electronic gaming tables, server-based gaming tables, and/or other types of devices or components which provide capabilities for enabling two or more casino patrons to concurrently participate in gaming and/or wagering activities. As illustrated in the example embodiment of FIG. 1, one or more gaming tables may be configured or designed to include one or more of the following components (or combinations thereof): at least one master gaming controller (MGC) 121, communication components 122, printer components 124, Bill/voucher/coin acceptor components 126, sensor components 128, data collection and reporting components 123. In at least one embodiment data collection and reporting components 123 may include functionality for facilitating, enabling, initiating, and/or performing collection and reporting of game-related information and/or wager-related information (e.g., including financial transaction events) occurring at that gaming table. Additional gaming table features and functionalities are illustrated and described with respect to FIG. 3.

In at least one embodiment data collection and reporting components (e.g., 113, 123, 153, 183) may include functionality for facilitating, aggregating, enabling, initiating, and/or performing collection and reporting of various types of information relating to conditions and/or events occurring at an associated gaming device and/or gaming table game, such as, for example: game-related information, player tracking information, wager-related information (e.g., including financial transaction events), and the like.

In at least one embodiment, Local Administration System 130 may include various types of devices or components (such as, for example, mobile devices 132, tablets 134, computer systems 136, etc.) which provide capabilities for enabling casino administrators to implement or perform administration of one or more aspects, components, systems, operations, and/or activities relating to a casino gaming network (e.g., 101). Additionally, local administrative access can be provided for the casino manager for configuring, registering, monitoring, analyzing, sending alerts, generating reports, etc., relating to fraudulent and suspicious activities.

According to different embodiments, Remote Devices 170 may include various types of devices or components (such as, for example, smart phones 172, tablets 174, computer systems 176, etc.) which provide capabilities for enabling a remote user to remotely participate in gaming and/or wagering activities at a casino gaming network (e.g., 101). In at least one embodiment, one or more remote device components may also be used by remote casino administrators to implement or perform remote administration of one or more aspects, components, systems, operations, and/or activities relating to a casino gaming network (e.g., 101).

In at least one embodiment, the Gaming Network may be operable to utilize and/or generate various different types of data and/or other types of information when performing specific tasks and/or operations. This may include, for example, input data/information and/or output data/information. For example, in at least one embodiment, the Gaming Network may be operable to access, process, and/or otherwise utilize information from one or more different types of sources, such as, for example, one or more local and/or remote memories, devices and/or systems. Additionally, in at least one embodiment, the Gaming Network may be operable to generate one or more different types of output data/information, which, for example, may be stored in memory of one or more local and/or remote devices and/or systems. Examples of different types of input data/information and/or output data/information which may be accessed and/or utilized by the Gaming Network may include, but are not limited to, one or more of those described and/or referenced herein. According to specific embodiments, multiple instances or threads of the Gaming Network processes and/or procedures may be concurrently implemented and/or initiated via the use of one or more processors and/or other combinations of hardware and/or hardware and software.

According to different embodiments, various different types of encryption/decryption techniques may be used to facilitate secure communications between devices, systems, and/or components of the Gaming Network(s). Examples of the various types of security techniques which may be used may include, but are not limited to, one or more of the following (or combinations thereof): random number generators, SHA-1 (Secured Hashing Algorithm), MD2, MD5, DES (Digital Encryption Standard), 3DES (Triple DES), RC4 (Rivest Cipher), ARC4 (related to RC4), TKIP (Temporal Key Integrity Protocol, uses RC4), AES (Advanced Encryption Standard), RSA, DSA, DH, NTRU, and ECC (elliptic curve cryptography), PKA (Private Key Authentication), Device-Unique Secret Key and other cryptographic key data, SSL, etc. Other security features contemplated may include use of well-known hardware-based and/or software-based security components, and/or any other known or yet to be devised security and/or hardware and encryption/decryption processes implemented in hardware and/or software.

It will be appreciated that the Gaming Network 101 of FIG. 1 is but one example from a wide range of Gaming Network embodiments which may be implemented. Other embodiments of the Gaming Network (not shown) may include additional, fewer and/or different components/features that those illustrated in the example Gaming Network embodiment of FIG. 1.

Generally, the automated gaming monetary instrument tracking techniques described herein may be implemented in hardware and/or hardware+software. Hardware and/or software+hardware hybrid embodiments of the automated gaming monetary instrument tracking techniques described herein may be implemented on a general-purpose programmable machine selectively activated or reconfigured by a computer program stored in memory. Such programmable machines may include, for example, mobile or handheld computing systems, PDA, smart phones, notebook computers, tablets, netbooks, desktop computing systems, server systems, cloud computing systems, network devices, etc.

FIG. 9 illustrates in block diagram format an exemplary alternative gaming network that can be used for monetary instrument tracking according to an alternative embodiment of the present disclosure. Gaming Network 900 may be configured or designed to implement various automated gaming monetary instrument tracking techniques described and/or referenced herein. As described in greater detail herein, different embodiments of Gaming Networks may be configured, designed, and/or operable to provide various different types of operations, functionalities, and/or features generally relating to Gaming Network technology. Further, as described in greater detail herein, many of the various operations, functionalities, and/or features of the Gaming Network(s) and/or Gaming System(s) disclosed herein may provide may enable or provide different types of advantages and/or benefits to different entities interacting with the Gaming Network(s).

According to different embodiments, the Gaming Network 900 may include a plurality of different types of components, devices, modules, processes, systems, etc., which, for example, may be implemented and/or instantiated via the use of hardware and/or combinations of hardware and software. For example, as illustrated in the example embodiment of FIG. 9, the Gaming Network may include one or more of the following types of systems, components, devices, processes, etc. (or combinations thereof):

Display Server System(s) 904. Table Multimedia Server System(s) 916.
Messaging Server System(s) 906.
Mobile Server System(s) 908.
AML Detection and Reporting Services 960.
Financial Server System(s) 912.
Player Tracking Server System(s) 914.
Data Tracking & Analysis System(s) 918.
Gaming Server System(s) (922, 924).
Jurisdictional/Regulatory Monitoring & Enforcement System(s) 950.
Authentication & Validation System(s) 952.
Casino Venues (930, 940).
Electronic Game Devices (EGDs) 932, 934, 936, 942, 944, 946.
Internet, Cellular, and WAN Network(s) 910.
Game History Server(s) 964.
Remote Database System(s).
Remote Server System(s)/Service(s).
Mobile Device(s).
Etc.

The functionality of the various systems and components of FIG. 9 may be similar to those described previously with respect to the description of FIG. 1, and therefore need not be repeated.

Figure 2:
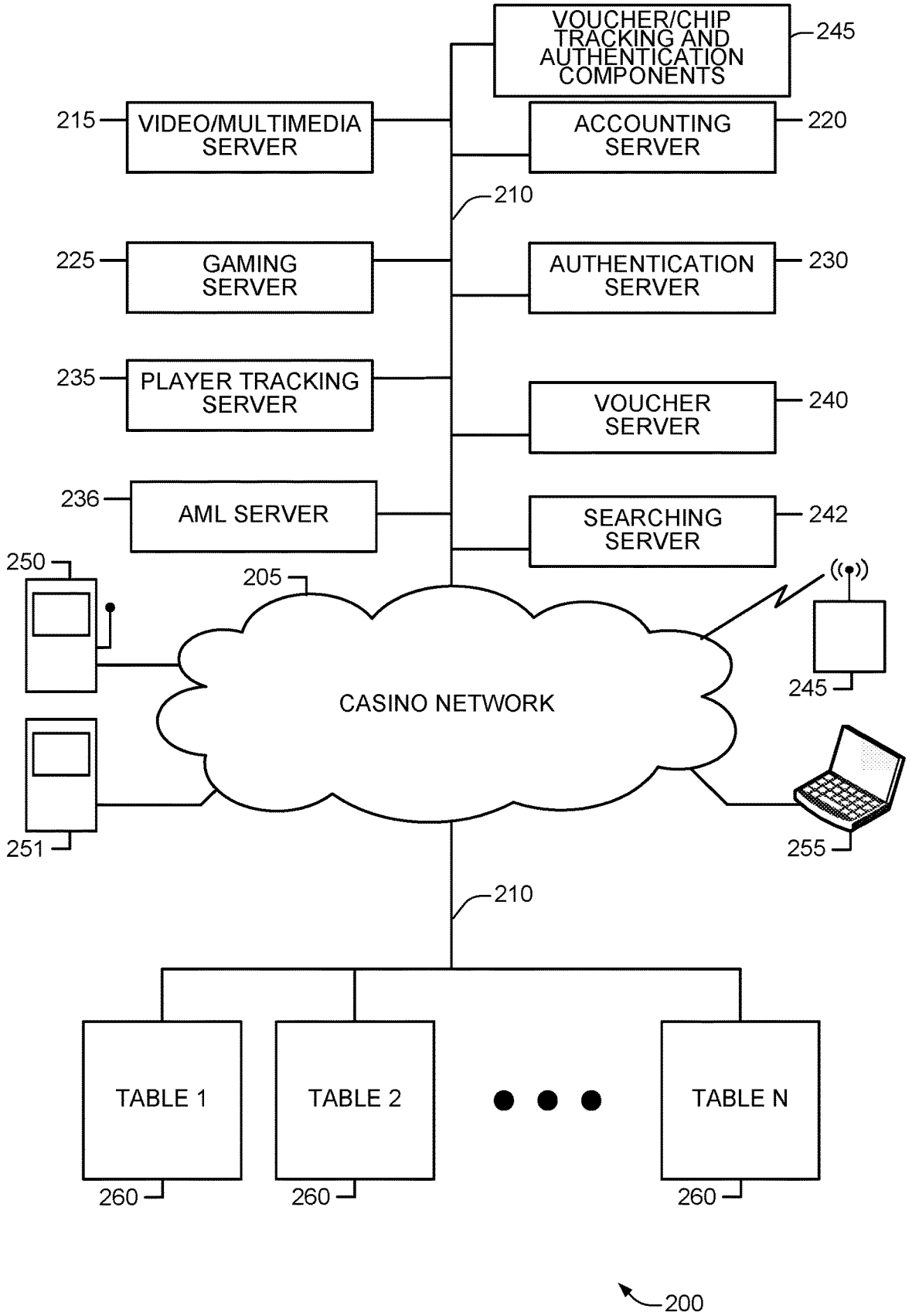
FIG. 2 illustrates in block diagram format an exemplary electronic gaming system according to a specific embodiment of the present disclosure.

FIG. 2 illustrates in block diagram format an exemplary electronic gaming system according to a specific embodiment of the present disclosure. Electronic gaming system 200 may include electronic gaming tables 260, which may be coupled to network 205 via a network link 210. Electronic gaming tables 260 may be normal gaming tables with enhanced electronic capabilities. Network 205 may be the internet or a private network. One or more video streams may be received at video/multimedia server 215 from gaming tables 260. Video/Multimedia server 215 may transmit one or more of these video streams to a mobile device 245, a gaming device 250, an EGD 251, a laptop 255, and/or any other remote electronic device. Video/Multimedia server 215 may transmit these video streams via network link 210 and network 205. Electronic gaming system 200 may include an accounting/transaction server 220, a gaming server 225, an authentication server 230, a player tracking server 235, a voucher server 240, and a searching server 242.

Accounting/transaction server 220 may compile, track, store, and/or monitor cash flows, voucher transactions, winning vouchers, losing vouchers, and/or other transaction data for the casino operator and for the players. Transaction data may include the number of wagers, the size of these wagers, the date and time for these wagers, the identity of the players making these wagers, and the frequency of the wagers. Accounting/transaction server 220 may generate tax information relating to these wagers. Accounting/transaction server 220 may generate profit/loss reports for predetermined gaming options, contingent gaming options, predetermined betting structures, and/or outcome categories.

Voucher and Chip Tracking Components 245, which, for example, may be configured or designed to include functionality for generating, storing, updating, tracking, and analyzing data with respect to the issuance and redemption of printed tickets, casino chips, and other voucher items having cash or credit values. These can include printers and readers for printed tickets or other gaming monetary instruments or vouchers, as well as components, systems, and databases to record and analyze collected data.

Gaming server 225 may generate gaming options based on predetermined betting structures and/or outcome categories. These gaming options may be predetermined gaming options, contingent gaming options, and/or any other gaming option disclosed in this disclosure. Authentication server 230 may determine the validity of vouchers, players' identity, and/or an outcome for a gaming event. Player tracking server 235 may track a player's betting activity, a player's preferences (e.g., language, drinks, font, sound level, etc.). Based on data obtained by player tracking server 235, a player may be eligible for gaming rewards (e.g. free play), promotions, and/or other awards (e.g., complimentary food, drinks, lodging, concerts, etc.).

Voucher server 240 may generate a voucher, which may include data relating to a printed ticket or other cash or credit value instrument. Various specific items and details for such data that can be generated, stored, and tracked are provided below. If there is a time deadline, that information may be generated by voucher server 240. Vouchers may be physical (e.g., paper) or digital.

AML Server 236 may be configured or designed to include functionality for facilitating, enabling, initiating, and/or performing various AML analysis, detection, and/or reporting activities, operation(s), action(s), and/or feature(s) such as one or more of those described herein.

Searching server 242 may implement a search on one or more gaming devices to obtain gaming data. Searching server 242 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching server 242 may implement a wagering function, which may be an automatic wagering mechanism. These functions of searching server 242 may be integrated into one or more servers.

Searching server 242 may include one or more searching structures, one or more searching algorithms, and/or any other searching mechanisms. In general, the search structures may cover which table games paid out the most money during a time period, which table games kept the most money from players during a time period, which table games are most popular (top games), which table games are least popular, which table games have the most amount of money wager during a period, which table games have the highest wager volume, which table games are more volatile (volatility, or deviation from the statistical norms, of wager volume, wager amount, pay out, etc.) during a time period, and the like. Search may also be associated with location queries, time queries, and/or people queries (e.g., where are the table games that most of my friends wager on, where are my favorite dealers, what do players wager on the most today, when are most wagers placed, etc.).

Figure 3:
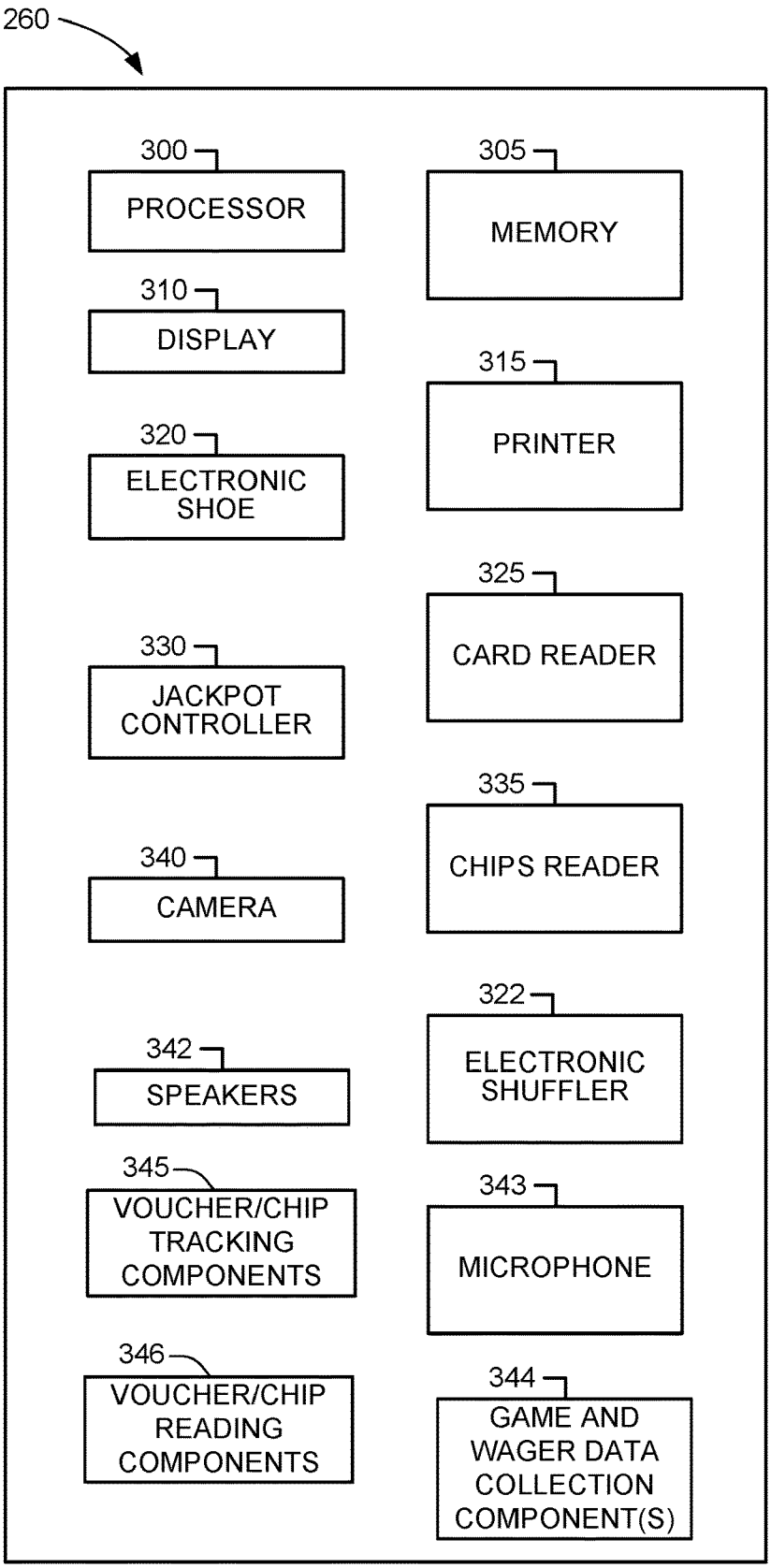
FIG. 3 illustrates in block diagram format an exemplary electronic gaming table with various features according to a specific embodiment of the present disclosure.

FIG. 3 illustrates in block diagram format an exemplary electronic gaming table with various features according to a specific embodiment of the present disclosure. Various different embodiments of the electronic gaming table 260 may be used as a live game table for conducting gameplay relating to one or more gaming sessions. Electronic gaming table 260 may include a processor 300, a memory 305, a display 310, a printer 315, an electronic shoe 320, an electronic shuffler 322, a smart card reader 325, a jackpot controller 330, a chips reader 335, and a camera 340. Processor 300 may be communicatively coupled to any other device in electronic gaming table 260. Processor 300 via an interface may communicate wired or wireless, with any of the elements of electronic gaming device 100 and/or electronic gaming system 200. Memory 305 may include data relating to gaming events, video streams transmitted from electronic gaming table 260, winning and losing percentages for gaming options relating to electronic gaming table 260, and game management data (e.g., dealer schedule, chip refills, etc.).

Display 310 may show previous game results, a betting structure, outstanding wagers, transaction volume, present value of betting options, a table minimum wager, a table maximum wager, wager and/or game play instructions input by one or more remote players (e.g., via their respective EGDs), instructions to the live dealer/attendant relating to game play activities to be performed by the dealer/attendant, video data, and/or any other type of data or content. Printer 315 may generate vouchers, promotional items, food tickets, event tickets, and/or lodging tickets. Vouchers may be physical (e.g., paper) or digital. Electronic shuffler 322 may be configured or designed to automatically shuffle multiple decks of cards, and to track the relative order of each of the cards of the shuffled decks of cards. The electronic shuffler can include an off the shelf unit. A dealer can use the electronic shuffler to shuffle the decks of cards before dealing the required hands, and place the shuffled decks of cards into the electronic shoe 320. In this way, the electronic gaming table may determine the relative order of all cards in the card shoe at the start of one or more game session(s), and/or at all other times of game play.

Electronic shoe 320 may obtain data and/or images of gaming objects utilized with gaming table 260. This data and/or images may be transmitted to electronic gaming device and displayed as images from table games. For example, on a blackjack table a ten of spades may be dealt to a player. This information is obtained via electronic shoe 320 and utilized to generate an image and/or illustration of a ten of spades card on an electronic gaming device. In another example, electronic shoe 320 may receive data relating to the numbers on dice, transmit this data to electronic gaming device, which may be utilized to generate an image/illustration of the dice on electronic gaming device.

In at least one embodiment, the electronic shoe can include an electronic reading system, such as an optical reader for recognizing the face value of each card. The electronic shoe can be designed to communicate directly with the card dealing/shuffling system to read or otherwise obtain the value of each card being dealt by the dealer as the card leaves the card dealing/shuffling system. For example, an optical reader or similar device can be attached to the card dealing/shuffling system, and the electronic shoe can obtain the scanned value of cards in the card dealing/shuffling system. In some implementations, the electronic shoe can interface with the table to read the value of each card being dealt by the dealer. For example, the table can include one or more scanning interfaces to scan each card before or after the card is dealt by the dealer. The electronic shoe can communicate with the one or more scanning interfaces to obtain the value of each card before or after the card is dealt by the dealer.

Card reader 325 may provide identification, authentication, and application processing functions. Card reader 325 may interface with smart cards, magnetic striped card, bar code reader, RFID card, and the like. Jackpot controller 330 may track and compile data associated with a jackpot. Jackpot controller 330 may award the jackpot on a specific occurrence (e.g., blackjack event, dealing a royal flush, etc.) and/or randomly award a jackpot. Chips reader 335 may compile and track data associated with the amount of chips one or more players possesses, the amount of chips won/lost at gaming table 260, the amount of chips in the dealer's rack at gaming table 260, an amount of chips wager by one or more players, amount of chips in the betting pool, and/or any combination thereof.

Camera 340 may obtain data from gaming table 260. Camera 340 may be one or more cameras located to view the gaming objects (e.g., cards, dice, dominos, ball, wheel, etc.), the dealer, the shoe, the players' hands, the players, and/or any combination thereof. Camera 340 may transmit this data to gaming table, which may be utilized to generate an image/illustration of the gaming objects. Speakers 342 may be used to provide audio information to the game table dealer/attendant. Examples of different types of audio information may include, for example, audio instructions and/or other audio/verbal communications from one or more remote players, computer-generated audio instructions/content, sound effects, and/or other types of audio content. Microphone 343 may be used to capture, record, and/or stream audio information from the electronic gaming table region, which, for example, may include verbal communications from the table game dealer/attendant.

Game And Wager Data Collection Component(s) 344 may include functionality for facilitating, enabling, initiating, and/or performing collection and reporting of various types of information relating to conditions and/or events occurring at an associated gaming device and/or gaming table game, such as, for example: game-related information, player tracking information, wager-related information (e.g., including financial transaction events), and/or other types of data/information described and/or referenced herein.

Voucher and Chip Tracking Components 345, and Voucher and Chip Reading Components 346, both of which, for example, may be configured or designed to include functionality for generating, storing, updating, tracking, and analyzing data with respect to the issuance and redemption of printed tickets, casino chips, and other voucher items having cash or credit values.

According to specific embodiments, a variety of different game states may be used to characterize the state of current and/or past events which are occurring (or have occurred) at a given live gaming table. For example, in one embodiment, at any given time in a game, a valid current game state may be used to characterize the state of game play (and/or other related events, such as, for example, mode of operation of the gaming table, etc.) at that particular time. In at least one embodiment, multiple different states may be used to characterize different states or events which occur at the gaming table at any given time. In one embodiment, when faced with ambiguity of game state, a single state embodiment forces a decision such that one valid current game state is chosen. In a multiple state embodiment, multiple possible game states may exist simultaneously at any given time in a game, and at the end of the game or at any point in the middle of the game, the gaming table may analyze the different game states and select one of them based on certain criteria. Thus, for example, when faced with ambiguity of game state, the multiple state embodiment(s) allow all potential game states to exist and move forward, thus deferring the decision of choosing one game state to a later point in the game. The multiple game state embodiment(s) may also be more effective in handling ambiguous data or game state scenarios.

According to specific embodiments, a variety of different entities may be used (e.g., either singly or in combination) to track the progress of game states which occur at a given gaming table. Examples of such entities may include, but are not limited to, one or more of the following (or combination thereof): master controller system, display system, gaming system, local game tracking component(s), remote game tracking component(s), etc. Examples of various game tracking components may include, but are not limited to: automated sensors, manually operated sensors, video cameras, intelligent playing card shoes, RFID readers/writers, RFID tagged chips, objects displaying machine readable code/patterns, etc.

According to a specific embodiment, local game tracking components at the gaming table may be operable to automatically monitor game play activities at the gaming table, and/or to automatically identify key events which may trigger a transition of game state from one state to another as a game progresses. For example, in the case of Blackjack, a key event may include one or more events which indicate a change in the state of a game such as, for example: a new card being added to a card hand, the split of a card hand, a card hand being moved, a new card provided from a shoe, removal or disappearance of a card by occlusion, etc.

Figure 4:
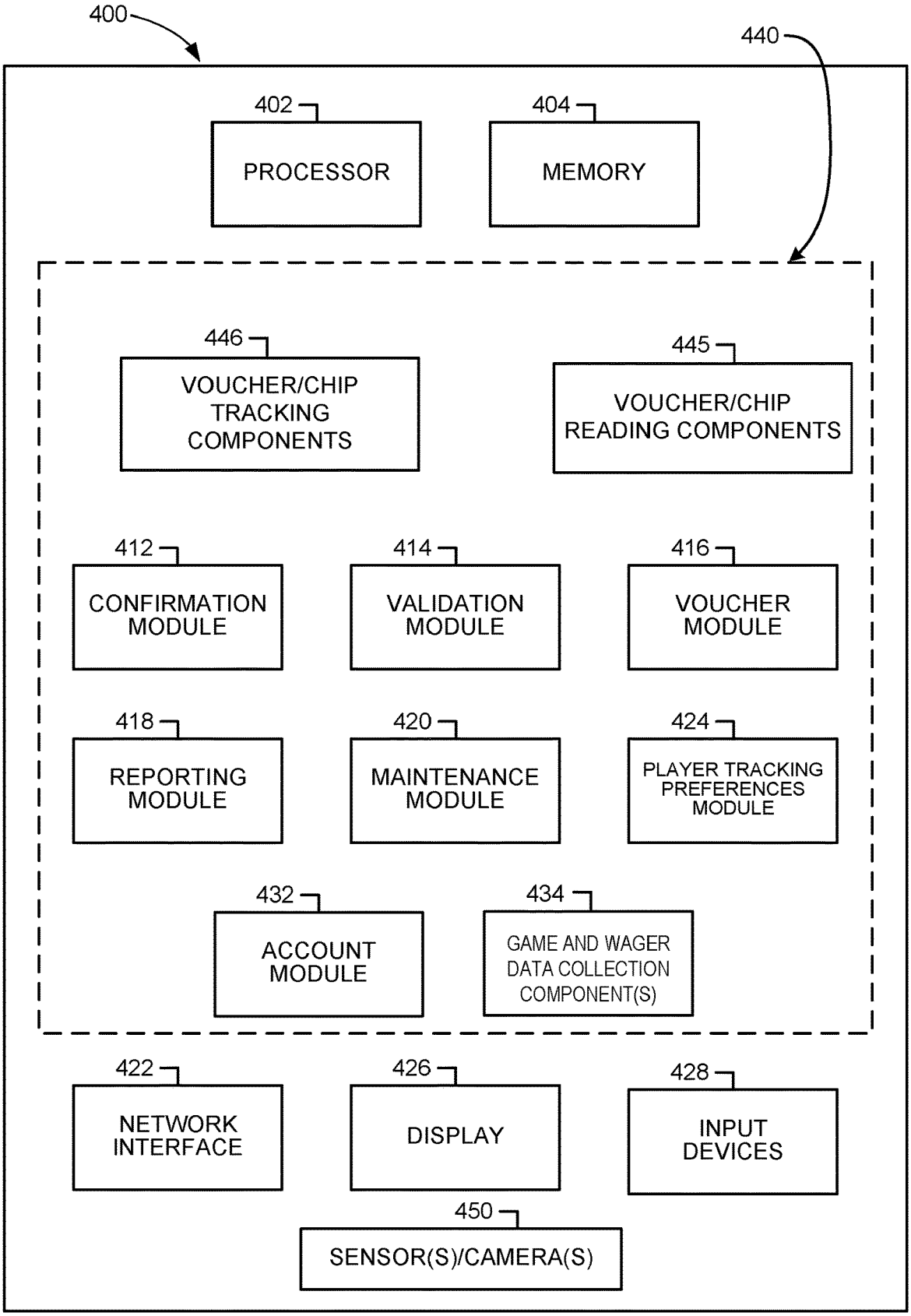
FIG. 4 illustrates in block diagram format another exemplary electronic gaming device according to a specific embodiment of the present disclosure.

FIG. 4 illustrates in block diagram format another exemplary electronic gaming device according to a specific embodiment of the present disclosure. Electronic gaming device 400 may include a processor 402, a memory 404, a network interface 422, input devices 428, and a display 426. Network interface 422 may allow electronic gaming device 400 to communicate with video/multimedia server 215, accounting/transaction server 220, gaming server 225, authentication server 230, player tracking server 235, voucher server 240, and gaming table 260.

Input devices 428 may be mechanical buttons, electronic buttons, a touchscreen, a microphone, cameras, an optical scanner, or any combination thereof. Input devices 428 may be utilized to make a wager, to make an offer to buy or sell a voucher, to determine a voucher's worth, to cash in a voucher, to modify (e.g., change sound level, configuration, font, language, etc.) electronic gaming device 400, to select a movie or music, to select live video streams (e.g., table 1, table 2, table 3), to request services (e.g., drinks, manager, etc.), or any combination thereof.

Display 426 may show video streams from one or more gaming tables 260, gaming objects from one or more gaming tables 260, computer generated graphics, predetermined gaming options 106, and/or contingent gaming options 108.

Memory 404 may include various memory modules 440. Memory 404 via various memory modules 440 may include a confirmation module 412, a validation module 414, a voucher module 416, a reporting module 418, a maintenance module 420, a player tracking preferences module 424, and an account module 432.

Confirmation module 412 may utilize data received from a voucher, the transaction history of the voucher (e.g., the voucher changed hands in a secondary market), and/or the identity of the player to confirm the value of the voucher. In another example, confirmation module 412 may utilize game event data, along with voucher data to confirm the value of the voucher.

Validation module 414 may utilize data received from a voucher to confirm the validity of the voucher.

Voucher module 416 may store data relating to generated vouchers, redeemed vouchers, bought vouchers, and/or sold vouchers.

Game And Wager Data Collection Component(s) 434 may include functionality for facilitating, enabling, initiating, and/or performing collection and reporting of various types of information relating to conditions and/or events occurring at an associated gaming device and/or gaming table game, such as, for example: game-related information, player tracking information, wager-related information (e.g., including financial transaction events), and/or other types of data/information described and/or referenced herein.

Voucher and Chip Tracking Components 445, and Voucher and Chip Reading Components 446, both of which, for example, may be configured or designed to include functionality for generating, storing, updating, tracking, and analyzing data with respect to the issuance and redemption of printed tickets, casino chips, and other voucher items having cash or credit values.

Sensor(s)/Camera(s) 450 may be configured or designed to detect and capture external data, events, and/or conditions including, for example, biometric information (e.g., facial images, facial features, fingerprints, voice recordings, etc.) relating to the player(s) or user(s) interacting with the gaming device. In some embodiments, the camera and/or other sensor(s) of the electronic gaming device may be remotely controlled and actuated. For example, in one embodiment, if it is determined that suspicious fraudulent activities may be occurring at a given electronic gaming device, the camera of the electronic gaming device may be caused to be remotely actuated in order to capture a facial image of the person(s) who is/are interacting with the electronic gaming device.

Reporting module 418 may generate reports related to a performance of electronic gaming device 400, electronic gaming system 200, table game 260, video streams, gaming objects, credit device 112, and/or identification device 114.

In one implementation, reporting module 418 may reside on a central server and can aggregate and generate real time statistics on betting activities at one or more table games at one or more participating casinos. The aggregate betting statistics may include trends (e.g., aggregate daily wager volume and wager amount by game types, by casinos, and the like), top games with the most payouts, top tables with the most payouts, top search structures used by players, most popular dealers by wager volume, most searched for game, tables with least payouts, weekly trends, monthly trends, and other statistics related to game plays, wagers, people, location, and searches.

The information and statistics generated by the server-based reporting module 418 can be displayed publicly or privately. For example, popular trending and statistical information on wager volume and wager amount for the top ten table games can be publicly displayed in a casino display system so that players can study and decide what game to play, where, when, etc. Such a public display of general statistics can also be posted on the Internet, sent out as a text, an email, or multimedia message to the player's smart phones, tablets, desktop computer, etc. In another example, the trending and statistical information can also be distributed privately to privileged players such as casino club members.

Maintenance module 420 may track any maintenance that is implemented on electronic gaming device 400 and/or electronic gaming system 200. Maintenance module 420 may schedule preventative maintenance and/or request a service call based on a device error. Player tracking preferences module 424 may compile and track data associated with a players preferences.

Account module 432 may include data relating to an account balance, a wager limit, a number of wagers placed, credit limits, any other player information, and/or any other account information.

Data from account module 432 may be utilized to determine whether a wager may be accepted. For example, when a search has determined a triggering event, the device and/or system may determine whether to allow this wager based on one or more of a wager amount, a number of wagers, a wager limit, an account balance, and/or any other criteria.

For example, the system and/or device determines via searching function that a triggering event has occurred. Based on this triggering event, the player would like to make a $400 wager, however, the player's account balance is only $50. In this case, the system and/or device may not accept the wager, modify the wager to the account balance (e.g., $50), send a notice to the player, modify the wager to some percentage (e.g., 10%, 25%, 50%, 75%, etc.) of the account balance (e.g., $5, $12.50, $25, $37.5, etc.), send a notice to the gaming entity, make a flat wager (e.g., $10), and/or any combination thereof.

In another example, the system and/or device determines via searching function that a triggering event has occurred. Based on this triggering event, the player would like to make a $400 wager and the player's account balance is $150. However, the system and/or device may not accept the wager because one betting parameter may be that no one wager may be more than a certain percentage (e.g., fifty percent) of a player's account balance. In this case, the system and/or device may not accept the wager, modify the wager to the predetermined limit (e.g., $75), send a notice to the player, modify the wager to some other percentage (e.g., 5%, 10%, 25%, 40%, etc.) of the account balance, send a notice to the gaming entity, make a flat wager (e.g., $10), and/or any combination thereof.

In another example, the gaming jurisdiction, the casino, the system and/or device may not allow an individual to place a wager over a specific value (e.g., $25, $400, $1,000, $10,000, $400,000, $1,000,000, etc.).

In another example, the system and/or device may not allow an individual to lose more than a specific amount of money in a predetermined timeframe. An individual may only be allowed to lose $200 (or any other number) over a two hour period (or any other time period).

In another example, based on this triggering event, the player would like to make a $400 wager and the player has a $200 balance. However, the player has made a predetermined number of wagers within a predetermined time frame. For example, the system and/or device may not allow an individual to make more than 5 wagers a day, 25 wagers a week, 1,000 wagers a year, etc. Any of these betting parameters may be combined by the system and/or device.

In at least one embodiment, at least a portion of the modules discussed in block diagram 400 may reside locally in gaming terminal 400. However, In at least some embodiments, the functions performed by these modules may be implemented in one or more remote servers. For instance, modules 412-420 and 424 may each be on a remote server, communicating with gaming terminal 400 via a network interface such as Ethernet in a local or a wide area network topology. In some implementations, these servers may be physical servers in a data center. In some other implementations, these servers may be virtualized. In yet some other implementations, the functions performed by these modules may be implemented as web services. Regardless of how the modules and their respective functions are implemented, the interoperability with the gaming terminal 400 is seamless.

In one implementation, reporting module 418 may reside on a central server and can aggregate and generate real time statistics on betting activities at one or more table games at one or more participating casino's. The aggregate betting statistics may include trends (e.g., aggregate daily wager volume and wager amount by game types, by casinos, and the like), top games with the most payouts, top tables with the most payouts, top search structures used by players, most popular dealers by wager volume, most searched for game, tables with least payouts, weekly trends, monthly trends, and other statistics related to game plays, wagers, people, location, and searches.

The information and statistics generated by the server-based reporting module 418 can be displayed publicly or privately. For example, popular trending and statistical information on wager volume and wager amount for the top ten table games can be publicly displayed in a casino display system so that players can study and decide what game to play, where, when, etc. Such a public display of general statistics can also be posted on the Internet, sent out as a text, an email, or multimedia message to the player's smart phones, tablets, desktop computer, etc. In another example, the trending and statistical information can also be distributed privately to privileged players such as casino club members.

Figure 5:
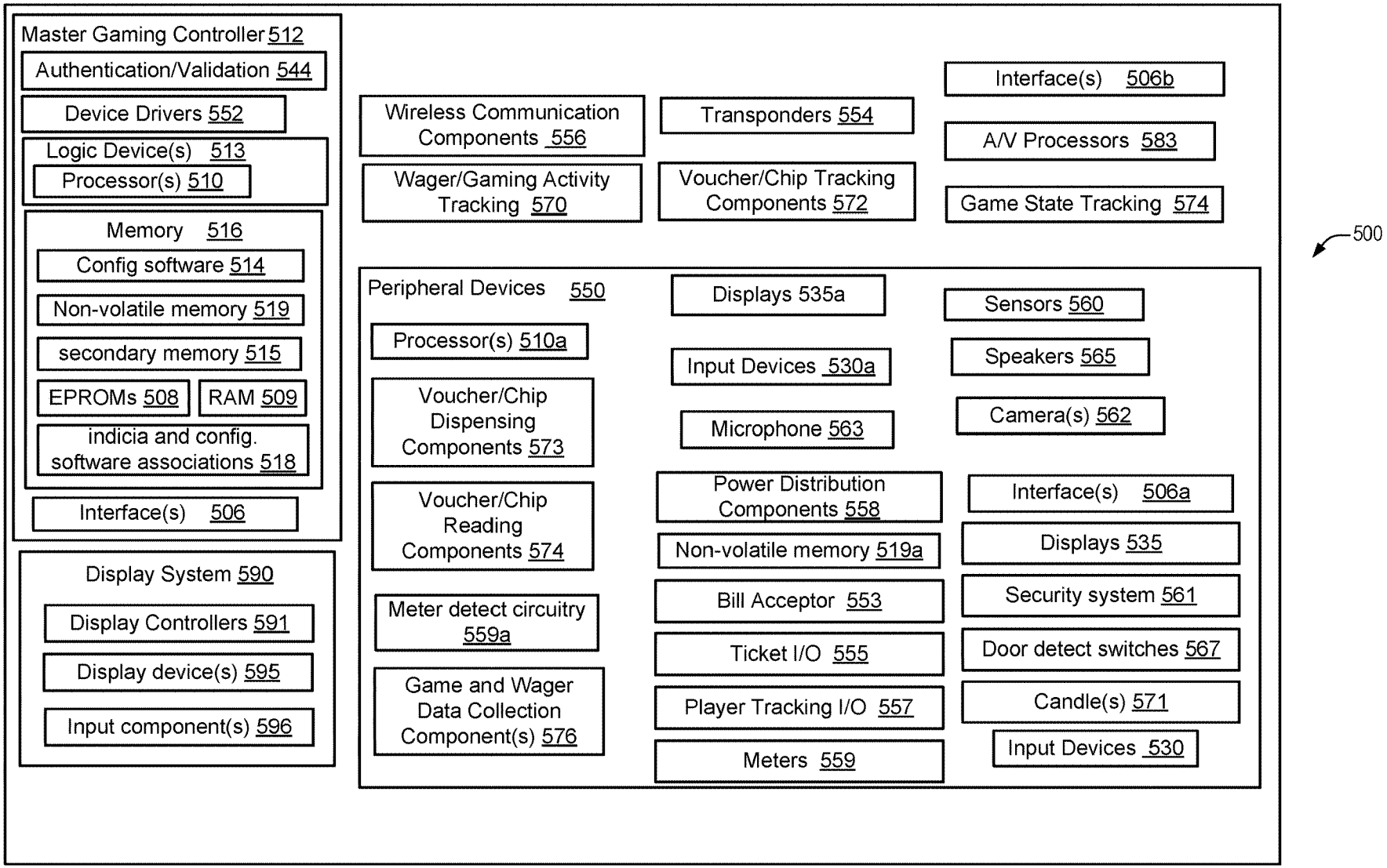
FIG. 5 illustrates in block diagram format an exemplary intelligent electronic gaming system according to a specific embodiment of the present disclosure.

FIG. 5 illustrates in block diagram format an exemplary intelligent electronic gaming system according to a specific embodiment of the present disclosure. In some embodiments, intelligent electronic gaming system 500 may be implemented as a gaming server. In other embodiments, gaming system 500 may be implemented as an electronic gaming machine (EGM) or electronic gaming device (EGD). As illustrated in the embodiment of FIG. 5, gaming system 500 includes at least one processor 510, at least one interface 506, and memory 516. Additionally, as illustrated in the example embodiment of FIG. 5, gaming system 500 includes at least one master gaming controller 512, a multi-touch sensor and display system 590, a plurality of peripheral device components 550, and various other components, devices, systems such as, for example, one or more of the following (or combinations thereof):

- Transponders 554;
- Wireless communication components 556;
- Games state tracking components 574;
- Audio/video processors 583 which, for example, may include functionality for detecting, analyzing and/or managing various types of audio and/or video information relating to various activities at the gaming system;
- Various interfaces 506 (e.g., for communicating with other devices, components, systems, etc.);
- Sensors 560;
- One or more cameras 562;
- One or more microphones 563;
- Input devices 530*a;*
- Peripheral Devices 550;
- Game and Wager Data Collection Component(s) 576;
- Wager and Gaming Activity Tracking 570;
- Voucher and Chip Tracking Components 572;
- Voucher and Chip Dispensing Components 573;

Voucher and Chip Reading Components 574

One or more cameras (e.g., 562) may be used to monitor, stream and/or record image content and/or video content relating to persons or objects within each camera's view. For example, in at least one embodiment where the gaming system is implemented as an EGD, camera 562 may be used to generate a live, real-time video feed of a player (or other person) who is currently interacting with the EGD. In some embodiments, camera 562 may be used to verify a user's identity (e.g., by authenticating detected facial features), and/or may be used to monitor or tract facial expressions and/or eye movements of a user or player who is interacting with the gaming system.

In at least one embodiment, display system 590 may include one or more of the following (or combinations thereof):

Display controllers 591;

Multipoint sensing device(s) (e.g., multi-touch surface sensors/components);

Display device(s) 595;

Input/touch surface 596;

Etc.

According to various embodiments, display device(s) 595 may include one or more display screens utilizing various types of display technologies such as, for example, one or more of the following (or combinations thereof): LCDs (Liquid Crystal Display), Plasma, OLEDs (Organic Light Emitting Display), TOLED (Transparent Organic Light Emitting Display), Flexible (F)OLEDs, Active matrix (AM) OLED, Passive matrix (PM) OLED, Phosphorescent (PH) OLEDs, SEDs (surface-conduction electron-emitter display), EPD (ElectroPhoretic display), FEDs (Field Emission Displays) and/or other suitable display technology. EPD displays may be provided by E-ink of Cambridge, Mass. OLED displays of the type list above may be provided by Universal Display Corporation, Ewing, N.J.

In at least one embodiment, master gaming controller 512 may include one or more of the following (or combinations thereof):

Authentication/validation components 544;

Device drivers 542;

Logic devices 513, which may include one or more processors 510;

Memory 516, which may include one or more of the following (or combinations thereof): configuration software 514, non-volatile memory 515, EPROMS 508, RAM 509, associations 518 between indicia and configuration software, etc.;

Interfaces 506;

Etc.

In at least one embodiment, Peripheral Devices 550 may include one or more of the following (or combinations thereof):

Power distribution components 558;

Non-volatile memory 519*a* (and/or other types of memory);

Bill acceptor 553;

Ticket I/O 555;

Player tracking I/O 557;

Meters 559 (e.g., hard and/or soft meters);

Meter detect circuitry 559*a;*

Processor(s) 510*a;*

Interface(s) 506*a;*

Display(s) 535;

Security system 561;

Door detect switches 567;

Input devices 530;

Etc.

In one implementation, processor 510 and master gaming controller 512 are included in a logic device 513 enclosed in a logic device housing. The processor 510 may include any conventional processor or logic device configured to execute software allowing various configuration and reconfiguration tasks such as, for example: a) communicating with a remote source via communication interface 506, such as a server that stores authentication information or games; b) converting signals read by an interface to a format corresponding to that used by software or memory in the gaming system; c) accessing memory to configure or reconfigure game parameters in the memory according to indicia read from the device; d) communicating with interfaces, various peripheral devices and/or I/O devices; e) operating peripheral devices such as, for example, card readers, paper ticket readers, etc.; f) operating various I/O devices such as, for example, displays 535, input devices 530; etc. For instance, the processor 510 may send messages including game play information to the displays 535 to inform players of cards dealt, wagering information, and/or other desired information.

In at least one implementation, the gaming system may include card readers such as used with credit cards, or other identification code reading devices to allow or require player identification in connection with play of the card game and associated recording of game action. Such a player identification interface can be implemented in the form of a variety of magnetic card readers commercially available for reading a player-specific identification information. The player-specific information can be provided on specially constructed magnetic cards issued by a casino, or magnetically coded credit cards or debit cards frequently used with national credit organizations such as VISA, MASTERCARD, AMERICAN EXPRESS, or banks and other institutions.

The gaming system may include other types of participant identification mechanisms which may use a fingerprint image, eye blood vessel image reader, or other suitable biological information to confirm identity of the player. Still further it is possible to provide such participant identification information by having the dealer manually code in the information in response to the player indicating his or her code name or real name. Such additional identification could also be used to confirm credit use of a smart card, transponder, and/or player's personal player input device (UID).

The gaming system 500 also includes memory 516 which may include, for example, volatile memory (e.g., RAM 509), non-volatile memory 519 (e.g., disk memory, FLASH memory, EPROMs, etc.), unalterable memory (e.g., EPROMs 508), etc. The memory may be configured or designed to store, for example: 1) configuration software 514 such as all the parameters and settings for a game playable on the gaming system; 2) associations 518 between configuration indicia read from a device with one or more parameters and settings; 3) communication protocols allowing the processor 510 to communicate with peripheral devices and I/O devices 511; 5) a secondary memory storage device 515 such as a non-volatile memory device, configured to store gaming software related information (the gaming software related information and memory may be used to store various audio files and games not currently being used and invoked in a configuration or reconfiguration); 5) communication transport protocols (such as, for example, TCP/IP, USB, Firewire, IEEE1394, Bluetooth, IEEE 802.11x (IEEE 802.11 standards), hiperlan/2, HomeRF, etc.) for allowing the gaming system to communicate with local and non-local devices using such protocols;

etc. In one implementation, the master gaming controller 512 communicates using a serial communication protocol. A few examples of serial communication protocols that may be used to communicate with the master gaming controller include but are not limited to USB, RS-232 and Netplex (a proprietary protocol developed by IGT, Reno, Nev.).

A plurality of device drivers 542 may be stored in memory 516. Example of different types of device drivers may include device drivers for gaming system components, device drivers for gaming system components, etc. Typically, the device drivers 542 utilize a communication protocol of some type that enables communication with a particular physical device. The device driver abstracts the hardware implementation of a device. For example, a device drive may be written for each type of card reader that may be potentially connected to the gaming system. Examples of communication protocols used to implement the device drivers include Netplex, USB, Serial, Ethernet 575, Firewire, I/O debouncer, direct memory map, serial, PCI, parallel, RF, Bluetooth™, near-field communications (e.g., using near-field magnetics), 802.11 (WiFi), etc. Netplex is a proprietary IGT standard while the others are open standards. According to a specific embodiment, when one type of a particular device is exchanged for another type of the particular device, a new device driver may be loaded from the memory 516 by the processor 510 to allow communication with the device. For instance, one type of card reader in gaming system 500 may be replaced with a second type of card reader where device drivers for both card readers are stored in the memory 516.

In some embodiments, the software units stored in the memory 516 may be upgraded as needed. For instance, when the memory 516 is a hard drive, new games, game options, various new parameters, new settings for existing parameters, new settings for new parameters, device drivers, and new communication protocols may be uploaded to the memory from the master gaming controller 512 or from some other external device. As another example, when the memory 516 includes a CD/DVD drive including a CD/DVD designed or configured to store game options, parameters, and settings, the software stored in the memory may be upgraded by replacing a first CD/DVD with a second CD/DVD. In yet another example, when the memory 516 uses one or more flash memory 519 or EPROM 508 units designed or configured to store games, game options, parameters, settings, the software stored in the flash and/or EPROM memory units may be upgraded by replacing one or more memory units with new memory units which include the upgraded software. In another embodiment, one or more of the memory devices, such as the hard-drive, may be employed in a game software download process from a remote software server.

In some embodiments, the gaming system 500 may also include various authentication and/or validation components 544 which may be used for authenticating/validating specified gaming system components such as, for example, hardware components, software components, firmware components, information stored in the gaming system memory 516, etc. Examples of various authentication and/or validation components are described in U.S. Pat. No. 6,620,047, entitled, "ELECTRONIC GAMING APPARATUS HAVING AUTHENTICATION DATA SETS," incorporated herein by reference in its entirety for all purposes.

Sensors 560 may include, for example, optical sensors, pressure sensors, RF sensors, Infrared sensors, motion sensors, audio sensors, image sensors, thermal sensors, biometric sensors, etc. As mentioned previously, such sensors may be used for a variety of functions such as, for example: detecting the presence and/or monetary amount of gaming chips which have been placed within a player's wagering zone; detecting (e.g., in real time) the presence and/or monetary amount of gaming chips which are within the player's personal space; etc.

In one implementation, at least a portion of the sensors 560 and/or input devices 530 may be implemented in the form of touch keys selected from a wide variety of commercially available touch keys used to provide electrical control signals. Alternatively, some of the touch keys may be implemented in another form which are touch sensors such as those provided by a touchscreen display. For example, in at least one implementation, the gaming system player may include input functionality for enabling players to provide their game play decisions/instructions (and/or other input) to the dealer using the touch keys and/or other player control sensors/buttons. Additionally, such input functionality may also be used for allowing players to provide input to other devices in the casino gaming network (such as, for example, player tracking systems, side wagering systems, etc.)

Wireless communication components 556 may include one or more communication interfaces having different architectures and utilizing a variety of protocols such as, for example, 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information.

An example of a near-field communication protocol is the ECMA-340 "Near Field Communication-Interface and Protocol (NFCIP-1)", published by ECMA International (www.ecma-international.org), herein incorporated by reference in its entirety for all purposes. It will be appreciated that other types of Near Field Communication protocols may be used including, for example, near field magnetic communication protocols, near field RF communication protocols, and/or other wireless protocols which provide the ability to control with relative precision (e.g., on the order of centimeters, inches, feet, meters, etc.) the allowable radius of communication between at least 5 devices using such wireless communication protocols.

Power distribution components 558 may include, for example, components or devices which are operable for providing wireless power to other devices. For example, in one implementation, the power distribution components 558 may include a magnetic induction system which is adapted to provide wireless power to one or more portable UIDs at the gaming system. In one implementation, a UID docking region may include a power distribution component which is able to recharge a UID placed within the UID docking region without requiring metal-to-metal contact.

In at least one embodiment, motion/gesture detection component(s) 551 may be configured or designed to detect player (e.g., player, dealer, and/or other persons) movements and/or gestures and/or other input data from the player. In some embodiments, each gaming system may have its own respective motion/gesture detection component(s). In other embodiments, motion/gesture detection component(s) 551 may be implemented as a separate sub-system of the gaming system which is not associated with any one specific gaming system or device.

Game And Wager Data Collection Component(s) 576 may include functionality for facilitating, enabling, initiating, and/or performing collection and reporting of various types of information relating to conditions and/or events occurring at an associated gaming device and/or gaming table game, such as, for example: game-related information, player tracking information, wager-related information (e.g., including financial transaction events), and/or other types of data/information described and/or referenced herein.

Figure 6:
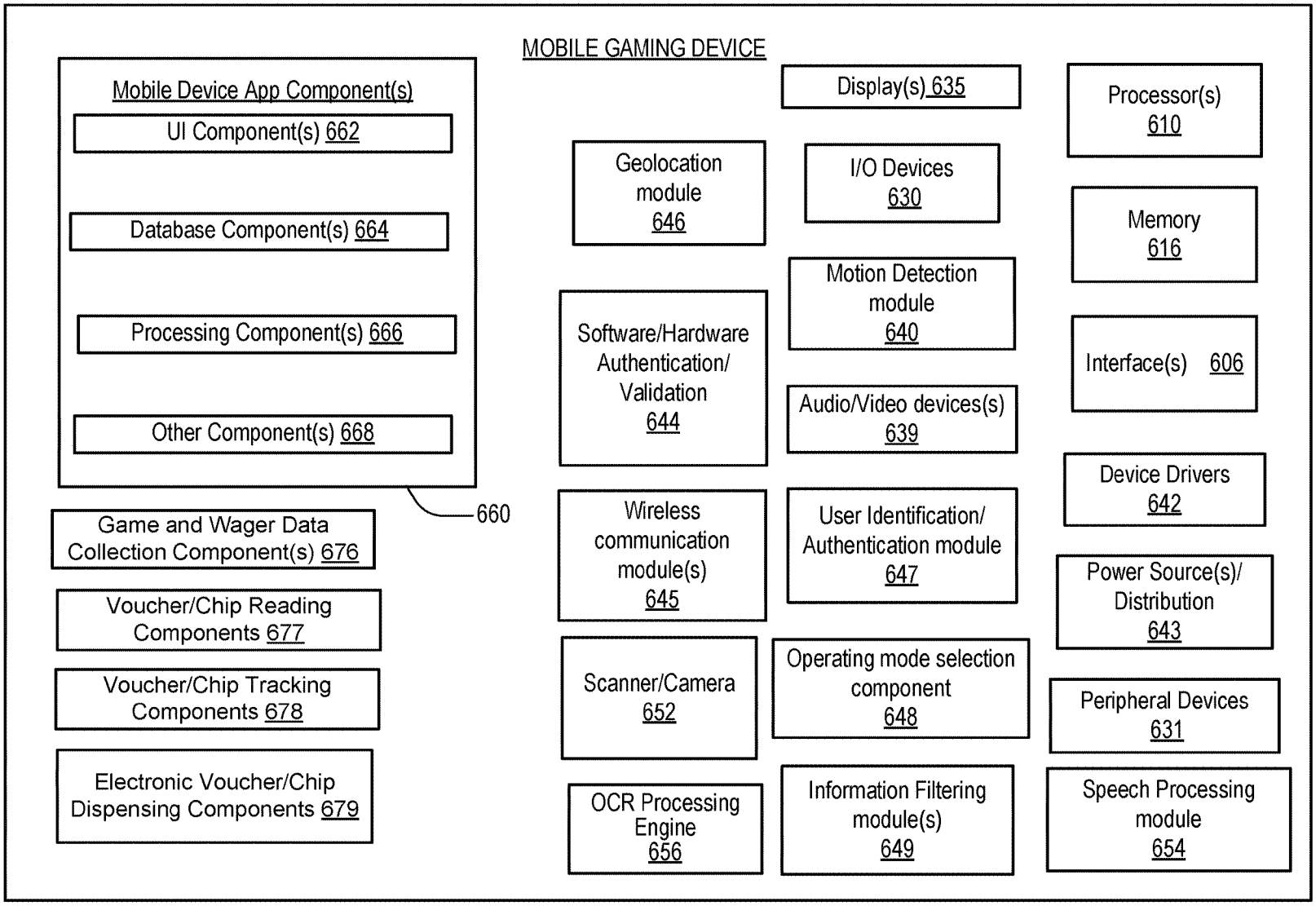
FIG. 6 illustrates in block diagram format an exemplary mobile gaming device according to a specific embodiment of the present disclosure.

FIG. 6 illustrates in block diagram format an exemplary mobile gaming device according to a specific embodiment of the present disclosure. In at least one embodiment, one or more players may participate in a live, multiplayer, wager-based, virtual table game session using mobile gaming devices. In at least some embodiments, a mobile gaming device 600 may be configured or designed to include or provide functionality which is similar to that of an electronic gaming device (EGD) such as that described, for example, in FIGS. 4 and 5.

As illustrated in the example of FIG. 6, mobile gaming device 600 may include a variety of components, modules and/or systems for providing various functionality. For example, as illustrated in FIG. 6, mobile gaming device 600 may include Mobile Device Application components (e.g., 660), which, for example, may include, but are not limited to, one or more of the following (or combinations thereof):

- UI Components 662 such as those illustrated, described, and/or referenced herein.
- Database Components 664 such as those illustrated, described, and/or referenced herein.
- Processing Components 666 such as those illustrated, described, and/or referenced herein.
- Other Components 668 which, for example, may include components for facilitating and/or enabling the mobile gaming device to perform and/or initiate various types of operations, activities, functions such as those described herein.

In at least one embodiment, the mobile gaming device may include further Mobile Device App Component(s) which have been configured or designed to provide functionality for enabling or implementing at least a portion of the various automated issuance and tracking of gaming monetary instruments and related techniques at the mobile gaming device. These further components can include, for example:

- Game and Wager Data Collection Components 676;
- Voucher and Chip Reading Components 677;
- Voucher and Chip Tracking Components 678;
- Electronic Voucher and Chip Dispensing Components 679;

According to specific embodiments, various aspects, features, and/or functionalities of the mobile gaming device may be performed, implemented and/or initiated by one or more of the following types of systems, components, systems, devices, procedures, processes, etc. (or combinations thereof):

- Processor(s) 610
- Device Drivers 642
- Memory 616
- Interface(s) 606
- Power Source(s)/Distribution 643
- Geolocation module 646
- Display(s) 635
- I/O Devices 630
- Audio/Video devices(s) 639
- Peripheral Devices 631
- Motion Detection module 640
- User Identification/Authentication module 647
- Client App Component(s) 660
- Other Component(s) 668
- UI Component(s) 662
- Database Component(s) 664
- Processing Component(s) 666
- Software/Hardware Authentication/Validation 644
- Wireless communication module(s) 645
- Information Filtering module(s) 649
- Operating mode selection component 648
- Speech Processing module 654
- Scanner/Camera 652
- OCR Processing Engine 656
- Game and Wager Data Collection Component(s) 676
- etc.

Figure 7:
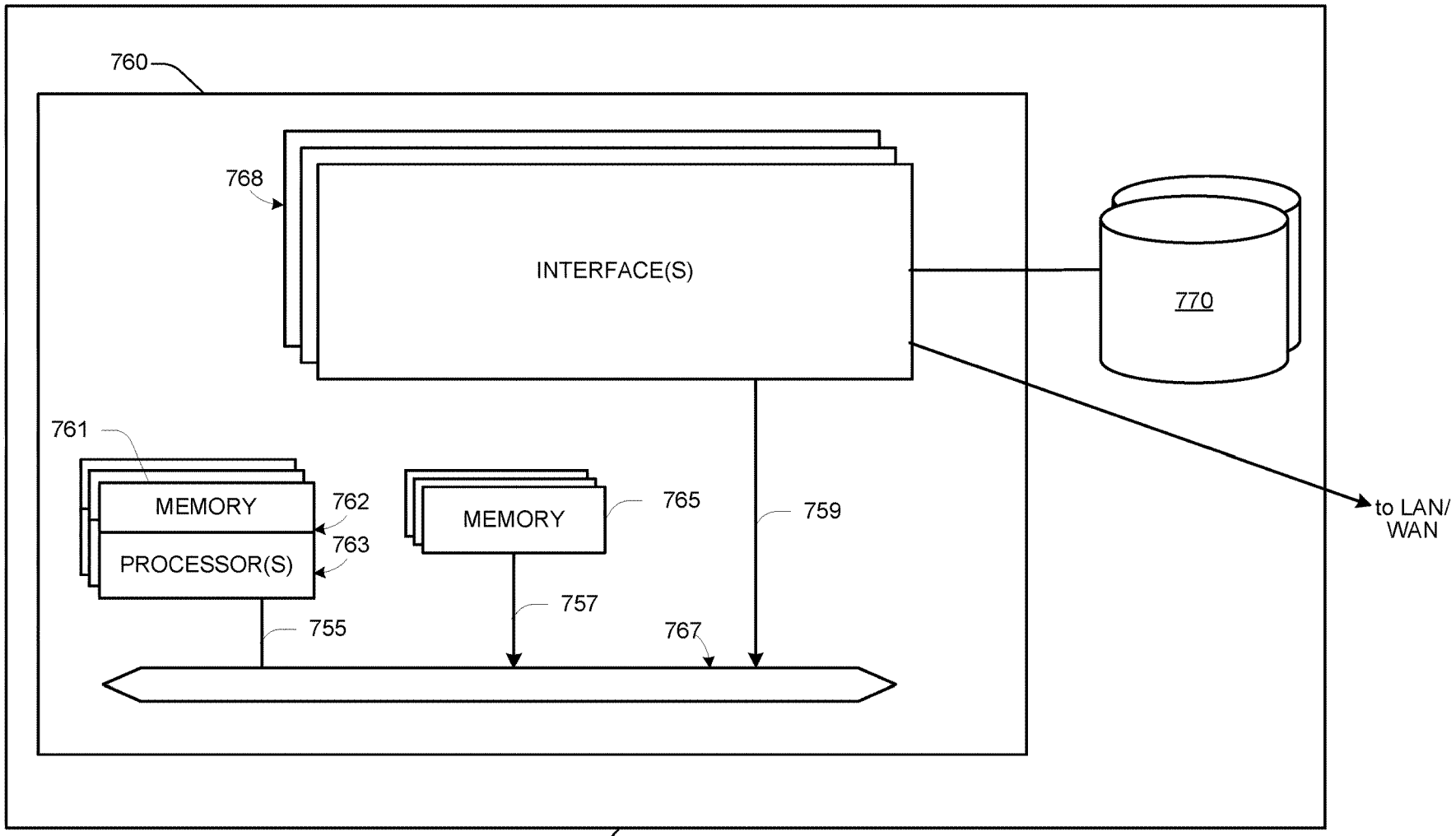
FIG. 7 illustrates in block diagram format an exemplary server system that can be used for implementing various aspects and features of the disclosed systems according to one embodiment of the present disclosure.

FIG. 7 illustrates in block diagram format an exemplary server system that can be used for implementing various aspects and features of the disclosed systems according to one embodiment of the present disclosure. In at least one embodiment, the server system 780 includes at least one network device 760, and at least one storage device 770 (such as, for example, a direct attached storage device). In one embodiment, server system 780 may be suitable for implementing at least some of the automated fraud and suspicious activity detection and reporting techniques described herein.

In according to one embodiment, network device 760 may include a master central processing unit (CPU) 762, interfaces 768, and a bus 767 (e.g., a PCI bus). When acting under the control of appropriate software or firmware, the CPU 762 may be responsible for implementing specific functions associated with the functions of a desired network device. For example, when configured as a server, the CPU 762 may be responsible for analyzing packets; encapsulating packets; forwarding packets to appropriate network devices; instantiating various types of virtual machines, virtual interfaces, virtual storage volumes, virtual appliances; etc. The CPU 762 preferably accomplishes at least a portion of these functions under the control of software including an operating system (e.g. Linux), and any appropriate system software (such as, for example, AppLogic™ software).

CPU 762 may include one or more processors 763 such as, for example, one or more processors from the AMD, Motorola, Intel and/or MIPS families of microprocessors. In an alternative embodiment, processor 763 may be specially designed hardware for controlling the operations of server system 780. In a specific embodiment, a memory 761 (such as non-volatile RAM and/or ROM) also forms part of CPU 762. However, there may be many different ways in which memory could be coupled to the system. Memory block 761 may be used for a variety of purposes such as, for example, caching and/or storing data, programming instructions, etc.

The interfaces 768 may be typically provided as interface cards (sometimes referred to as "line cards"). Alternatively, one or more of the interfaces 768 may be provided as on-board interface controllers built into the system motherboard. Generally, they control the sending and receiving of data packets over the network and sometimes support other peripherals used with the server system 780. Among the interfaces that may be provided may be FC interfaces, Ethernet interfaces, frame relay interfaces, cable interfaces, DSL interfaces, token ring interfaces, Infiniband interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like. Other interfaces may include one or more wireless interfaces such as, for example, 802.11 (WiFi) interfaces, 802.15 interfaces (including Bluetooth™), 802.16 (WiMax) interfaces, 802.22 interfaces, Cellular standards such as CDMA interfaces, CDMA2000 interfaces, WCDMA interfaces, TDMA interfaces, Cellular 3G/4G/5G interfaces, etc.

Generally, one or more interfaces may include ports appropriate for communication with the appropriate media. In some cases, they may also include an independent processor and, in some instances, volatile RAM. The independent processors may control such communications intensive tasks as packet switching, media control and management. By providing separate processors for the communications intensive tasks, these interfaces allow the master microprocessor 762 to efficiently perform routing computations, network diagnostics, security functions, etc.

In at least one embodiment, some interfaces may be configured or designed to allow the server system 780 to communicate with other network devices associated with various local area network (LANs) and/or wide area networks (WANs). Other interfaces may be configured or designed to allow network device 760 to communicate with one or more direct attached storage device(s) 770.

Although the system shown in FIG. 7 illustrates one specific network device described herein, it is by no means the only network device architecture on which one or more embodiments can be implemented. For example, an architecture having a single processor that handles communications as well as routing computations, etc. may be used. Further, other types of interfaces and media could also be used with the network device.

Regardless of network device's configuration, it may employ one or more memories or memory modules (such as, for example, memory block 765, which, for example, may include random access memory (RAM)) configured to store data, program instructions for the general-purpose network operations and/or other information relating to the functionality of the various automated fraud and suspicious activity detection and reporting techniques described herein. The program instructions may control the operation of an operating system and/or one or more applications, for example. The memory or memories may also be configured to store data structures, and/or other specific non-program information described herein.

Because such information and program instructions may be employed to implement the systems/methods described herein, one or more embodiments relates to machine readable media that include program instructions, state information, etc. for performing various operations described herein. Examples of machine-readable storage media include, but are not limited to, magnetic media such as hard disks, floppy disks, and magnetic tape; optical media such as CD-ROM disks; magneto-optical media such as floptical disks; and hardware devices that may be specially configured to store and perform program instructions, such as read-only memory devices (ROM) and random access memory (RAM). Some embodiments may also be embodied in transmission media such as, for example, a carrier wave travelling over an appropriate medium such as airwaves, optical lines, electric lines, etc. Examples of program instructions include both machine code, such as produced by a compiler, and files containing higher level code that may be executed by the computer using an interpreter.

Figure 8:
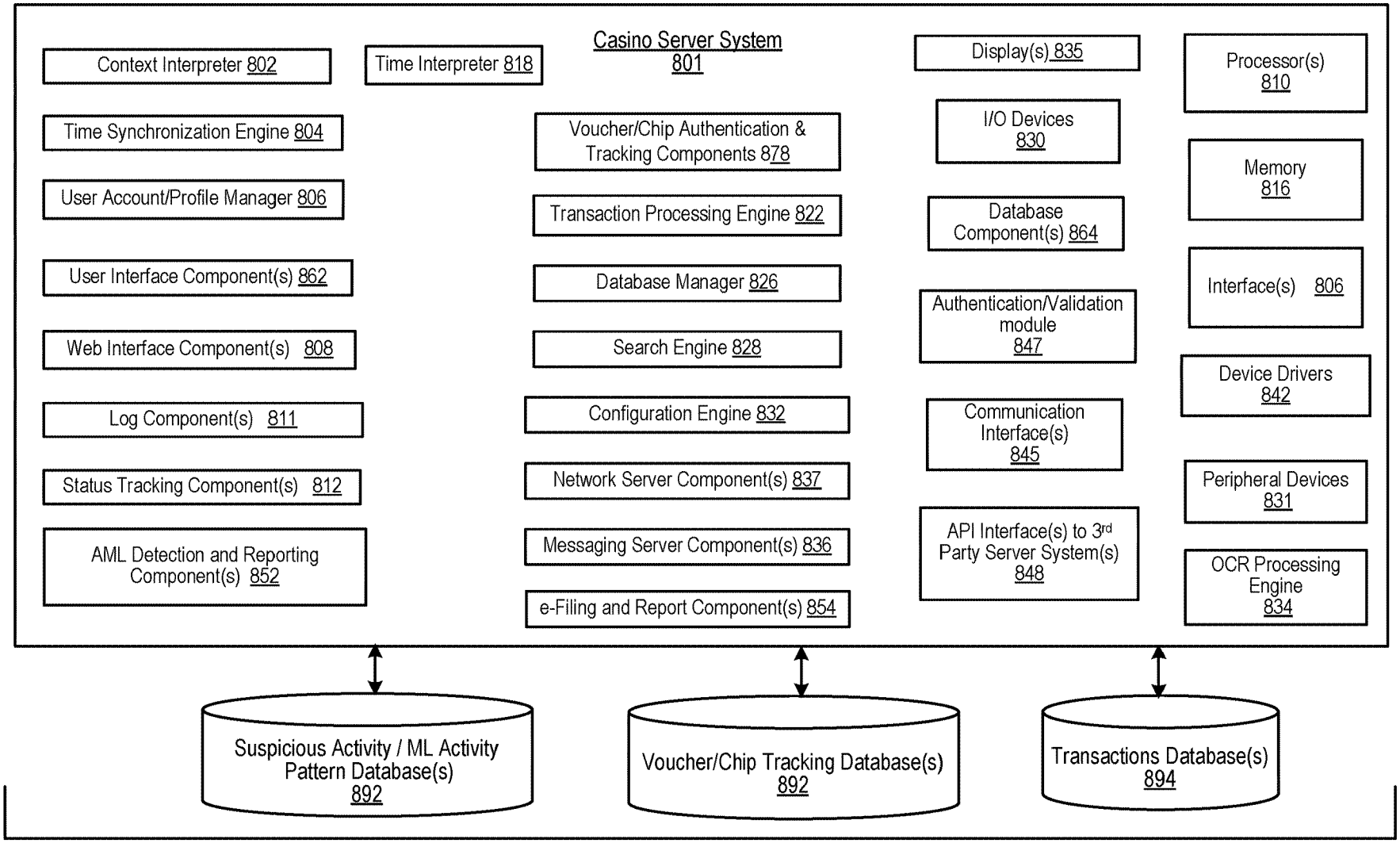
FIG. 8 illustrates in block diagram format an exemplary casino gaming server system according to a specific embodiment of the present disclosure.

FIG. 8 illustrates in block diagram format an exemplary casino gaming server system according to a specific embodiment of the present disclosure. In at least one embodiment, the Casino Server System 801 may be operable to perform and/or implement various types of functions, operations, actions, and/or other features, such as, for example, one or more of those described and/or referenced herein. In at least one embodiment, the Casino Server System 801 may include a plurality of components operable to perform and/or implement various types of functions, operations, actions, and/or other features such as, for example, one or more of the following (or combinations thereof):

- Context Interpreter (e.g., 802) which, for example, may be operable to automatically and/or dynamically analyze contextual criteria relating to a detected set of event(s) and/or condition(s), and automatically determine or identify one or more contextually appropriate response(s) based on the contextual interpretation of the detected event(s)/condition(s). According to different embodiments, examples of contextual criteria which may be analyzed may include, but are not limited to, one or more of the following (or combinations thereof):
  - location-based criteria (e.g., geolocation of mobile gaming device, geolocation of EGD, etc.)
  - time-based criteria
  - identity of user(s)
  - user profile information
  - transaction history information
  - recent user activities
  - etc.
- Time Synchronization Engine (e.g., 804) which, for example, may be operable to manages universal time synchronization (e.g., via NTP and/or GPS)
- Search Engine (e.g., 828) which, for example, may be operable to search for transactions, logs, game history information, player information, automated money laundering detection and reporting information, etc., which may be accessed from one or more local and/or remote databases.
- Configuration Engine (e.g., 832) which, for example, may be operable to determine and handle configuration of various customized configuration parameters for one or more devices, component(s), system(s), process(es), etc.
- Time Interpreter (e.g., 818) which, for example, may be operable to automatically and/or dynamically modify or change identifier activation and expiration time(s) based on various criteria such as, for example, time, location, transaction status, etc.
- Authentication/Validation Component(s) (e.g., 847) (password, software/hardware info, SSL certificates) which, for example, may be operable to perform various types of authentication/validation tasks such as one or more of those described and/or referenced herein.
- Transaction Processing Engine (e.g., 822) which, for example, may be operable to handle various types of transaction processing tasks such as, for example, one or more of those described and/or referenced herein.
- OCR Processing Engine (e.g., 834) which, for example, may be operable to perform image processing and optical character recognition of images such as those captured by a gaming device camera, for example.
- Database Manager (e.g., 826) which, for example, may be operable to handle various types of tasks relating to database updating, database management, database access, etc. In at least one embodiment, the Database Manager may be operable to manage game history databases, player tracking databases, etc.
- Log Component(s) (e.g., 811) which, for example, may be operable to generate and manage transactions history logs, system errors, connections from APIs, etc.

Status Tracking Component(s) (e.g., 812) which, for example, may be operable to automatically and/or dynamically determine, assign, and/or report updated transaction status information based, for example, on the state of the transaction.

Gateway Component(s) (e.g., 814) which, for example, may be operable to facilitate and manage communications and transactions with external Payment Gateways.

Web Interface Component(s) (e.g., 808) which, for example, may be operable to facilitate and manage communications and transactions with virtual live game table web portal(s).

API Interface(s) to Casino Server System(s) (e.g., 846) which, for example, may be operable to facilitate and manage communications and transactions with API Interface(s) to Server System(s) of various casino networks.

API Interface(s) to 3rd Party Server System(s) (e.g., 848) which, for example, may be operable to facilitate and manage communications and transactions with API Interface(s) to 3rd Party Server System(s)

At least one processor 810. In at least one embodiment, the processor(s) 810 may include one or more commonly known CPUs which are deployed in many of today's consumer electronic devices, such as, for example, CPUs or processors from the Motorola or Intel family of microprocessors, etc. In an alternative embodiment, at least one processor may be specially designed hardware for controlling the operations of a gaming system. In a specific embodiment, a memory (such as non-volatile RAM and/or ROM) also forms part of CPU. When acting under the control of appropriate software or firmware, the CPU may be responsible for implementing specific functions associated with the functions of a desired network device. The CPU preferably accomplishes all these functions under the control of software including an operating system, and any appropriate applications software.

Memory 816, which, for example, may include volatile memory (e.g., RAM), non-volatile memory (e.g., disk memory, FLASH memory, EPROMs, etc.), unalterable memory, and/or other types of memory. In at least one implementation, the memory 816 may include functionality similar to at least a portion of functionality implemented by one or more commonly known memory devices such as those described herein and/or generally known to one having ordinary skill in the art. According to different embodiments, one or more memories or memory modules (e.g., memory blocks) may be configured or designed to store data, program instructions for the functional operations of the mobile gaming system and/or other information relating to the functionality of the various Mobile Transaction techniques described herein. The program instructions may control the operation of an operating system and/or one or more applications, for example. The memory or memories may also be configured to store data structures, metadata, identifier information/images, and/or information/data relating to other features/functions described herein.

Interface(s) 806 which, for example, may include wired interfaces and/or wireless interfaces. In at least one implementation, the interface(s) 806 may include functionality similar to at least a portion of functionality implemented by one or more computer system interfaces such as those described herein and/or generally known to one having ordinary skill in the art.

Device driver(s) 842. In at least one implementation, the device driver(s) 842 may include functionality similar to at least a portion of functionality implemented by one or more computer system driver devices such as those described herein and/or generally known to one having ordinary skill in the art.

One or more display(s) 835.

Messaging Server Component(s) 836, which, for example, may be configured or designed to provide various functions and operations relating to messaging activities and communications.

Network Server Component(s) 837, which, for example, may be configured or designed to provide various functions and operations relating to network server activities and communications.

AML Detection and Reporting Component(s) 852. In at least one embodiment, the AML Detection and Reporting components may be configured or designed to include functionality for facilitating, aggregating data, enabling, initiating, and/or performing various types of financial transaction analysis, AML analysis and detection, and reporting operation(s), action(s), and/or feature(s) such as one or more of those described herein.

E-Filing and Report Component(s) 854. In at least one embodiment, the e-Filing and Report Component(s) may be configured or designed to include functionality for facilitating, enabling, initiating, and/or performing various types of reporting and notification activities such as, for example:

automated electronic filing of detected suspicious fraudulent activities at appropriate governmental agencies;

automated generation and/or transmission of notifications and alerts (e.g., such as those relating to detected suspicious fraudulent activities) to appropriate authorities (e.g., police, Federal agencies, local law enforcement, casino security personnel, casino employees, etc.);

and/or other types of types of reporting and notification activities such as those described herein.

Voucher and Chip Tracking Components 878. In at least one embodiment, the Voucher and Chip Tracking Components can include functionality for generating, storing, updating, tracking, and analyzing data with respect to the issuance and redemption of printed tickets, casino chips, and other voucher items having cash or credit values.

Suspicious and Fraudulent Activity Pattern Database(s) 892. In at least one embodiment, the Suspicious and Fraudulent Activity Pattern Database(s) may be configured or designed to include functionality for storing and/or providing access to various types of information relating to suspicious activity pattern and fraudulent pattern analysis and detection, and/or other types of information described and/or referenced herein.

Voucher and Chip Tracking Database(s) 893.

Transactions Database(s) 894. In at least one embodiment, the Transactions Database(s) may be configured or designed to include functionality for storing and/or providing access to various types of information, events, and/or conditions such as, for example, one or more of the following (or combinations thereof):

casino-related information, game play information, wager information, financial transaction information, and/or other types of information described and/or referenced herein.

Etc.

Various embodiments of automated fraudulent activity detection, analysis, and reporting techniques described herein are directed to different methods and systems for enabling automated, rule-based and/or pattern-based monitoring, detection, analysis, and reporting of suspicious activities relating to financial or monetary conducted in casino gaming establishments, casino networks, and/or non-casino environments. According to different embodiments, one or more Suspicious Activity Pattern Database(s) (e.g., 892) may be provided for storing and/or providing access to various types of information for use in conducting suspicious fraudulent activity pattern analysis, detection and/or reaction. For example, in some embodiments, at least a portion of the information stored in the Suspicious Activity Pattern Database(s) 892 may include rule-based and/or pattern-based criteria for use in facilitating identification of suspicious fraudulent activity during analysis of casino-related financial transactions.

Non-limiting examples of various suspicious fraudulent activity rule-based and/or pattern-based criteria may include, but are not limited to, one or more of the following (or combinations thereof):

A. Customers who try to keep their transactions just below the reporting or recordkeeping thresholds, such as:
   - Two or more customers each purchase chips with currency in amounts between $3,000 and $10,000, engage in minimal gaming, combine the chips (totaling in excess of $10,000), and one of them redeems the chips for a casino check.
   - A customer seeks to cash out chips, tickets or tokens in excess of $10,000, but when asked for identification for completing a Currency Transaction Report by Casinos (CTRC) form, reduces the amount of chips or tokens to be cashed out to less than $10,000.
   - A customer pays off a large credit debt, such as markers or bad checks, of more than $20,000 over a short period of time (e.g., less than one week), through a series of currency transactions, none of which exceeds $10,000 in a gaming day.
   - A customer receives a race book or sports pool payout in excess of $10,000 and requests currency of less than $10,000 and the balance paid in chips. The customer then goes to the cage and redeems the remaining chips for currency in an amount that is less than the CTRC reporting threshold.
   - A customer, who is a big winner, enlists another individual (who is not a partner of the customer in the gaming activity), to cash out a portion of the chips or tokens won to avoid the filing of a CTRC, IRS Form W-2G or other tax forms.
   - A customer attempts to influence, bribe, corrupt, or conspire with an employee not to file CTRCs.
   - Using a Cage Solely for Its Banking-Like Financial Services B. Customer activity involving unusual banking-like transactions at the cage, such as:
   - A customer wires funds derived from non-gaming proceeds, to or through a bank and/or a non-bank financial institution(s) located in a country that is not his/her residence or place of business.
   - A customer appears to use a casino account primarily as a temporary repository for funds by making frequent deposits into the account and, within a short period of time (e.g., one to two days), requests money transfers of all but a token amount to domestic or foreign-based bank accounts.

C. Customers conducting large transactions on the floor with little or no related gaming activity and without reasonable explanation, such as:
   - A customer purchases a large amount of chips with currency at a table, engages in minimal gaming, and then redeems the chips for a casino check.
   - A customer draws casino markers (e.g., between $5,000 and $10,000) which he/she uses to purchase chips, engages in minimal or no gaming activity, and then pays off the markers in currency and subsequently redeems the chips for a casino check.
   - A customer makes a large deposit using numerous small denomination bills (e.g., $5s, $10s and $20s); and withdraws it in chips at a table game, engages in minimal gaming, and exchanges remaining chips at a cage for large denomination bills (e.g., $100), a casino check or a money transfer.
   - While reviewing computerized player rating records, an employee determines that a customer frequently purchases chips with currency between $5,000 and $10,000, engages in minimal gaming, and walks away with the chips.
   - A customer using a slot club account card inserts $2,990 of paper money (or an amount just below established thresholds) into a bill acceptor on a slot machine or video lottery terminal (e.g., contemporaneously inserting $5s, $10s and $20s), accumulating credits with minimal or no gaming activity, presses the "cash out" button to obtain a ticket. The customer goes to three other machines and conducts the same activity for $2,990 at each machine. Then the customer redeems the tickets for large denomination bills or casino checks with different cage cashiers at different times in a gaming day.
   - A customer transfers funds to a casino for deposit into a front money account in excess of $5,000; and withdraws it in chips at a table game, engages in minimal or no gaming activity, and exchanges remaining chips at a cage for a casino check.
   - Cashing out chips when the casino had no record of the individual having bought or played with chips.
   - Buying chips with cash, casino credit, credit card advances, wired funds, or funds withdrawn from safekeeping accounts, and then playing minimally or not playing at all. Some subjects cashed out chips while others left the casino with unredeemed chips.
   - Receiving wired funds into a casino front money account and then requesting that the funds be wired to a bank account without playing.
   - Frequently depositing money orders or casino checks from other casinos into front money accounts, buying in and playing minimally, or not playing and then cashing out through issuance of a casino check.
   - Patrons inserted large numbers of small denomination bills into casino gaming machines with little or no play in order to exchange small bills for casino tokens. Patrons then redeemed the casino tokens for large bills.
   - Patrons used small bills to buy in at gaming tables, received large denomination chips, and redeemed those chips with little or no play for large denomination bills.

D. Customers conducting illegal activity, such as:
- A customer conducts transactions that the casino believes to be the result of some illegal activity or from an illegal source (e.g., narcotics trafficking).
- A customer or a group of individuals forge signatures or use counterfeit business or personal checks to obtain currency, chips or tokens.
- Customers secured markers with personal checks that were returned unpaid, either because the account held insufficient funds or because the depository institution had previously closed the account.
- Patrons negotiated or attempted to negotiate stolen, forged, or altered checks.
- Patrons attempted to pass counterfeit bills.
- Casino patrons use their player club points to purchase significant amounts of merchandise at independently owned and operated retail stores on casino premises.

E. Transactions involving suspicious or unusual characteristics and/or activities, such as:
- A pair of bettors frequently cover between them both sides of an even bet, such as:
  - Betting both "red and black" or "odd and even" on roulette; or
  - Betting both with and against the bank in baccarat/mini-baccarat; or
  - Betting the "pass line" or "come line" and the "don't pass line" or "don't come line" in craps; and
  - the aggregate amount of both bettors' total wagering is in excess of $5,000.
- A customer routinely bets both sides of the same line for sporting events (e.g., betting both teams to win) and thus the amount of overall loss to the customer is minimal (known as hedging).
- A customer requests the issuance of casino checks, each less than $3,000, which are made payable to third parties or checks without a specified payee.
- A customer furnishes a legitimate type of identification document, in connection with the completion of a CTRC, or the opening of a deposit, credit or check cashing account, which:
  - Does not match the customer's appearance (e.g., different age, height, eye color, sex); or
  - Is false or altered (e.g., address changed, photograph substituted).
- A customer presents information for the completion of CTRCs for different gaming days that contains conflicting identification information, such as:
  - Different address or different spelling or numeration in address;
  - Different state driver's license number; or
  - Different social security number.
- A customer makes large deposits or pays off large markers with multiple instruments (e.g., cashier's checks, money orders, traveler's checks, or foreign drafts) in amounts of less than $3,000.
- A customer withdraws a large amount of funds (e.g., $30,000 or more) from a deposit account and requests that multiple casino checks be issued each of which is less than $10,000.
- A customer arranges large money transfers out of the country which are paid for by multiple cashier's checks from different financial institutions in amounts under $10,000.
- Reducing the number of chips or tokens to be cashed out at a cage when asked to provide identification or a Social Security Number (SSN), when the cash out was over $10,000, or when a subject had previously cashed out chips or tokens and the additional cash out would exceed $10,000 in a gaming day. This was the most frequently reported structuring activity.
- Reducing the amount of cash buy-ins at gaming tables to avoid providing identification or an SSN.
- Using agents to cash out chips.
- Cashing out chips, tickets, and/or tokens multiple times a day, at different times, or at different windows/cages.
- Requesting jackpot winnings exceeding $10,000 to be paid in two or three payments. In some cases, winnings were placed on deposit and withdrawn in cash amounts under the currency transaction reporting threshold.
- Wiring funds into front money accounts and withdrawing those funds, in cash, in smaller increments to avoid conducting one large-dollar reportable transaction.
- Repaying outstanding balances with structured cash payments, apparently to avoid a reportable transaction.
- Purchasing chips with cash just under the reporting threshold and then purchasing additional chips at the table, again with cash.
- Placing bets at multiple sportsbooks, usually at related properties, in an attempt to structure bets that in the aggregate would exceed the reporting threshold. Placing bets at multiple properties may also conceal aggregated winnings over the reporting threshold.
- Customers repeatedly inquire about the CTRC reporting requirements, and whether their buy-ins and/or cash-outs had reached the reporting threshold.
- A high-stakes player frequently wires funds via depository institutions to the front money account of another high-stakes customer.
- Customer uses markers as casino loans by requesting advances on credit through markers, often at gaming tables, then does not play or play only minimally.
- Customers using player rating accounts record their gaming history on each other's accounts, possibly to conceal wins and losses by each customer.
- Surveillance determines that the person attempting to claim a slot jackpot is not the actual jackpot winner.
- Patrons wager higher amounts than their occupations appear able to support.
- Casino employees who assist customers by failing to log patrons' multiple currency transactions into the casinos' Multiple Transaction Logs.
- Patrons attempting to reduce the dollar amount received from their chip redemptions, apparently to avoid a CTRC filing requirements.

According to different embodiments, it may be preferable or desirable for a casino to develop and implement an effective fraud and suspicious activity detection program. The casino's size, location, dollar volume, types of games, type/nature of customers, and internal controls are some of the factors to consider when analyzing the possible risk of money laundering occurring at the casino. Additionally, in at least some embodiments, an effective anti-money laundering program may be configured or designed to include automated notification and reporting mechanisms (such as, for example, E-Filing and Report Component(s) 854) which may include functionality for facilitating, enabling, initiating, and/or performing various types of reporting and notification activities such as, for example: automated electronic filing of detected suspicious fraudulent activities at appropriate governmental agencies; automated generation and/or transmission of notifications and alerts (e.g., such as those relating to detected suspicious fraudulent activities) to appropriate authorities (e.g., police, Federal agencies, local law enforcement, casino security personnel, casino employees, etc.); and/or other types of types of reporting and notification activities such as those described herein.

In at least one embodiment, the automated money laundering analysis, detection and reporting components of a Casino Gaming Network may be operable to: (i) automatically analyze data relating to financial transaction events and other activities occurring at the casino; (ii) automatically detect suspicious fraudulent activities and/or reportable financial transaction events; and (iii) automatically generate and electronically file appropriate electronic reports (e.g., relating to the detected suspicious fraudulent activities and/or reportable financial transaction events) at one or more specified entities or agencies.

For example, in one embodiment, the automated money laundering analysis, detection and reporting components of a Casino Gaming Network may automatically generate and electronically file one or more a Currency Transaction Report(s) (CTRs) for reporting each transaction in currency involving cash-in and cash-out of more than $10,000 in a gaming day.

In at least one embodiment, transactions in currency involving cash-in may include, but are not limited to one or more of the following (or combinations thereof):

- Purchase of chips, tokens, and plaques
- Front money deposits
- Safekeeping deposits
- Payments on any form of credit, including markers and counter checks
- Bets of currency
- Currency received by a casino for transmittal of funds through wire transfer for customer
- Purchases of a casino's check
- Exchanges of currency for currency, including foreign currency In at least one embodiment, transactions in currency involving cash-out may include, but are not limited to one or more of the following (or combinations thereof):

- Redemption of chips, tokens and plaques
- Front money withdrawals
- Safekeeping withdrawals
- Advances on any form of credit, including markers and counter checks
- Payments on bets, excluding slot and video lottery terminal jackpots
- Payments by a casino to a customer based on receipts of funds through wire transfer for credit to a customer
- Cashing of checks or other negotiable instruments
- Exchanges of currency for currency, including foreign currency
- Reimbursements for customers' travel and entertainment expenses by the casino In some embodiments, multiple currency transactions may be treated as a single transaction if, for example, the casino has knowledge that they are by, or on behalf of, any person and result in either cash in or cash-out totaling more than $10,000 during any gaming day. In some embodiments, cash-in and cash-out transactions may preferably be aggregated separately. In some embodiments, a CTR may preferably be electronically filed within 15 calendar days following the day the reportable transaction occurs. In some embodiments, Suspicious Activity Reports (SARs) be filed for any detected suspicious transaction(s) that may be relevant to the possible violation of any law or regulation, and which involves or aggregates at least $3,000 in funds or other assets.

According to different embodiments, Casino Gaming Networks may be configured or designed to retain copies of electronically filed CTR and SAR reports for a specified period of time, as may be legally required (e.g., five years from the date of the report). Additionally, in some embodiments, evidence relating to any detected suspicious fraudulent activity (e.g., such as financial transactions, player information, gaming information, wagering information, captured video or images, etc.) may also be retained for a specified period of time.

In at least one embodiment, the term "Casino Cage" may be interpreted to include a secure work area within a casino that houses cashiers and storage facilities for cash, chips, tokens, and credit documents. Cashiers at the cage conduct transactions with customers and other casino areas.

In at least one embodiment, the term "Front Money" may be interpreted to include money deposited by a customer into a personal casino account with a cage cashier. The customer can later withdraw the front money at gaming tables or at the cage in the form of chips, currency, casino check, or wire transfer.

In at least one embodiment, the term "Marker or Counter Check" may be interpreted to include credit extended to a customer in exchange for chips, tokens, or currency. The marker or counter check may be intended for use in gambling.

In at least one embodiment, the term "Multiple Transaction Log" may be interpreted to include casino and card club documents used to record and keep track of customer currency transaction activity above a given dollar threshold. Many casinos and card clubs maintain multiple transaction logs for pit and cage (including slot booth) transactions, sometimes pursuant to state, local, or tribal gaming laws, or within the ordinary course of business.

In at least one embodiment, the term "Player Club Points" may be interpreted to include casinos "club points," which may be awarded to casino patrons based on how much customers bet and how often they play. Patrons can redeem these club points for goods and services at restaurants, retail shops, or hotels.

In at least one embodiment, the term "Player Rating Card" may be interpreted to include a card used in a casino pit to keep track of a player's activity at a single gaming table for purposes of determining if a player is entitled to receive complimentary services ("comps"). Each time a rated player begins gambling at a table, designated casino employees who monitor customer's play prepare a "player rating card," also known as a "rating card" or "rating slip."

In at least one embodiment, casinos may assign different "Player Ratings" to different patrons, which may be used for awarding complimentary services to attract and retain customers. A common player rating method is based on theoretical win—the amount a casino expects to win from a particular customer. It is calculated using a number of factors, including the length of time the gambler plays.

In at least one embodiment, the term "Pit" may be interpreted to include an area of a casino or card club floor that contains gaming tables. Each pit contains several gaming tables organized by game type. Each pit is under the supervision of a single floor supervisor (or "pit boss"). Customers can buy chips and conduct other transactions at the pit.

In at least one embodiment, the term "Sportsbook" may be interpreted to include a place where individuals can wager on various sports competitions, such as golf, football, basketball, baseball, boxing, and horse racing.

In at least one embodiment, the term "Surveillance" may be interpreted to include various types of surveillance components including, for example, video cameras, monitors, recorders, video printers, switches, selectors and other ancillary equipment to observe and record activities at the gaming establishment Casinos often identify individuals conducting unusual, suspicious or potentially criminal financial transactions through surveillance.

In at least one embodiment, the term "cash" may be interpreted to include coin and currency of the United States or any other country, and may include cashier's checks, gaming vouchers, bank drafts, traveler's checks, or money orders received over $10,000 in one transaction (or two or more related transactions) during a 12-month period.

Figure 10:
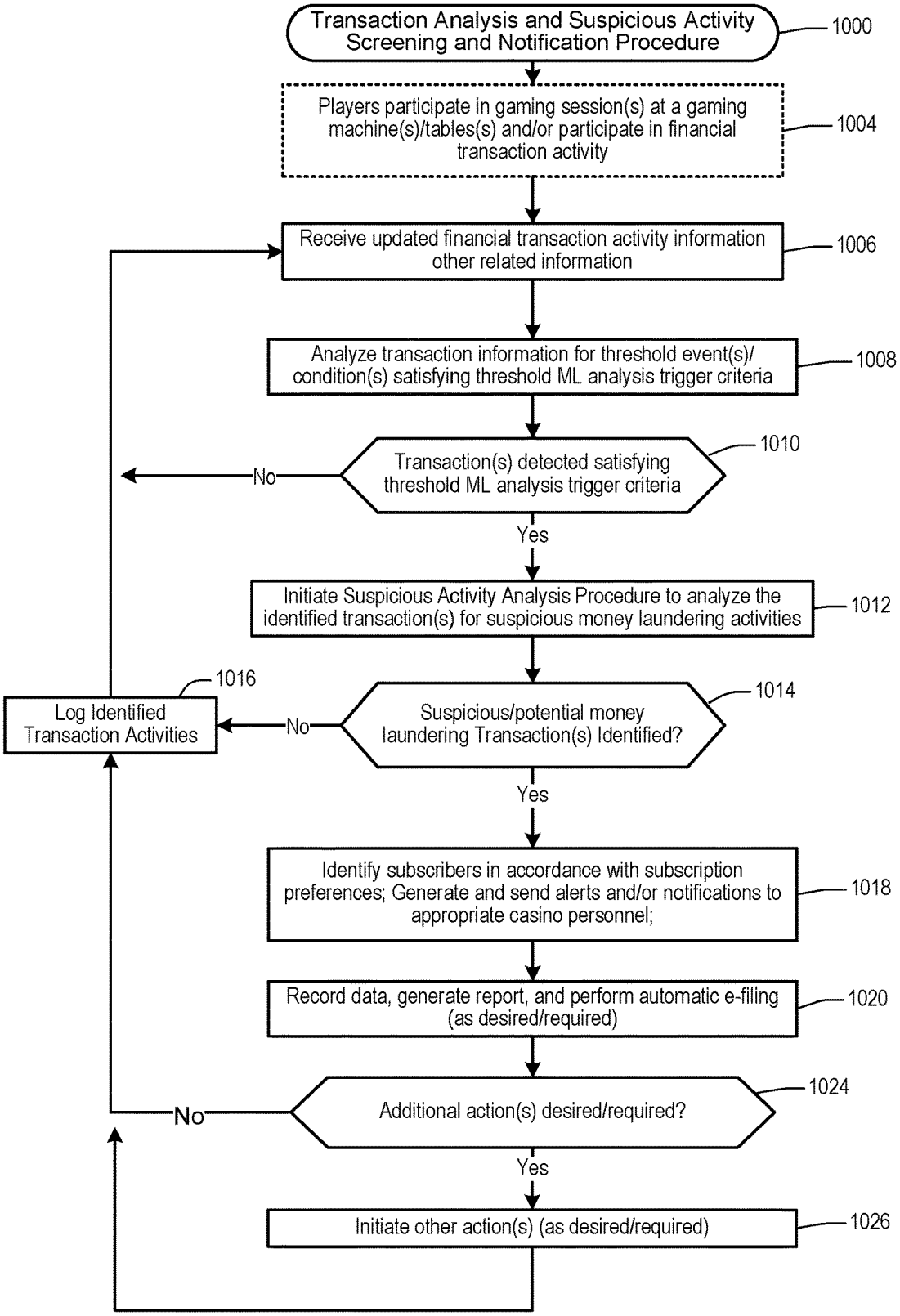
FIG. 10 provides a flowchart of an exemplary method of analyzing transactions using gaming monetary instruments according to one embodiment of the present disclosure.
Figure 11:
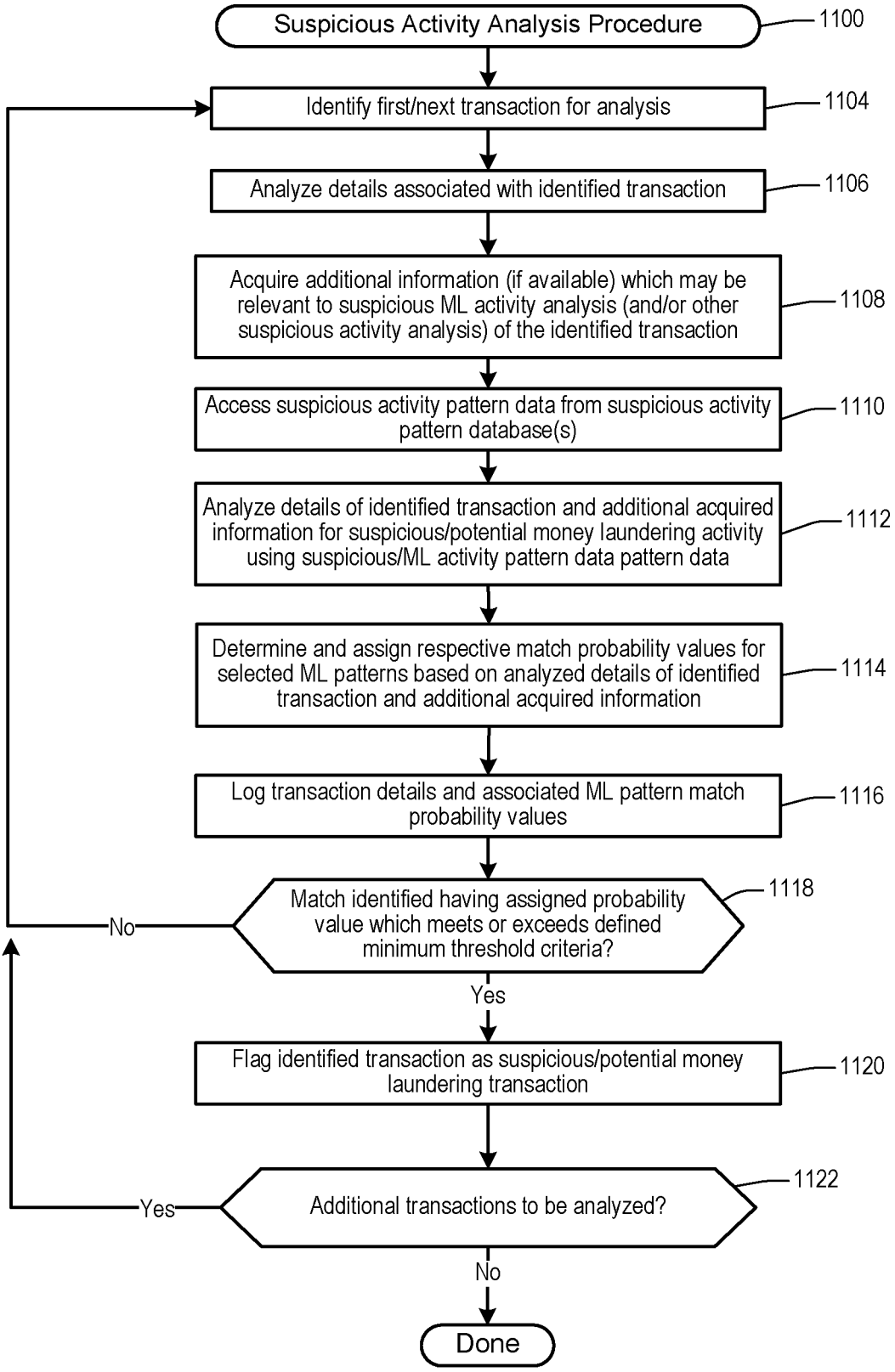
FIG. 11 provides a flowchart of an exemplary method of analyzing transactions for suspicious gaming activity patterns using gaming monetary instruments according to a specific embodiment of the present disclosure.

FIGS. 10-11 illustrate various example embodiments of different fraud detection and suspicious transactional activity analysis, detection and reporting procedures and/or procedural flows which may be used for facilitating activities relating to one or more of the automated fraud detection analysis, detection and reporting aspects disclosed herein. More specifically, FIG. 10 shows an example of a Transaction Analysis and Suspicious Activity Screening and Notification Procedure 1000 in accordance with a specific embodiment, and FIG. 11 shows an example of a Suspicious Activity Analysis Procedure 1100 in accordance with a specific embodiment.

According to different embodiments, at least a portion of the functions, operations, actions, and/or other features provided by the various procedures, steps, and/or operations described herein may be implemented at one or more client systems(s); at one or more server systems(s) such as, for example, casino server system(s) (e.g., 140, FIG. 1), cloud server system(s) (e.g., 160, FIG. 1); and/or may be implemented at one or more other types of system(s) described and/or referenced herein.

In at least one embodiment, one or more of the various procedures, steps, and/or operations described herein may be operable to utilize and/or generate various different types of data and/or other types of information when performing specific tasks and/or operations. This may include, for example, input data/information and/or output data/information. For example, in at least one embodiment, the automated fraud detection analysis, detection and reporting procedures may be operable to access, process, and/or otherwise utilize information from one or more different types of sources, such as, for example, one or more local and/or remote memories, devices and/or systems. Additionally, in at least one embodiment, the automated fraud detection analysis, detection and reporting procedures may be operable to generate one or more different types of output data/information, which, for example, may be stored in memory of one or more local and/or remote devices and/or systems. Examples of different types of input data/information and/or output data/information which may be accessed and/or utilized by the automated fraud detection analysis, detection and reporting procedures may include, but are not limited to, one or more of those described and/or referenced herein.

In at least one embodiment, a given instance of one or more of the various procedures described herein may access and/or utilize information from one or more associated databases. In at least one embodiment, at least a portion of the database information may be accessed via communication with one or more local and/or remote memory devices. Examples of different types of data which may be accessed by the automated fraud detection analysis, detection and reporting procedures may include, but are not limited to, one or more of those described and/or referenced herein.

According to specific embodiments, multiple instances or threads of the Transaction Analysis and Suspicious Activity Screening and Notification Procedure and/or Suspicious Activity Analysis Procedure may be concurrently implemented and/or initiated via the use of one or more processors and/or other combinations of hardware and/or hardware and software. For example, in at least some embodiments, various aspects, features, and/or functionalities of the Suspicious Activity Screening and Notification Procedure and/or Suspicious Activity Analysis Procedure may be performed, implemented and/or initiated by one or more of the various systems, components, systems, devices, procedures, processes, etc., described and/or referenced herein.

According to different embodiments, one or more different threads or instances of the Suspicious Activity Screening and Notification Procedure and/or Suspicious Activity Analysis Procedure may be initiated in response to detection of one or more conditions or events satisfying one or more different types of minimum threshold criteria for triggering initiation of at least one instance of one or more of the procedures. Various examples of conditions or events which may trigger initiation and/or implementation of one or more different threads or instances of the various procedures may include, but are not limited to, one or more of those described and/or referenced herein.

According to different embodiments, one or more different threads or instances of the Suspicious Activity Screening and Notification Procedure and/or Suspicious Activity Analysis Procedure may be initiated and/or implemented manually, automatically, statically, dynamically, concurrently, and/or combinations thereof. Additionally, different instances and/or embodiments of the Suspicious Activity Screening and Notification Procedure and/or Suspicious Activity Analysis Procedure may be initiated at one or more different time intervals (e.g., during a specific time interval, at regular periodic intervals, at irregular periodic intervals, upon demand, etc.).

In at least one embodiment, initial configuration of a given instance of the Suspicious Activity Screening and Notification Procedure and/or Suspicious Activity Analysis Procedure may be performed using one or more different types of initialization parameters. In at least one embodiment, at least a portion of the initialization parameters may be accessed via communication with one or more local and/or remote memory devices. In at least one embodiment, at least a portion of the initialization parameters provided to an instance of a given procedure may correspond to and/or may be derived from the input data/information.

Different embodiments of the Transaction Analysis and Suspicious Activity Screening and Notification Procedure 1000 and/or Suspicious Activity Analysis Procedure 1100 may be configured or designed to provide various methods and techniques for enabling automated, rule-based monitoring, analysis, detection and reporting of suspicious activities relating to financial or monetary transactions conducted in casino gaming establishments, casino networks, and/or non-casino environments. One or more of these transactions may occur at various casino-related devices, machines, systems, and/or locations of casino environments and/or non-casino environments.

FIG. 10 provides a flowchart of an exemplary method of analyzing transactions using gaming monetary instruments according to one embodiment of the present disclosure. Transaction Analysis and Suspicious Activity Screening and Notification Procedure 1000 begins at 1004, where it may be assumed that casino patrons or customers participate in gaming and wagering activities at one or more gaming machine(s) and/or gaming tables(s), and/or participate in other types of financial transaction activity at the casino establishment (e.g., such as, for example: cash in transactions; cash out transactions; credit transactions; money exchange transactions; money deposit transactions; money withdrawal transactions; wagering token transactions; payout transactions; purchase transactions; money transfer transactions; and/or other types of financial transactions which may occur at casino gaming establishments and/or casino networks).

According to different embodiments, information relating to casino-related financial transactions may be captured (e.g., in real-time or non-real-time) at the device, table, or system where the financial transaction even has occurred, and uploaded (e.g., in real-time or non-real-time) to a server such as, for example, the Casino Server System 140 (FIG. 1), AML Detection and Reporting Component(s) 141 (FIG. 1), AML Server 236 (FIG. 2), AML Detection and Reporting Services (e.g., 161, FIG. 1; 960, FIG. 9), etc.

For example, at the casino gaming devices and/or game tables, casino patrons may place wagers or participate in various cash-in transaction(s) by depositing their money (e.g., via cash, printed ticket, voucher, wagering tokens, etc.), and/or by putting up credits (e.g., from pre-established credit accounts). Casino patrons may also participate in various cash-in transaction(s) at financial kiosks and cashier cages. Similarly, casino patrons may participate in various cash-out transaction(s) at different gaming devices, gaming tables, financial kiosks, cashier cages, etc. According to different embodiments, data and other information relating to each of these transactions may be automatically captured, uploaded to a casino server system, and analyzed for suspicious activities. Preferably, the capturing and uploading (or reporting) of the financial transaction information may be performed in real-time (or near real-time) so as to allow the casino to detect and respond to suspicious or fraudulent activities in a timely manner. Examples of various types of data and/or information which may be captured (and uploaded) for a given financial transaction event may include, but are not limited to, one or more of the following (or combinations thereof):

- transaction event amount;
- transaction event location;
- time of transaction event;
- day of transaction event;
- date of transaction event;
- win amount;
- game-related information (e.g., game ID, game play history, etc.);
- wager-related information (e.g., credit meter, games won/lost, bet denomination, etc.);
- information relating to identity of person initiating transaction (e.g., Player ID);
- information relating to identity (e.g., asset ID) and location of gaming device/gaming table where transaction event occurred;
- information relating to identity of other gaming device(s) and/or gaming table(s) (e.g., gaming devices/tables near to where the suspicious transaction event occurred) in which similar suspicious transaction events have recently been detected (e.g., within the past 4 hours);
- information relating to identity of gaming table attendant(s) servicing gaming table/gaming device at time of transaction event;
- information relating to identities of other players participating at the gaming table/gaming device at time of transaction event;
- information relating to identity of gaming table attendant(s) servicing gaming table/gaming device at time of transaction event;
- information relating to identity of financial kiosk machine where transaction event took place and the location code of the kiosk;
- information relating to identity of cashier cage where transaction event took place;
- information relating to identity of cashier attendant(s) on duty at cashier cage where transaction event took place;
- Casino ID and location;
- information relating to the bill validator status of the gaming device/gaming table where transaction event occurred
- and/or other types of desired information relating to or concurrent with the identified transaction event.

As illustrated in the example embodiment of FIG. 10, at 1006, it is assumed that the casino server system receives updated financial transaction activity information other related information. For example, in one embodiment, the updated transaction activity information may include information relating to money in/out activities (e.g., cash-in/cash-out activities), game related data, wager amount information, and win amount.

In at least one embodiment, the received financial transaction information may be analyzed (1008) by the casino server system (and/or cloud-based system(s)) for detection of possible fraudulent activities and/or other suspicious activities. Financial transactions which are flagged as potentially suspicious or even fraudulent activities may be logged, and additional analysis may be performed if one or more specific triggering criteria is satisfied. For example, in at least one embodiment, a multi-step analysis process may be utilized for suspicious fraudulent activity analysis, whereby all (or selected) financial transactions are each initially screened and analyzed (e.g., 1008, 1010) for one or more triggering events/conditions which, if satisfied, may necessitate additional (in-depth) suspicious fraudulent activity analysis (e.g., 1012) of the identified financial transaction (e.g., as shown in FIG. 11).

Accordingly, as illustrated in the example embodiment of FIG. 10, as shown at 1008 and 1010, the received transaction information may be initially screened for threshold event(s)/condition(s) satisfying threshold fraudulent analysis trigger criteria such as that previously described herein. As illustrated in the example embodiment of FIG. 10, if it is determined (1010) that an identified transaction meets or satisfies predefined threshold fraudulent analysis trigger criteria, then, in response, in-depth suspicious fraudulent activity analysis procedure(s) (such as, for example, Suspicious Activity Analysis Procedure of FIG. 11) may be triggered or initiated (1012) to further analyze the identified transaction for potential fraud and/or other suspicious activities.

For example, in one embodiment, in-depth suspicious fraudulent activity analysis may be triggered in response to detecting that total consecutive money cashed in (e.g., for a given player over a given time period such as, for example, 3 minutes) exceeds $3000 or some other specified threshold value. In some embodiments, a substantial cash in (e.g., at least $3000), follow by a minimum amount of gaming (e.g., at least 3 games of at least $20 wager each), followed by a cash out, can trigger a deeper analysis for suspicious fraudulent activity. In some embodiments, in-depth suspicious fraudulent activity analysis may be triggered in response to detecting that cumulative money cashed in for a given player over a given time period exceeds some specified threshold value. For example, frequent money-in into a gaming terminal, at 3-minute to 5-minute intervals, of $3000 or more each time, for a total of more than $10,000 in 15 minutes, may trigger a deeper analysis for suspicious fraudulent activity. In some embodiments, in-depth suspicious fraudulent activity analysis may be triggered in response to detecting that total consecutive money cashed out (e.g., for a given player over a given time period) such exceeds some specified threshold value. For example, frequent cash-out events at a gaming terminal, at 1-minute to 5-minute intervals, of $2000 or more each time, for a total of more than $9,000 over a 20-minute time window, may trigger a deeper analysis for suspicious fraudulent activity. In some embodiments, in-depth suspicious fraudulent activity analysis may be triggered in response to detecting that total money cashed out (for a given player over a given time period) exceeds some specified threshold value.

In yet other embodiments, the triggering of in-depth suspicious fraudulent activity analysis may be based, at least partially, on statistical information relating to one or more group(s) of gaming devices over a period of time, and/or may be based, at least partially, on statistical information relating to other types of financial transactions which occur over one or more specified time periods(s). For example, financial transactions for a given gaming device (or a specified group of gaming devices) may be averaged over a specified time period or time interval (e.g., 90 days) to establish a relative baseline of what a "normal" transaction is for that particular gaming device (or group of gaming devices). Any detected financial transactions (new and/or historical) associated with the identified gaming device (or associated with one or more gaming devices of the identified group of gaming device) may then be compared to the baseline "normal" transaction. If, based on the results of the comparison(s), it is determined that an identified transaction exceeds predefined threshold comparison criteria (e.g., greater than 3 sigmas or 3 standard deviations higher than the baseline "normal" transaction), such a determination may trigger in-depth suspicious fraudulent activity analysis of the identified new transaction.

By way of illustration, in one example, a statistical average analysis may be performed for cash-in transactions occurring at an identified gaming device over a 3-month time period. Based on this analysis it may be determined that the baseline "normal" cash-in transaction value and standard deviation value for the identified gaming device is $300, +/−$200. In one embodiment, the $300 value may represent the baseline "normal" cash-in transaction, and the "+/−$200" value may represent one standard deviation. One of the cash-in transactions which occurred during the analyzed 3-month time period relates to a cash-in transaction for $3000. This identified transaction may be determined to be about 13.5× standard deviations higher than the calculated baseline "normal" cash-in transaction for the identified gaming device, which may cause the triggering of in-depth suspicious fraudulent activity analysis to be performed on the identified transaction. Another, (new) cash-in transaction for $1800 is detected at the identified gaming device. This newly identified transaction may be determined to be about 7.5× standard deviations higher than the calculated baseline "normal" cash-in transaction for the identified gaming device, which may cause the triggering of in-depth suspicious fraudulent activity analysis to be performed on the newly identified transaction.

Similarly, in at least one embodiment, a statistical average analysis may be performed for cash-out transactions occurring at an identified gaming device over a 200-day moving time window. Based on this analysis it may be determined that the 200-day moving average, or the baseline "normal" cash-out transaction value and standard deviation value for the identified gaming device is $200, +/−$100. In one embodiment, the $200 value may represent the baseline "normal" cash-out transaction, and the "+/−$100" value may represent one standard deviation. One of the cash-out transactions which occurred during the analyzed 200-day moving time window relates to a cash-out transaction for $2000. This identified transaction may be determined to be about 18× standard deviations higher than the calculated baseline "normal" cash-out transaction for the identified gaming device, which may cause the triggering of in-depth suspicious fraudulent activity analysis to be performed on the identified transaction. Another, (new) cash-out transaction for $800 is detected at the identified gaming device. This newly identified transaction may be determined to be about 6× standard deviations higher than the calculated baseline "normal" cash-out transaction for the identified gaming device, which may cause the triggering of in-depth suspicious fraudulent activity analysis to be performed on the newly identified transaction.

It will be appreciated that the various types of baseline "normal" transaction and standard deviation criteria which may be generated and utilized for triggering of in-depth suspicious fraudulent activity analysis may depend upon the desired types of financial transaction filter criteria to be applied (such as, for example, time period filter criteria, transaction date filter criteria, transaction day of week filter criteria, transaction time filter criteria, etc.). Additionally, in at least some embodiments, the range of acceptable standard deviation variance may also be used as a definable criteria for triggering of in-depth suspicious fraudulent activity analysis. For example, any transactions which have been identified as exceeding 4× standard deviations from the baseline "normal" transaction may be flagged for in-depth suspicious fraudulent activity analysis.

According to different embodiments, the techniques for analyzing selected financial transaction information and determining the various baseline "normal" transaction and standard deviation criteria (e.g., such as those described above with respect to single or individual gaming devices) may similarly be applied to one or more sets or groups of gaming devices. For example, in some embodiments, a statistical average analysis may be performed for cash-in transactions occurring at one or more identified group(s) of gaming devices over a specified time period. Similarly, in some embodiments, a statistical average analysis may be performed for cash-out transactions occurring at one or more identified group(s) of gaming devices over a specified time period.

In some embodiments, various types of pattern recognition techniques may be utilized or employed for identifying suspicious financial transactions which may correspond to one or more different types of fraudulent financial activities. Non-limiting examples of pattern recognition techniques may include, but are not limited to, one or more of the following (or combinations thereof):

- Pattern recognition by location. Example: Group of gaming devices that are within a predefined proximity to each other (e.g., 20-meter proximity), and exhibit similar suspicious fraudulent activities.
- Pattern recognition by time. Example: Group of gaming devices that exhibit similar suspicious fraudulent activities over a period of time (e.g., 2 hours).

Pattern recognition by transaction types. Example: Group of gaming devices that exhibit high cash-in, follow by minimal gaming activities, and then a cash out transaction.

Returning to the example embodiment of FIG. 10, if it is determined (1014) that a suspicious activity and/or potential fraudulent transaction or event has been identified, then one or more automated response(s) may be initiated (e.g., 1016-1026) such as, for example, one or more of the following (or combinations thereof):

Logging Identified Transaction Activities (e.g., 1016).

Generating appropriate electronic reports describing the identified suspicious activity/transaction, and perform automated e-filing (as desired/required) (e.g., 1020). In at least one embodiment, this may include electronic filing of CTR reports, SAR reports, and/or other reports with appropriate governing agencies such as, for example Financial Crimes Enforcement Network (FinCEN), Local, State and Federal gaming regulators, casino security personnel, law enforcement officers, casino security managers, and the like.

Identification (e.g., 1018) of notification/alert subscribers in accordance with subscription preferences.

Generation and transmission (e.g., 1018) of notification and/or alert messages to designated casino personnel such as, for example, the nearest security officers, a casino manager, pit boss, etc. In some embodiments, the suspicious activity alert messages may be generated and transmitted in real-time or near real-time. In some embodiments, additional actions may be automatically implemented to verify the actual presence of security personnel on duty at any given time and/or to verify that the intended recipients of the suspicious activity alert messages have actually been received by those recipients. In some embodiments, a GUI representation of the casino floor may also be provided to facilitate casino personnel in quickly identifying the location of suspicious activity. According to different embodiments, different types of messaging protocols may be used for transmission of the alert messages such as, for example, push notification, pull notification (polling), SMS, email, RSS, and/or other types of messaging protocols or methods (as desired).

Generation and transmission of alert messages to local law enforcement.

Capture image of player (e.g., using casino security camera and/or gaming device camera).

Geolocation capture of suspicious transaction.

Geolocation capture of gaming device involved in suspicious transaction.

Geolocation capture of mobile device(s) associated with one or more persons involved with the identified suspicious activity.

Initiate geotracking (using, for example, WiFi/Cellular/GPS tracking techniques) of one or more persons involved with the identified suspicious activity.

Track casino chips in possession by one or more persons involved with the identified suspicious activity.

Delay completion of the transaction (e.g., prolong the transaction time), or hold the transaction processing, pending additional verifications and/or actions.

Etc.

In at least some embodiments, one or more different persons and/or entities may subscribe or register to receive alerts and/or notifications relating to various types of suspicious activities and/or potential money laundering transactions. Collectively, the various persons and/or entities who subscribe to receive selected suspicious activity/fraudulent transaction alert(s) may be referred to as subscribers. According to different embodiments, there may be different classes of subscribers such as, for example:

Passive Subscribers such as a casino legal compliance manager who is merely monitoring, but who is not actively patrolling the casino floor.

Active subscribers such as a security office patrolling the casino floor (who may need to proactively respond to an alert by going to the physical location where the suspicious alert activity was detected to assess the situation.), or a security manager in the back room who may be required to take action in response to a detected alert (e.g., by dispatching additional security officers).

Other types of subscribers may include, but are not limited to: casino employees, security personnel, casino floor managers, casino floor pit bosses, law enforcement personnel, government personnel, gaming regulators, governmental agencies, gaming regulatory agencies, financial regulatory agencies, etc.

According to different embodiments, different persons and/or entities may each provide or configure their respective subscription preferences and other subscription rules/criteria for receiving alerts and/or notifications relating to desired types of suspicious or fraudulent activities or transactions. Examples of various types of subscription preferences, rules, and criteria may include, but are not limited to, one or more of the following (or combinations thereof):

Location-based criteria, such as, for example multiple incidents/events within a location (e.g., Zone ABC, bank EFG, carousel IJK, casinos in Las Vegas, etc.).

Time-based criteria, such as, for example events/incidents which occur within a specific time window (e.g., 1 hour, New Year's eve, 3 months, etc.).

Passive subscription criteria, such as, for example, casino manager, or gaming regulator, or other governmental personnel (FINCEN, NSA, CIA, etc.), who wants to keep informed of trends and general activities. For such subscribers, real time notification may not be a necessity, but periodic reports or digests of events/incidents may be desirable (e.g., daily, weekly, monthly, every month, etc.).

Active subscription criteria, such as, for example, casino security supervisor, casino dispatcher, and/or other persons who may wish to receive real-time alerts/notifications relating to one or more predefined types of suspicious activities and/or potential money laundering transactions.

Priority-based criteria, such as, for example: transactions involving over $100,000 total cash which occur within 1 hour of each other (e.g., highest priority); transactions involving over $10,000 total deposit within a 24 hour period (e.g., medium priority); transactions involving over $3000 cash in per event (e.g., regular priority); and/or other types of priority-based criteria described and/or referenced herein.

Access-level criteria, which, for example, may be based on access level authorization, security level authorization, job title, etc. For example, a shift supervisor of security who is responsible for monitoring specific region of a casino floor may be provided with real-time alerts/notifications about suspicious activities and/or potential money laundering transactions which have been detected as occurring within one of the casino floor regions for which the security shift supervisor is responsible for overseeing. In another example, a casino regulator may be provided with periodic updates relating to alert/notification trends at various locations within his state. A VP of Compliance for a chain of casinos may be provided with access for viewing all (or selected) alerts and trends relating to activities at each of the casino establishments of the casino chain (some of which may be located in different states and/or countries).

In some embodiments, alert/event monitoring may be performed at an operator control panel in a back room of the casino. In other embodiments, alert/event monitoring may be performed in mobile environments (e.g., while the monitoring person is on the move).

For example, in one embodiment, a security officer (who is determined to be on-duty) may receive an alert or notification (e.g., via SMS text alert) on his smart phone or other mobile device. The security office may tap on the alert to open an activity monitoring application on the mobile device which may display an interactive Alert Floor Map GUI of the casino floor (or portion thereof) and which may also highlight (e.g., by visual display) the gaming device/table/machine at which a suspicious or fraudulent activity or event has been detected. In one embodiment, the security officer may interact with the Alert Floor Map GUI (e.g., by touching the highlighted gaming device) to access additional information and details relating to the nature of the alert, the transaction event(s), player identity, and/or other types of information relating to the detected suspicious or fraudulent activity or event. In some embodiments, the mobile device and/or Alert Floor Map GUI may be configured or designed to include functionality for:

receiving an alert;

facilitating visual identification and location of the gaming device/table associated with the alert;

facilitating visual identification and current location a person or suspect associated with the alert;

visually identifying a current location of the user's mobile device;

generating/displaying visual directional information to assist the mobile device user (e.g., security officer) in efficiently navigating to the identified gaming device/table;

generating/displaying visual directional information to assist the mobile device user (e.g., security officer) in tracking the movements and/or future activities of the identified person or suspect associated with the alert;

accessing and displaying detailed information relating to the alert (e.g., nature of suspicious activity, location, suggested response for the security office based on the priority level of the alarm, etc.).

In some embodiments the degree of severity of an identified suspicious activity may also be assessed (e.g., in real-time) in order to determine, for example: (i) which type(s) of response action(s) should be performed (e.g., in response to detection of the identified suspicious activity), and/or (ii) the appropriate timeframe for initiating or implementing each response action to be performed. By way of illustration, non-exhaustive examples of different types of criteria may be considered when determining the degree of priority or urgency to be assigned to a given response action may include, but are not limited to, one or more of the following (or combinations thereof):

Time sensitivity. For example, if it is determined that there is a time sensitivity associated with a given response action, then it is preferable that the response action be implemented within an appropriate, predetermined timeframe takes into account the time sensitivity.

Amount of time which has elapsed since the detected event occurred.

Type of suspicious activity involved.

Amount of money involved.

Number of similar incidents within a given period (e.g., 48 hours).

Number of similar incidents within a geographical area (e.g., nearby gaming devices, within the casino gaming venue, within a 2-mile radius, within the city, etc.).

Transactions characteristics and/or transaction patterns that have been flagged or prioritized by law enforcement agencies.

Prior histories of person(s) involved in the suspicious activity. For example, if it is determined that the identity of one of the persons involved in the suspicious activity is a fugitive, it may be desirable to immediately notify law enforcement agencies and/or casino security personnel of the last known location of the identified fugitive.

Increased likelihood of apprehending one or more person(s) involved in the suspicious activity (e.g., if response activity is assigned high priority status).

Increased likelihood of identifying one or more person(s) involved in the suspicious activity (e.g., if response activity is assigned high priority status).

Increased likelihood of prevention of similar type(s) of suspicious activities from occurring in future (e.g., if response activity is assigned high priority status).

Some events may be assigned relatively higher priorities than other events. Assignment of relative priorities may depend upon the particular facts and/or conditions associated with each event. Additionally, in some embodiments, the degree of urgency or priority of dispatching alert(s) communications and/or notification(s) for a given event may be determined, at least partially, as a function of the priority associated with that event.

For example, detection of a $9000 cash-in event at a specific gaming device, followed by an $8990 cash-out event at the same gaming device within 1 minute may be assigned a high priority, or may be assigned a relatively higher priority than detection of a $9000 cash-in event at the gaming device, followed by an $8990 cash-out event at the same gaming device 2 hours later. In the former situation, it may be determined that there is a relatively high degree of urgency to immediately send out an alert to casino security and the casino floor supervisor, alerting them of the detected fraudulent activity. In the latter situation, it may be determined that there is a relatively lower degree of priority (or no need) for sending out alert(s) communications relating to the detected event. In another example, a cash-out after a Jackpot win of $10,000 is may not be assigned as a high priority event for suspicious fraudulent activity. However, in at least one embodiment, the detection of such an event will trigger a flag for automatic reporting purposes for causing the detected event to be logged and reported to the appropriate agencies for tax reporting purposes.

It will be appreciated that different embodiments of the Transaction Analysis and Suspicious Activity Screening and Notification Procedure (not shown) may include additional features and/or operations than those illustrated in the specific embodiment of FIG. 10, and/or may omit at least a portion of the features and/or operations of Transaction Analysis and Suspicious Activity Screening and Notification Procedure illustrated in the specific embodiment of FIG. 10.

FIG. 11 provides a flowchart of an exemplary method of analyzing transactions for suspicious gaming activity patterns using gaming monetary instruments according to a specific embodiment of the present disclosure. In at least one embodiment, a Suspicious Activity Analysis Procedure 1100 may be configured or designed to perform in-depth suspicious fraudulent activity analysis of identified transactions to further analyze the identified transactions for suspicious or fraudulent activities. In at least one embodiment, the Suspicious Activity Analysis Procedure 1100 may be initiated or triggered in response to determining that an identified transaction meets or satisfies predefined threshold fraudulent analysis trigger criteria.

As shown at 1104, one or more specific transaction(s) may be identified for analysis. For purposes of simplification and clarification, it is assumed in the example embodiment of FIG. 11 that a specific transaction has been identified for in-depth suspicious activity analysis. In at least one embodiment, the identified transaction may correspond to a transaction which has previously been flagged for in-depth suspicious activity analysis.

As shown at 1106, various details associated with the identified transaction may be analyzed. In at least one embodiment, such details may include, for example, one or more of the following (or combinations thereof): information identifying one or more persons involved in the transaction; information identifying the kiosk, gaming device, gaming table or other device(s) associated with transaction; transaction time/date; transaction location; transaction amount; win amount; etc.

As shown at 1108, if desired, additional information relating to the identified transaction (if available) may be acquired, generated, and/or retrieved which may be relevant to suspicious or fraudulent activity analysis of the identified transaction. In at least one embodiment, at least a portion of the additional information may be retrieved and/or accessed from one or more sources such as, for example: casino server system database(s), external database(s), etc. Examples of such additional information may include, but are not limited to, one or more of the following (or combinations thereof):

- known associations between person performing suspicious activity and other persons;
- information relating to concurrent conditions and/or events (e.g., relative to the identified transaction being analyzed);
- information relating to historical transaction activities associated with the identified person;
- game-related information (e.g., game ID, game play history, etc.);
- wager-related information (e.g., credit meter, games won/lost, bet denomination, etc.);
- information relating to identity (e.g., asset ID) and location of gaming device/gaming table where transaction event occurred;
- information relating to identity of other gaming device(s) and/or gaming table(s) (e.g., gaming devices/tables near to where the suspicious transaction event occurred) in which similar suspicious transaction events have recently been detected (e.g., within the past 4 hours);
- information relating to identity of gaming table attendant(s) servicing gaming table/gaming device at time of transaction event;
- information relating to identities of other players participating at the gaming table/gaming device at time of transaction event;
- information relating to identity of gaming table attendant(s) (e.g., dealer, croupier(s), hostess(es), etc.) servicing gaming table/gaming device at time of transaction event;
- information relating to identity and location of financial kiosk machine where transaction event took place;
- information relating to identity and location of cashier cage where transaction event took place;
- information relating to identity of cashier attendant(s) on duty at cashier cage where transaction event took place;
- Casino ID and location;
- and/or other types of desired information relating to or concurrent with the identified transaction event.

As shown at 1110, pattern information relating to fraudulent activity and/or other types of suspicious activity may be accessed and/or retrieved from one or more Suspicious Activity/fraudulent Activity Pattern Database(s) (such as, for example, 892, FIG. 8). In at least one embodiment, the suspicious activity/fraudulent activity pattern information may include predefined sets of rules and other criteria for use in facilitating suspicious/fraudulent activity analysis, comparison, and detection.

As shown at 1112, details of the identified transaction and the additional acquired information may be analyzed for suspicious/potential fraudulent activity using the retrieved suspicious/fraudulent activity pattern data. In at least one embodiment, the Suspicious Activity Analysis Procedure may determine and assign (1114) respective match probability values for selected fraudulent patterns and/or other suspicious activity patterns based on analyzed details of the identified transaction and additional acquired information. As shown at 1116, selected transaction details relating to the identified transaction may be logged along with the calculated pattern match probability values. In at least one embodiment, this archive of historical transaction analysis information may be used for future analysis and/or detection of suspicious fraudulent activity.

In at least one embodiment, if at least one pattern match is identified (1118) for which the associated calculated pattern match probability value meets or exceeds predefined minimum threshold criteria (e.g., pattern match probability value >50%), then the identified transaction may be flagged (1120) as suspicious/potential money laundering transaction. Additional financial transactions flagged for in-depth suspicious activity analysis may be analyzed (1122) in a similar manner to that described above.

The foregoing features, embodiments, and procedures provide an overview and examples of various systems and methods to detect and provide alerts across gaming systems and networks with respect to suspicious and fraudulent activities and events. Another tool that can be used to help detect such activities and events can relate to gaming monetary instruments that are used within such gaming systems and networks. For example, printed tickets or vouchers having cash values are often printed and issued by slot machines, gaming tables, gaming kiosks, and other electronic devices throughout a casino and/or gaming enterprise or network. Often these printed tickets or vouchers are anonymously issued, in that any player or person holding a voucher may redeem such voucher for the cash value printed thereon. Unfortunately, present systems tend to provide inadequate help in detecting suspicious and fraudulent activities with respect to printed tickets and vouchers for gaming systems.

Accordingly, the disclosed embodiments also provide improved gaming monetary instrument tracking systems that allow for enhanced tracking and detection of suspicious and fraudulent gaming activities involving gaming monetary instruments. Again, a gaming monetary instrument can refer to a wide variety of items, such as, for example, printed tickets, vouchers, casino chips, markers, smart cards, magnetic stripe cards, and the like. For purposes of discussion, all such gaming monetary instruments or items shall be referred to as "vouchers" herein where context is appropriate.

In various embodiments, printed tickets and other vouchers can have tracking details associated therewith. Some or all printed tickets or vouchers within a gaming system or network can each be associated with a data structure, and can each be associated with a historical record that allows tracking across multiple different transactions over time. In some embodiments, a given voucher can have an identifier that not only associates a cash value with the voucher, but that also associates a historical record that identifies some or all sources of the cash value for that voucher, such as across several gaming transactions. In this manner, a more transparent level of continuity is provided across a series of gaming transactions that may involve multiple gaming devices and multiple vouchers.

Figure 12:
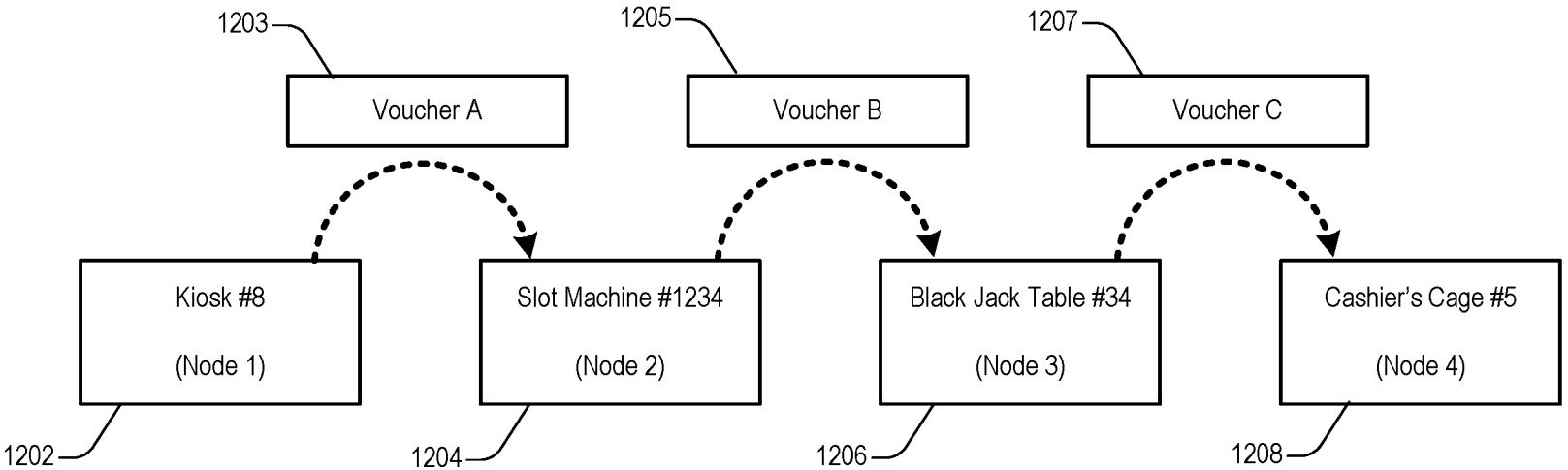
FIG. 12 provides a sequence chart of an exemplary chronological gaming transaction sequence using related gaming monetary instruments according to a specific embodiment of the present disclosure.

FIG. 12 provides a sequence chart of an exemplary chronological gaming transaction sequence using related gaming monetary instruments according to a specific embodiment of the present disclosure. Sequence 1200 represents an exemplary series of gaming transactions and events that might be conducted by a player over time at a casino or other gaming establishment. Although the present discussion is directed toward an example of one player at one casino, it will be readily appreciated that multiple players and/or multiple gaming establishments might also apply to this or a similar example.

Sequence 1200 includes the generation and redemption of multiple different printed tickets or vouchers 1203, 1205, 1207, which are used at multiple different system nodes or gaming devices 1202, 1204, 1206, 1208 over time across the casino. At an initial transaction, a player can insert $20 in cash at a first system node 1202, which can be, for example, "Kiosk #8" (Node 1). The player then requests a printed ticket 1203, upon which "Voucher A" in the amount of $20 is issued by Kiosk #8. As noted in greater detail below, a data structure and historical record on the gaming system can both be associated with Voucher A, with such data structure and historical record having sufficient data to track information regarding Voucher A. For example, the historical record can at least include data regarding the cash amount inserted at Kiosk #8, as well as Kiosk #8 being the gaming device that issued Voucher A. Further data can include the date and time that Voucher A was issued, and may also include other details, such as a serial number of a $20 bill inserted to procure the cash value of Voucher A, for example.

The player then moves to a second system node 1204, which can be, for example, "Slot Machine #1234" (Node 2), and inserts Voucher A for a credit of $20. The player then plays 10 games at $1 each and wins $50 at Slot Machine #1234, after which the player requests a cash out. A printed ticket 1205 represented as "Voucher B" in the amount of $60 (10+50) is then issued by Slot Machine #1234. Again, a data structure and historical record on the gaming system can both be associated with Voucher B, with such data structure and historical record having sufficient data to track information regarding Voucher B. For example, the historical record may include some or all of the data in the historical record for Voucher A, as well as additional information regarding the date and time of the insertion of Voucher A into Slot Machine #1234, the amounts and times of games played, the amounts won for the games played, and the date and time of the issuance of Voucher B from Slot Machine #1234. Accordingly, the historical record for Voucher B would contain data noting that Voucher B for $60 came about due to the $20 of Voucher A and a net win of $40 at Slot Machine #1234, such that the historical record accounts for the entire monetary value of Voucher B. In addition, the historical record for Voucher A may be updated with a forward reference to Voucher B.

The player then moves to a third system node 1206, which can be, for example, "Blackjack Table #34" (Node 3), and inserts or otherwise redeems Voucher B for a credit of $60. This credit can be taken in the form of $5 chips at the blackjack table, for example. The player then plays 20 games of blackjack at $5 per game, and wins a total of $140 over the 20 games. The net win then is $40 to go with the original $60 buy-in, giving the player $100 in chips. The player then requests a cash out, upon which a printed ticket 1207 represented as "Voucher C" in the amount of $100 is issued at Blackjack Table #34.

As in the above iterations, a data structure and historical record on the gaming system can both be associated with Voucher C, with such data structure and historical record having sufficient data to track information regarding Voucher C. For example, the historical record may include some or all of the data in the historical records for both of Voucher A and Voucher B, as well as additional information regarding the date and time of the redemption of Voucher B at Blackjack Table #34, the amounts and times of the blackjack games played, the amounts won for the games played, and the date and time of the issuance of Voucher C from Blackjack Table #34. Accordingly, the historical record for Voucher C would contain data noting that Voucher C for $100 came about due to the $20 of Voucher A and a net win of $40 at Slot Machine #1234, and a net win of $40 at Blackjack Table #34, such that the historical record accounts for the entire monetary value of Voucher C. In addition, the historical records for Voucher A and Voucher B may both be updated with a forward reference to Voucher C. Such forward reference updates can include some or all of the data contained in the forward referenced voucher or vouchers, such as Voucher C in this instance.

The player then moves to a fourth system node 1208, which can be, for example, "Cashier's Cage #5" (Node 4), and redeems Voucher C for $100 cash. The system can then invalidate Voucher C once it has been redeemed (to prevent any further redemption or other fraud), but may still retain the historical records for Vouchers A, B, and C, such as to detect larger patterns of gaming activities and transactions.

Figure 13:
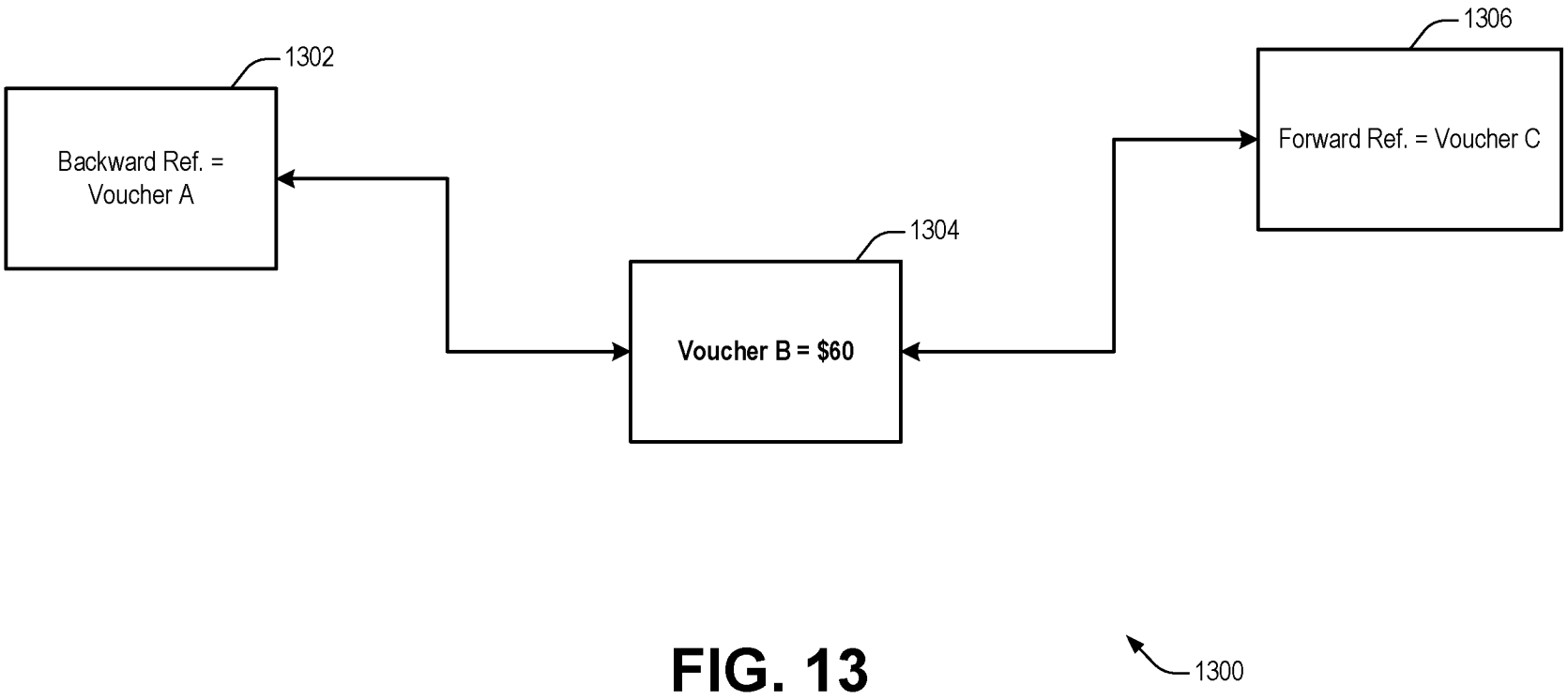
FIG. 13 illustrates in block diagram format multiple related gaming monetary instruments for FIG. 12 according to a specific embodiment of the present disclosure.

FIG. 13 illustrates in block diagram format multiple related gaming monetary instruments for FIG. 12 according to a specific embodiment of the present disclosure. Related voucher set 1300 represents three related printed tickets or vouchers that are issued sequentially in time, and can include Voucher A 1302, Voucher B 1304, and Voucher C 1306, which can all correspond to Vouchers A, B, and C of the foregoing example in FIG. 12. In this example of FIG. 13, focus can be made with respect to Voucher B, which issued in the amount of $60 and which was generated by Slot Machine #1234 (Node 2), as shown in FIG. 12.

Data structures and/or historical data for printed tickets and other vouchers can include various data items, such as voucher sequence data, for example. Such voucher sequence data can indicate some or all sources from which a voucher is derived (e.g., "backward references", as well as some or all vouchers that derive from the instant voucher (e.g., "forward references"). As shown, printed ticket 1304 (i.e., Voucher B) can be associated with historical data that can include voucher sequence data. In particular, the historical data for Voucher B can include a backward reference to Voucher A, as well as a forward reference to Voucher C. Of course, the forward reference to Voucher C cannot be input or detailed until Voucher C is created or otherwise known of. As such, historical data for a given voucher can be updated over time to reflect forward references.

Figure 14:
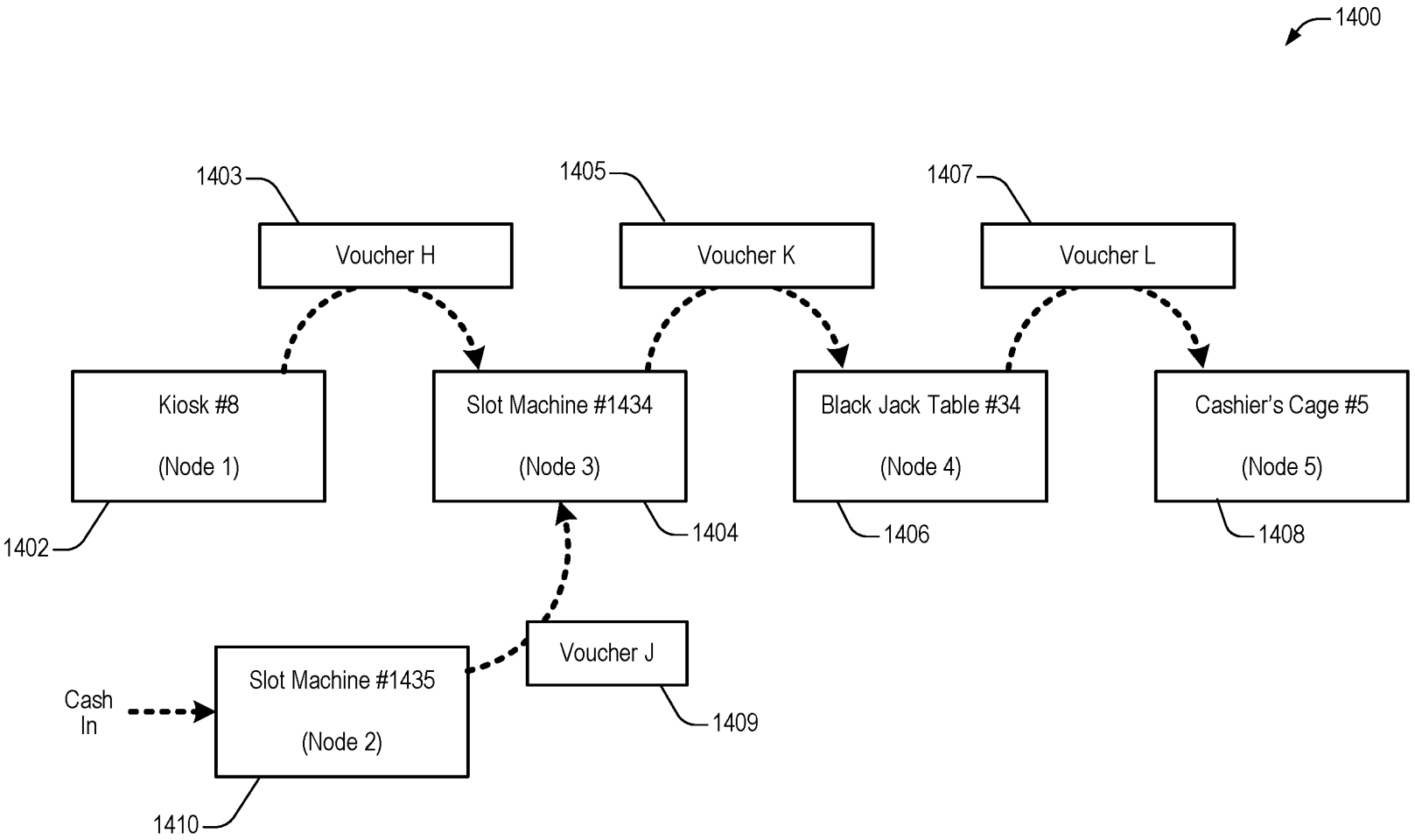
FIG. 14 provides a sequence chart of an exemplary alternative chronological gaming transaction sequence using related gaming monetary instruments according to a specific embodiment of the present disclosure.

FIG. 14 provides a sequence chart of an exemplary alternative chronological gaming transaction sequence using related gaming monetary instruments according to a specific embodiment of the present disclosure. Sequence 1400 represents an exemplary series of gaming transactions and events that might be conducted by a player over time at a casino or other gaming establishment. Again, it will be readily appreciated that multiple players and/or multiple gaming establishments might apply to this or a similar example, although only one player and casino is reference for purposes of discussion. As shown, sequence 1400 is substantially similar to sequence 1200 given above in FIG. 12. That is, sequence 1400 includes the generation and redemption of multiple different printed tickets or vouchers 1403, 1405, 1407, and 1409, which are used at multiple different system nodes or gaming devices 1402, 1404, 1406, 1408, and 1410 over time across the casino. As shown, system nodes or gaming devices 1402, 1404, 1406, and 1408 can be the same as those given above in FIG. 12

Again an initial transaction, a player can insert cash at a first system node 1402, which can be, for example, "Kiosk #8" (Node 1), upon which a printed ticket 1403 is issued therefrom as Voucher H. As an addition to the pattern of sequence 1200 above, a separate cash in and gaming event can take place at a second system node 1410, which can be, for example "Slot Machine #1435" (Node 2), after which a printed ticket 1409 is issued therefrom as Voucher J. As in the foregoing examples, each of Voucher H and Voucher J can have a data structure and historical record associated therewith.

Voucher H and Voucher J can then both be inserted for credit at a third system node 1404, which can be, for example, "Slot Machine #1434" (Node 3). After a gaming session at Slot Machine #1434, a requested cash out can result in the issuance of another printed ticket 1405, represented as Voucher K. Unlike the foregoing simpler pattern example of sequence 1200, Voucher K will then have additional information or data in its historical record here in sequence 1400. That is, while the corresponding historical record for Voucher B above included historical record data for Voucher A, gaming session data for the games at Slot Machine #1434, and issuance data for Voucher B, the historical record for Voucher K can include historical record data for Voucher H, gaming session data for the games at Slot Machine #1434, issuance data for Voucher K, and also historical record data for Voucher J.

Further iterations at Blackjack Table #34, Voucher L issuance and historical record creation, and Cashier's Cage #5 can all also reflect the additional historical record data with respect to Voucher J. In this manner, all gaming transactions and vouchers that contribute to or reflect the amount of any value for a given voucher can be reflected in the historical record for that voucher. For example, if ten more vouchers are also added to the gaming session at Slot Machine #1434, then historical record data for each of these additional ten vouchers can also be added to the historical record for each of downstream or later sequential vouchers K and L.

Figure 15:
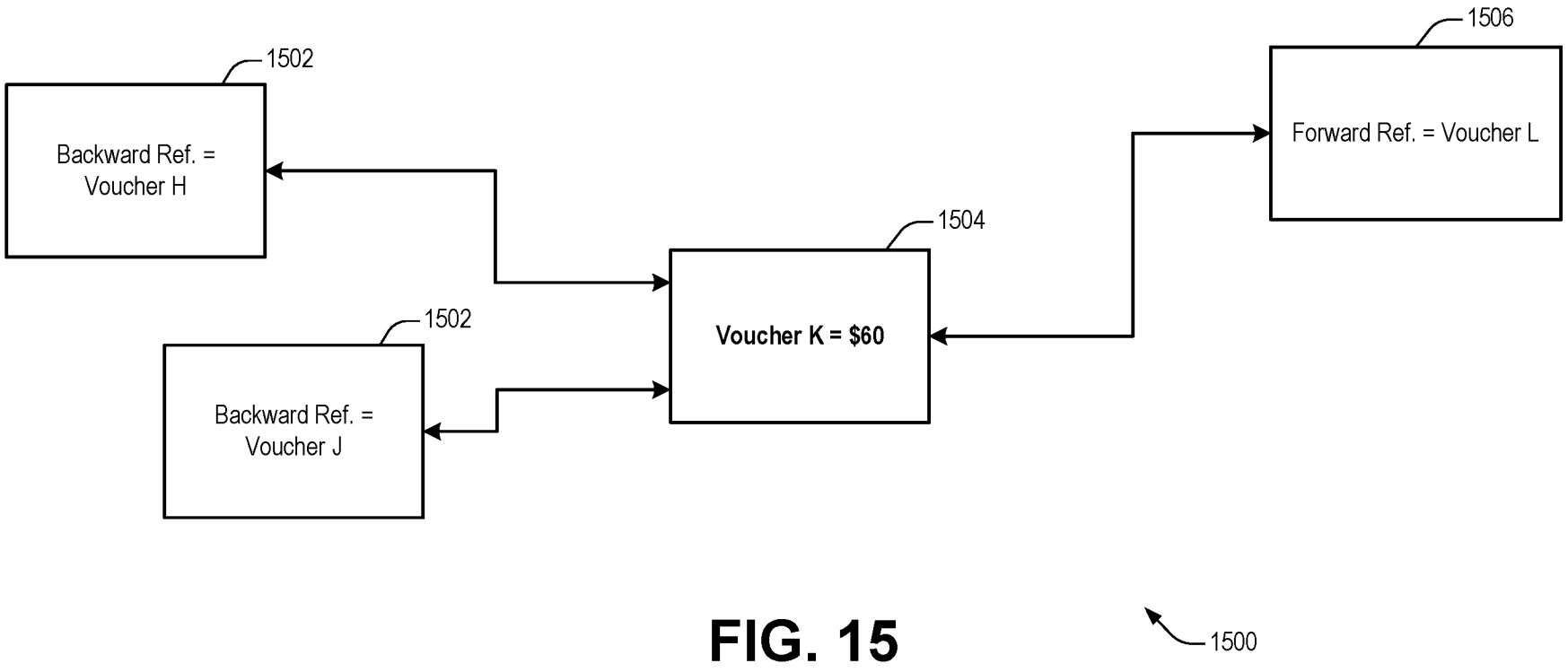
FIG. 15 illustrates in block diagram format multiple related gaming monetary instruments for FIG. 14 according to a specific embodiment of the present disclosure.

FIG. 15 illustrates in block diagram format multiple related gaming monetary instruments for FIG. 14 according to a specific embodiment of the present disclosure. Related voucher set 1500 represents four related printed tickets or vouchers that are issued sequentially in time, and can include Voucher H 1502, Voucher J 1503, Voucher K 1504, and Voucher L 1506, which can all correspond to Vouchers H, J, K, and L of the foregoing example in FIG. 14. In this example of FIG. 15, focus can be made with respect to Voucher K, which issued in the amount of $60 and which was generated by Slot Machine #1434 (Node 3), as shown in FIG. 14.

Again, data structures and/or historical data for printed tickets and other vouchers can include various data items, such as voucher sequence data, for example. As shown, printed ticket 1504 (i.e., Voucher K) can be associated with historical data that can include voucher sequence data. In particular, the historical data for Voucher K can include backward references to Vouchers H and J, as well as a forward reference to Voucher L. Again, the forward reference to Voucher L cannot be input or detailed until Voucher L is created or otherwise known of.

Figure 16:
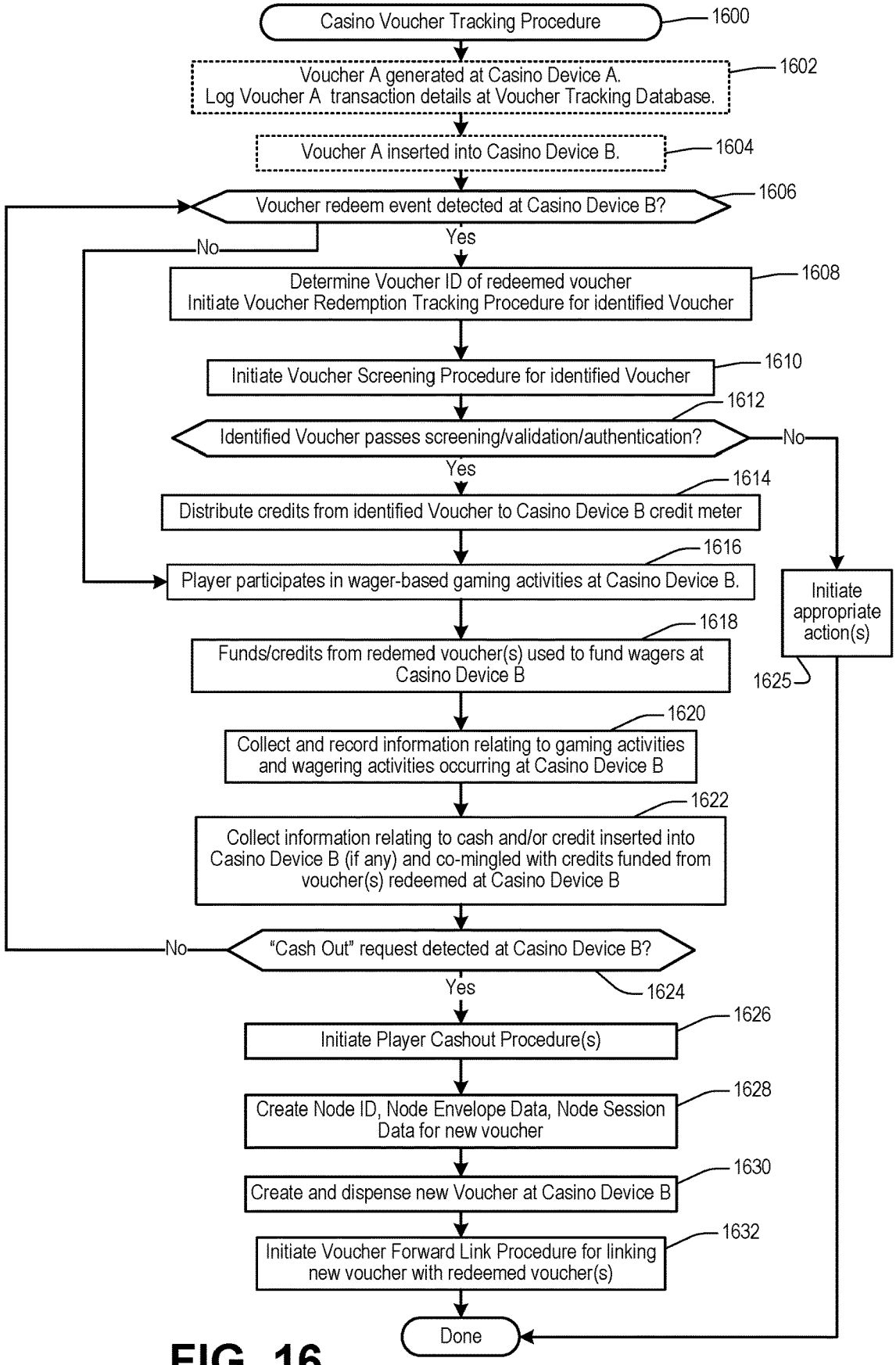
FIG. 16 provides a flowchart of an exemplary method of tracking gaming monetary instruments over multiple transactions across a gaming network according to one embodiment of the present disclosure.

FIG. 16 provides a flowchart of an exemplary method of tracking gaming monetary instruments over multiple transactions across a gaming network according to one embodiment of the present disclosure. In at least one embodiment, a Casino Voucher Tracking Procedure 1600 may be configured or designed to perform tracking and association with stored system data structures and historical records for one or more gaming monetary instruments, such as printed tickets or other vouchers having cash values. In at least one embodiment, the Casino Voucher Tracking Procedure 1600 may be initiated or triggered in response to determining that a voucher has been generated at a system node, such as at an electronic gaming device at a casino or other gaming establishment. For example, optional step 1602 shows that a Voucher A is generated at a system node, such as Casino Device A, whereupon details regarding the transaction for Voucher A are logged at a Voucher Tracking Database on the gaming system or network.

As shown at optional step 1604, Voucher A can then be inserted into or otherwise provided for credit at a Casino Device B that is separate from Casino Device A which issued Voucher A. For purposes of simplification and clarification, it is assumed in the example embodiment of FIG. 16 that a specific series of transactions at Casino Device B are being described for a detailed analysis of what can happen at every gaming device or other node on the system where a voucher is presented and gaming transactions take place. That is, a similar series of steps may take place at every other gaming device or other node for system tracking with respect to a similar voucher redemption, voucher issuance, and/or gaming interaction.

As shown at step 1606, an inquiry can be made as to whether a voucher redeem event is detected at Casino Device B. If no voucher redeem event is detected, then the procedure skips to step 1616 as shown. If a voucher redeem event is detected, however, such as after Voucher A has been inserted into or presented thereat in optional steps 1602 and 1604, then the procedure continues to step 1608 where the Voucher Identification (e.g., unique number or code) of Voucher A is determined and a Voucher Redemption Tracking Procedure is initiated. A more detailed description of such a Voucher Redemption Tracking Procedure is set forth at FIG. 17A below.

At step 1610, a Voucher Screening Procedure is initiated for the identified Voucher A, details for which are set forth at FIG. 18 below. As shown at the following step 1612, an inquiry is made as to whether the identified voucher (e.g. Voucher A in this example) passes the screening/validation/authentication process noted at step 1610. If not, then no credit is provided and the appropriate flag(s), alert(s), and action(s) with respect to suspicious or fraudulent activity detection are initiated at step 1625, after which the procedure ends.

If the identified voucher does pass screening at step 1612, however, then an appropriate amount of credits are distributed from the identified voucher to the credit meter of the electronic gaming device accepting the voucher at step 1614. In this particular example as shown, the cash value of Voucher A is distributed or transferred as credits to the meter of Casino Device B. At step 1616, the player then participates in wager-based gaming activities at Casino Device B. At step 1618, funds and/or credits from redeemed vouchers, which can include Voucher A and potentially one or more additional vouchers, are then used to fund wagers for the wager-based gaming activities at Casino Device B.

At step 1620, information and data relating to the wager-based gaming activities during the gaming session at Casino Device B are collected and recorded, such that data structures and historical records relating to Voucher A and any other relevant vouchers associated with the gaming session can be created. It should be noted that this collection and recording step 1620 may be performed before Voucher A is redeemed, after the gaming session is over, and/or can be performed dynamically during the gaming session at Casino Device B. At step 1622, information and data relating to any other additional vouchers and/or cash that is inserted into Casino Device B during the gaming session can be collected and recorded. In particular, redeemed vouchers, cash, and/or other credits that are comingled with credits from Voucher A are also tracked for purposes of linking and tracking all vouchers associated with the gaming session. Similar to step 1620, this step 1622 may also be performed at different times in the provided procedure, such as before Voucher A is redeemed and/or before some of the wager-based gaming activities that take place on Casino Device B.

As shown at the following step 1624, an inquiry can made as to whether a "Cash Out" request is detected at Casino Device B. If not, then the procedure reverts to step 1606, after which all steps can then be repeated as may be appropriate. If a "Cash Out" request is detected at step 1624, however, then the procedure continues to step 1626 where Player Cashout Procedure(s) are initiated. At step 1628, various data items are created and recorded for the new voucher that is about to be issued. Such data items can include a Node ID (e.g., the node identifier for Casino Device B), Node Envelope Data, Node Session Data, and other informational items that can be placed into the historical record associated with the new voucher, which can be called Voucher B.

At step 1630, the new voucher (i.e., Voucher B) is created and dispensed at Casino Device B. This can be accomplished, for example, by way of a ticket printer at the device issuing a printed ticket. At step 1632, a Voucher Forward Link Procedure is initiated for the newly issued voucher (i.e., Voucher B), details for which are set forth at FIG. 17B below. As noted above, voucher linking can include linking the newly issued voucher to the previously redeemed voucher (e.g., backward linking or referencing Voucher B to Voucher A), and can also include forward linking to any other voucher that issues based on transactions that are at least partially funded later by Voucher B. The procedure then ends after step 1632.

Figure 17B:
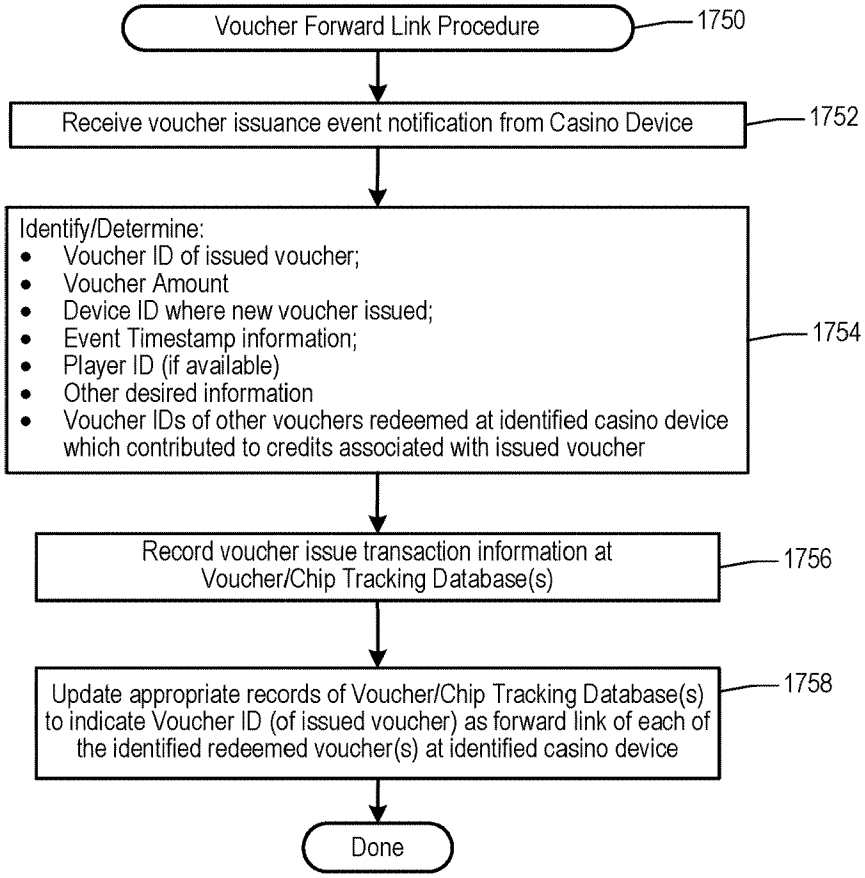
FIG. 17B provides a flowchart of an exemplary method of forward linking gaming monetary instruments on a gaming network according to one embodiment of the present disclosure.
Figure 17A:
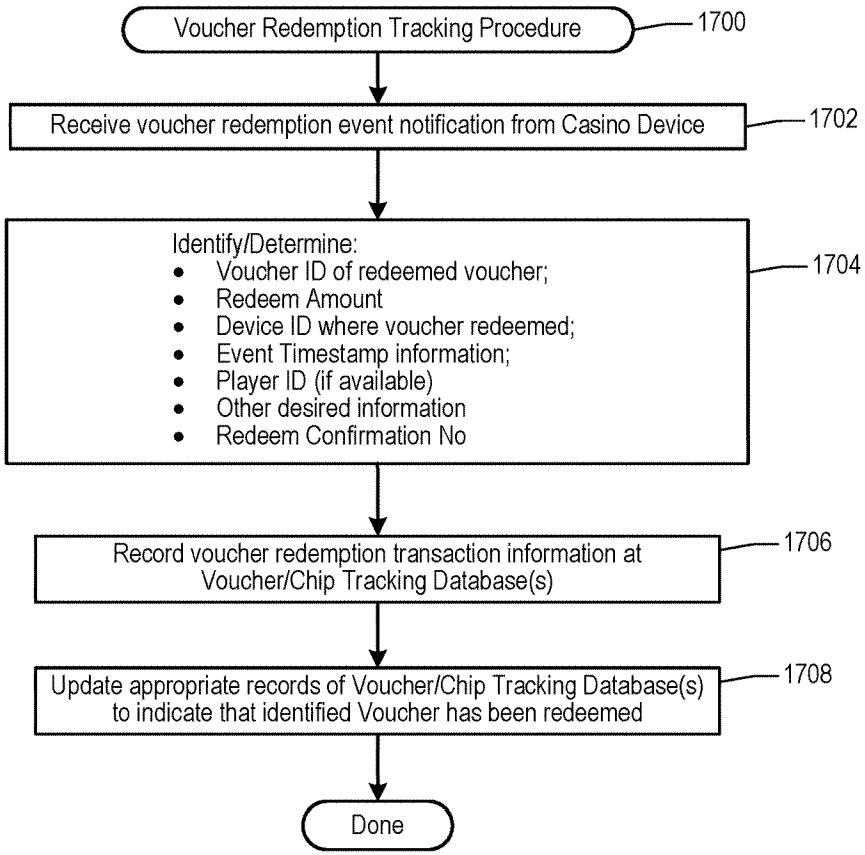
FIG. 17A provides a flowchart of an exemplary method of tracking gaming monetary instrument redemption on a gaming network according to one embodiment of the present disclosure.

FIG. 17A provides a flowchart of an exemplary method of tracking gaming monetary instrument redemption on a gaming network according to one embodiment of the present disclosure. In at least one embodiment, a Voucher Redemption Tracking Procedure 1700 may be configured or designed to perform tracking and association with stored system data structures and historical records for one or more redeemed gaming monetary instruments, such as printed tickets or other vouchers having cash values. In at least one embodiment, the Voucher Redemption Tracking Procedure 1700 may be initiated or triggered in response to determining that a voucher has been inserted or otherwise offered for redemption at a system node, such as at an electronic gaming device at a casino or other gaming establishment. For example, step 1702 shows that a voucher redemption event notification has been received from a Casino Device on the system. This can correspond to that which takes place for a positive inquiry at steps 1606 and 1608 in the foregoing example of FIG. 16.

At step 1704, details regarding the offered and redeemed voucher are identified or determined. Such details and information can include, for example:

- Voucher ID of redeemed voucher;
- Redeem Amount (i.e., cash value of the voucher or redeemed portion);
- Device ID where redeemed;
- Event Timestamp information;
- Player ID (if available) and/or other player biometric data (e.g., picture);
- Other desired information; and
- Voucher Redeem Confirmation ID.

At step 1706, the foregoing voucher redemption transaction information can be recorded at the appropriate Voucher/Chip Tracking Database(s). A detailed example of potential items for such recorded information is provided at FIG. 21 below. At step 1708, one or more appropriate records on the Voucher/Chip Tracking Database(s) can then be updated to indicate that the identified voucher has been redeemed. For example, any records for the Voucher ID associated with the redeemed voucher can indicate that the voucher has been redeemed and is therefore no longer valid if the voucher has been redeemed in full. If the voucher has only been partially redeemed, then the relevant record(s) can be updated to indicate the reduced value of the voucher. This might be suitable in the event that the voucher is a smart card or magnetic stripe card carrying a significant balance, for example, such as where only a portion of the credits or value of the voucher has been redeemed at the Casino Device. Other records may also be updated as may be appropriate in light of the voucher redemption, such as historical records for the redeemed voucher and all related or linked vouchers. The procedure then ends after step 1708.

FIG. 17B provides a flowchart of an exemplary method of forward linking gaming monetary instruments on a gaming network according to one embodiment of the present disclosure. In at least one embodiment, a Voucher Forward Link Procedure 1750 may be configured or designed to perform forward linking to future vouchers for purposes of tracking and association with stored system data structures and historical records for one or more gaming monetary instruments, such as printed tickets or other vouchers having cash values. In at least one embodiment, the Voucher Forward Link Procedure 1750 may be initiated or triggered in response to determining that a voucher has been printed or otherwise issued at a system node, such as at an electronic gaming device at a casino or other gaming establishment. For example, step 1752 shows that a voucher issuance event notification has been received from a Casino Device on the system. This can correspond to that which takes place at step 1632 in the foregoing example of FIG. 16.

At step 1754, details regarding the issued voucher are identified or determined. Such details and information can include, for example:

Voucher ID of issued voucher;
Voucher Amount;
Device ID where issued;
Event Timestamp information;
Player ID (if available) and/or other player biometric data (e.g., picture);
Other desired information; and
Voucher ID for all other vouchers redeemed at the Casino Device, as well as all other vouchers that contributed to any portion of the voucher amount for the newly issued voucher.

At step 1756, the foregoing voucher issuance transaction information can be recorded at the appropriate Voucher/Chip Tracking Database(s), such that this data or information can then be provided to all forward linked vouchers. At step 1758, one or more appropriate records on the Voucher/Chip Tracking Database(s) can then be updated to indicate that the new voucher has been issued. For example, a forward link relating to the newly issued voucher can be provided to any other system node and/or data structure or historical record for a future issued voucher. This forward link can identify the newly issued voucher and provide a location where appropriate information and data can be located to be included in the data structures and historical records of such future issued vouchers that are related to the instant voucher. The procedure then ends after step 1658.

Figure 18:
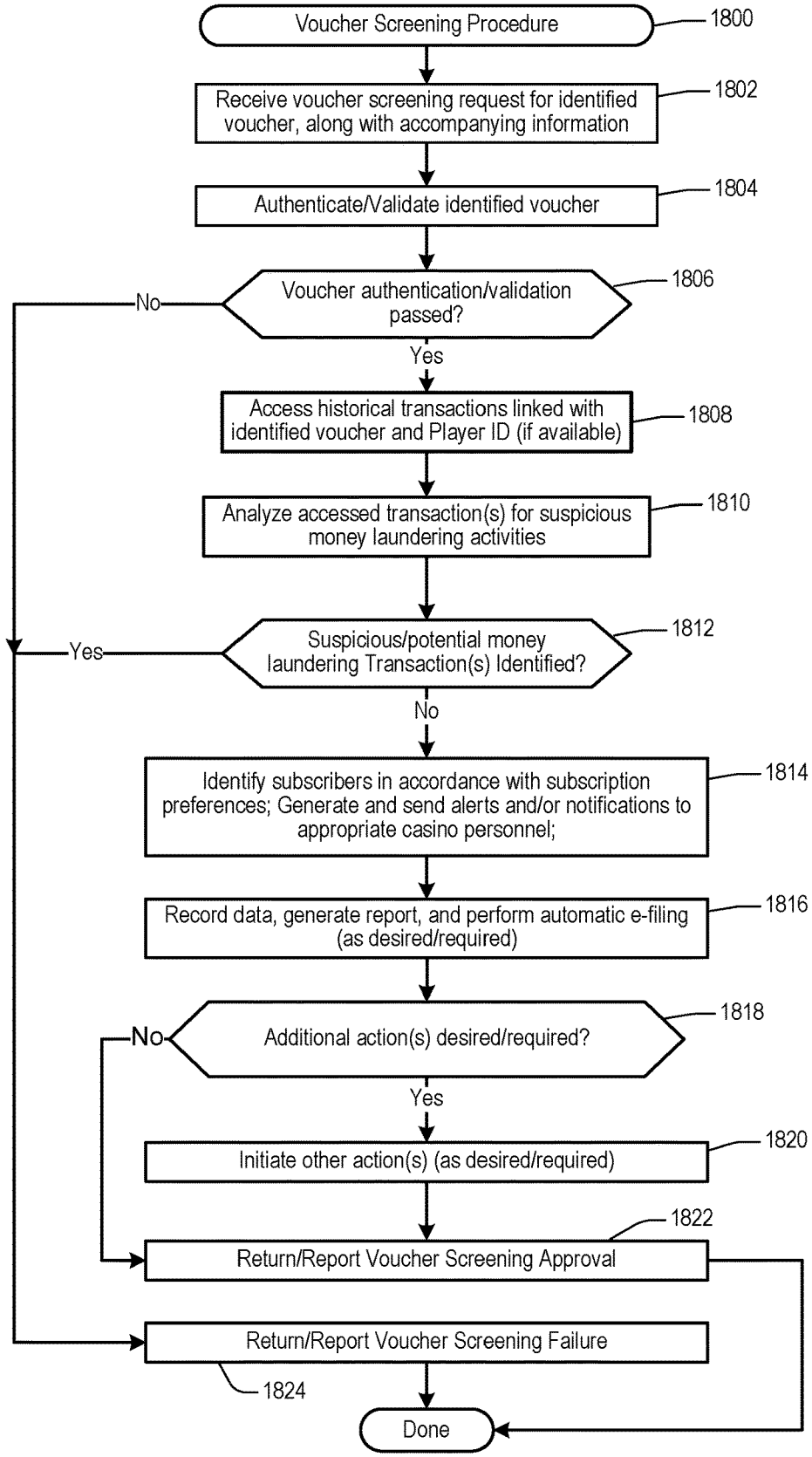
FIG. 18 provides a flowchart of an exemplary method of screening gaming monetary instruments on a gaming network according to one embodiment of the present disclosure.

FIG. 18 provides a flowchart of an exemplary method of screening gaming monetary instruments on a gaming network according to one embodiment of the present disclosure. In at least one embodiment, a Voucher Screening Procedure 1800 may be configured or designed to perform screening (e.g., authentication, validation, fraud or suspicious activity detection) for one or more gaming monetary instruments, such as printed tickets or other vouchers having cash values. In at least one embodiment, the Voucher Screening Procedure 1800 may be initiated or triggered in response to determining that a voucher has been inserted or otherwise offered for redemption at a system node, such as at an electronic gaming device at a casino or other gaming establishment. Voucher Screening Procedure 1800 can be used to screen any offered vouchers to identify security, fraudulent, or suspicious activity flags. If any such flags or issues are detected, then security alerts can be provided, and acceptance or issuance of any affected voucher can be delayed appropriately.

Initial step 1802 shows that a voucher screening request has been received from a Casino Device on the system. This can correspond to that which takes place at step 1610 in the foregoing example of FIG. 16. The voucher screening request can include various information items for the voucher being screened. Such informational items or data can include, for example:

Voucher ID of offered/screened voucher;
Redeem Amount (i.e., cash value of the voucher or redeemed portion);
Casino Device ID where offered/redeemed;
Event Timestamp information;
Player ID (if available) and/or other player biometric data (e.g., picture);
Co-mingled funding information (if applicable);
Credit meter value at Casino Device; and
Other desired information.

As shown at step 1804, the offered voucher being screened is then authenticated and validated, such as according to the foregoing informational items. At step 1806, an inquiry is then made as to whether the offered voucher being screened passed the authentication and validation process. If not, then the procedure moves to step 1824 where a Return/Report Voucher Screening Failure is recorded and appropriate alerts are sent, after which the procedure ends. If the voucher being screened passes at step 1806, however, then the procedure continues to step 1808, where historical transactions related to the screened voucher are accessed and linked to the screened voucher and any associated player ID (as may be applicable).

At step 1810, the authenticated and validated voucher is then analyzed according to its related transactions for fraudulent or suspicious activities (e.g., for possible money laundering patterns). At step 1812, another inquiry is made as to whether the authenticated voucher being screened has any suspicious or potentially fraudulent activities identified according to the accessed historical data. If such suspicious or possibly fraudulent activities are detected at step 1812, then the procedure similarly moves to step 1824 where a Return/Report Voucher Screening Failure is recorded and appropriate alerts are sent, after which the procedure ends. If the voucher being screened for fraudulent or suspicious activity passes at step 1812, however, then the procedure continues to step 1814, where subscribers are identified accordingly to subscription preferences, and alerts and/or notifications are generated and sent to the appropriate subscribing casino personnel and/or other relevant parties.

At step 1816, data regarding the screened voucher is recorded, one or more suitable reports are generated, and automated electronic filing is performed for the recorded data and reports (e.g., historical records), as may be desired or required per system preferences or parameters. At step 1818, an inquiry is made as to whether any additional actions regarding the screened voucher may be desired or required. If not, then the procedure moves to step 1822, where a Return/Report Voucher Screening Approval is recorded, after which the procedure ends. If any other actions are desired at step 1818, however, then such additional other action(s) are initiated and performed as may be desired or required at step 1820, after which the procedure moves to step 1822 for the same action noted above, and after which the procedure ends.

FIG. 19 provides a chart of exemplary envelope data for a gaming monetary instrument from FIGS. 12-13 according to one embodiment of the present disclosure. Envelope Data File 1900 can include a number of informational or data items related to a particular voucher, such as data items 1902-1918. As shown in FIG. 19, Envelope Data File 1900 can be associated with Voucher B from FIGS. 12-13, where Voucher B was issued by Slot Machine #1234 in the amount of $60.

As shown, Envelope Data File 1900 can include data items relating to forward and backward references to other vouchers (e.g., Vouchers C and A), time stamp data, location data, Casino Device and node type data, a credit amount, any player ID and/or biometric (e.g., fingerprint or picture) information, and a redemption confirmation number, among other possible data items. Such other possible data items may include other fields, such as a field and subfields for co-mingled funds details. Also, while the redemption confirmation number is presently blank, it will be readily appreciated that this field can be updated whenever Voucher B is redeemed, such as at another Casino Device.

FIG. 20 provides a chart of exemplary session data for a gaming monetary instrument from FIGS. 12-13 according to one embodiment of the present disclosure. Session Data File 2000 can include a number of informational or data items related to a particular gaming session at a specific Casino Device, such as data items 2002-2016. As shown in FIG. 20, Session Data File 2000 can be associated with the gaming session at Slot Machine #1234 that resulted in Voucher B being issued in the amount of $60, such as that which is represented in FIGS. 12-13, As shown, Session Data File 2000 can include data items such as an issued voucher ID, the game type and theme (e.g., slots), the number of games played and number of games won, jackpots won, net win, and the average rate of game play, among other possible data items.

FIG. 21 provides a chart of exemplary redemption data for a gaming monetary instrument from FIGS. 12-13 according to one embodiment of the present disclosure. Voucher Redemption Data File 2100 can include a number of informational or data items related to the redemption of a particular voucher, such as data items 2102-2118. As shown in FIG. 21, Voucher Redemption Data File 2100 can also be associated with Voucher B from FIGS. 12-13, where Voucher B was redeemed by Blackjack Table #34 in the amount of $60.

As shown, Voucher Redemption Data File 2100 can include data items relating to time stamp data, location data, redemption amount, any player ID and/or biometric information if applicable (in this case Anonymous), a credit amount, and a redemption confirmation number, among other possible data items. Again, while the redemption confirmation number is presently blank, it will be readily appreciated that this field can be updated whenever Voucher B is redeemed, such as at another Casino Device.

FIG. 22 provides a chart of exemplary envelope data for a gaming monetary instrument from FIGS. 14-15 according to one embodiment of the present disclosure. Envelope Data File 2200 can include a number of informational or data items related to a particular voucher, such as data items 2202-2218. As shown in FIG. 22, Envelope Data File 2200 can be associated with Voucher K from FIGS. 14-15, where Voucher K was issued by Slot Machine #1434 in the amount of $60.

Similar to the foregoing example, Envelope Data File 2200 can include data items relating to forward and backward references to other vouchers (e.g., Vouchers L forward and Vouchers H and J backward), time stamp data, location data, Casino Device and node type data, a credit amount, any player ID and/or biometric information, and a redemption confirmation number, among other possible data items, such as a field and subfields for co-mingled funds details. Again, while the redemption confirmation number is presently blank, it will be readily appreciated that this field can be updated whenever Voucher K is redeemed, such as at another Casino Device.

Figure 23:
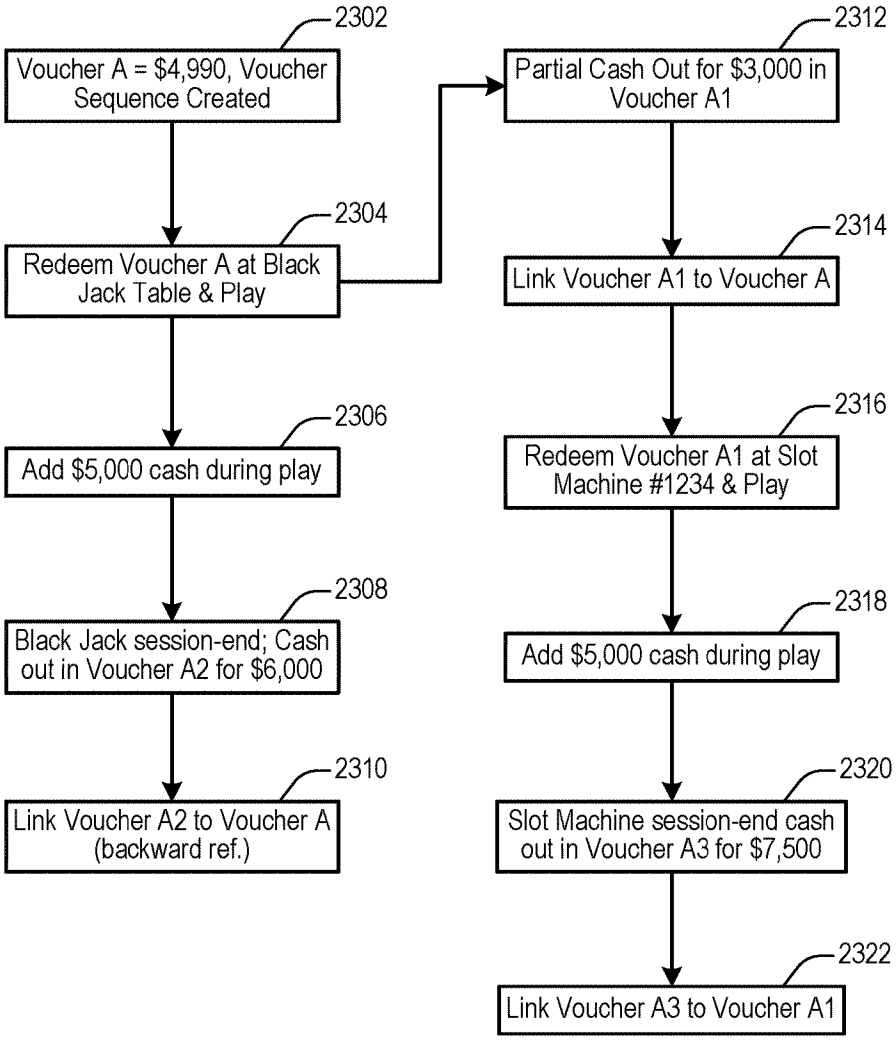
FIG. 23 provides a flowchart of an exemplary specific method of tracking gaming monetary instruments over multiple gaming transactions according to another specific embodiment of the present disclosure.

FIG. 23 provides a flowchart of an exemplary specific method of tracking gaming monetary instruments over multiple gaming transactions according to another specific embodiment of the present disclosure. According the specific example provided at FIG. 23, an initial transaction at step 2302 involves Voucher A being created in the amount of $4,990. This can be a result of obtaining a voucher at a kiosk, casino cage, or other gaming device on the network for a cash or credit purchase of $4,990.

At step 2304, Voucher A is then redeemed at Blackjack Table A, and a gaming session of blackjack at the table commences. At step 2306, an additional $5,000 in cash is added during the gaming session at Blackjack Table A. At step 2312, which may occur before or after step 2304, a Partial Cash Out from the gaming session at Blackjack Table A is requested. The Partial Cash Out results in the issuance of a new Voucher A1 in the amount of $3,000, which amount is deducted from the pending credit balance at Blackjack Table A. Such a Partial Cash Out might take place, for example, where a spouse or friend of the player at Blackjack Table A desires funds for his or her own separate gaming session. As such, steps 2306-2310 can occur in parallel with steps 2312-2322. Alternatively, either series of these steps may occur before or after the other.

Continuing from step 2306, the gaming session ends at Blackjack Table A at step 2308, whereupon a full Cash Out of the remaining credit balance for the gaming session there is requested. This Cash Out results in the issuance of another new Voucher A2 in the amount of $6,000, which is the remaining balance at Blackjack Table A. At the next step 2310, Voucher A2 is backward referenced to the original Voucher A. In addition to the backward reference to Voucher A, data regarding the extra $5,000 added during the gaming session, the Partial Cash Out resulting in new Voucher A1, and other gaming session details can be added to the historical record for newly issued Voucher A2 at step 2310 or a subsequent step (not shown).

Continuing from step 2312, newly issued Voucher A1 can be backward linked or referenced to original Voucher A at step 2314. Additional data can also be added to a historical record for new Voucher A1, similar to that which is described for Voucher A2 above. At a following step 2316, Voucher A1 is redeemed at Slot Machine #1234, and a slots gaming session at the Slot Machine commences. At step 2318, an additional $5,000 in cash is added during the gaming session at Slot Machine #1234. At step 2320, the gaming session ends at Slot Machine #1234, whereupon a full Cash Out of the remaining credit balance for the gaming session there is requested. This Cash Out results in the issuance of another new Voucher A3 in the amount of $7,500, which is the remaining balance at Slot Machine #1234. At the next step 2322, Voucher A3 is backward referenced to Voucher A1, and can be backward referenced to the original Voucher A as well. In addition to the backward reference to Voucher A, data regarding the extra $5,000 added during the gaming session, and other gaming session details can be added to the historical record for newly issued Voucher A3 at step 2322 or a subsequent step.

Figure 24:
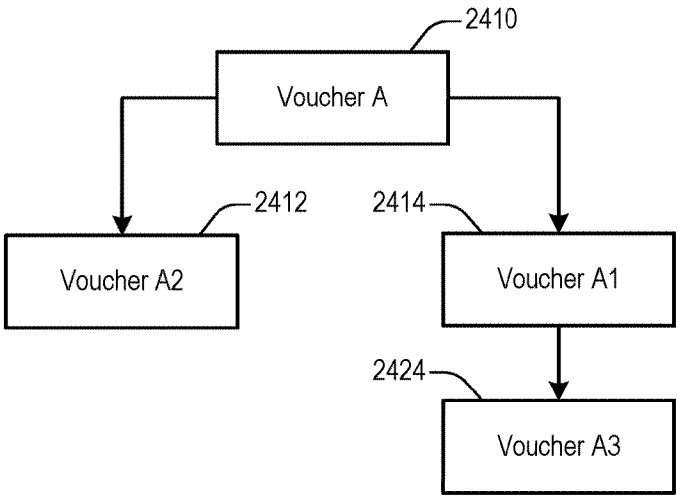
FIG. 24 illustrates in block diagram format multiple related gaming monetary instruments for FIG. 23 according to a specific embodiment of the present disclosure.

FIG. 24 illustrates in block diagram format multiple related gaming monetary instruments for FIG. 23 according to a specific embodiment of the present disclosure. As shown, printed tickets 2410 ("Voucher A"), 2412 ("Voucher A2"), 2414 ("Voucher A1"), and 2424 ("Voucher A3") are all related due to the various transactions described with respect to FIG. 23. That is to say, Voucher A directly spawned or spun off transactions and gaming sessions that resulted in the later chronological issuance of both Voucher A1 and Voucher A2, while Voucher A1 directly spawned or spun off transactions and gaming sessions that resulted in the later chronological issuance of Voucher A3. Accordingly, the historical record for each of Vouchers A1, A2, and A3 will include historical data regarding Voucher A, while the historical record for Voucher A3 will also include historical data regarding Voucher A1. Of course, each of the respective historical records can also include additional data or information, such as data regarding related gaming session details, as well as the additional input of $5,000 during such sessions.

Figure 25:
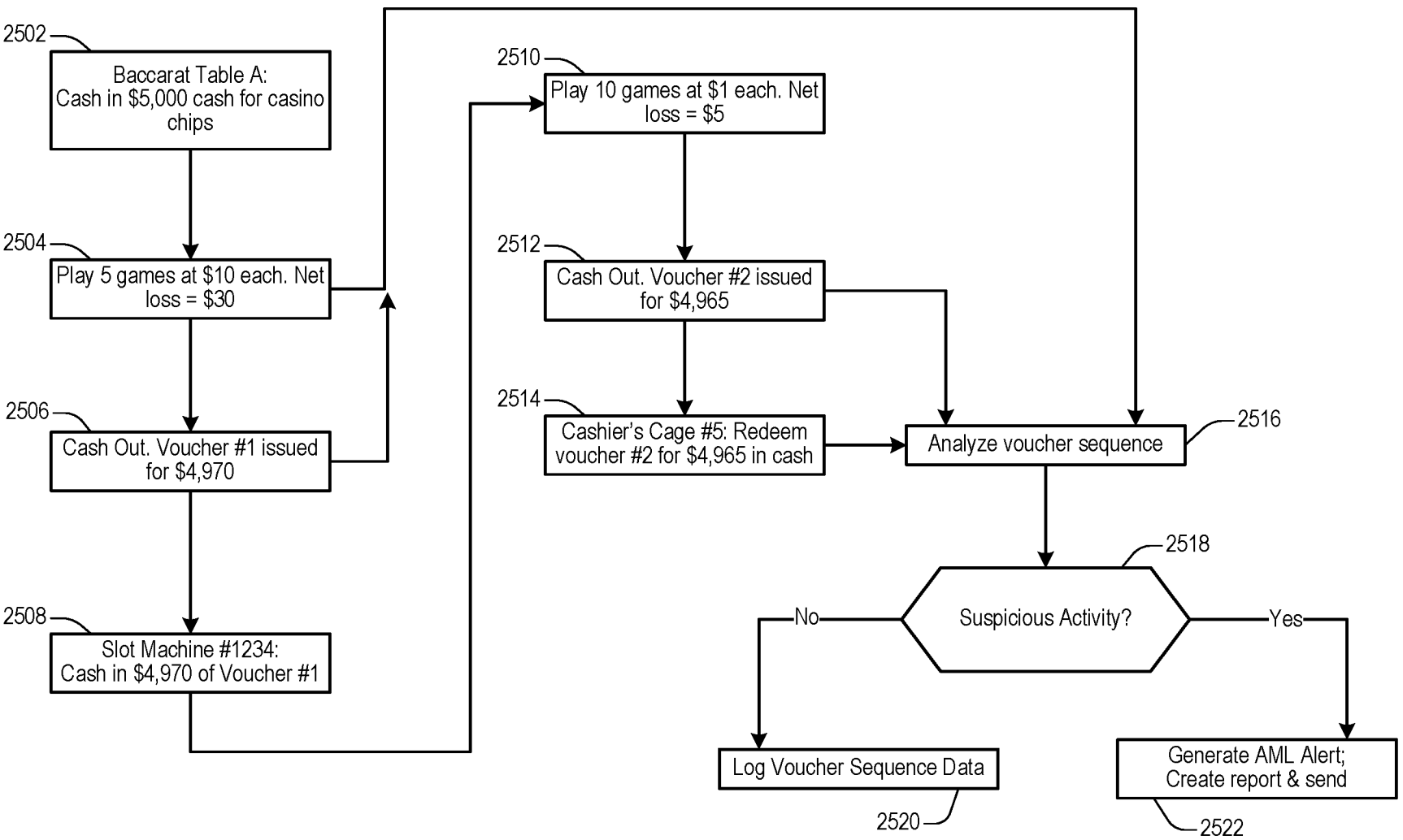
FIG. 25 provides a flowchart of an exemplary specific method of analyzing transactions for suspicious gaming activity patterns using gaming monetary instruments according to another specific embodiment of the present disclosure.

FIG. 25 provides a flowchart of an exemplary specific method of analyzing transactions for suspicious gaming activity patterns using gaming monetary instruments according to another specific embodiment of the present disclosure. According to the specific example provided at FIG. 25, an initial transaction at step 2502 involves a cash in for $5,000 worth of casino chips at Baccarat Table A. At step 2504, a gaming session commences at Baccarat Table A, which gaming session involves the play of 5 games at $10 each for a net loss of $30. At step 2506, a full Cash Out request results in the issuance of Voucher #1 in the amount of $4,970 at Baccarat Table A. During the gaming session at step 2504 and/or at the Cash Out at step 2506, an Analyze Voucher Sequence may be performed at step 2516, further details of which are provided below.

At step 2308, Voucher #1 is then redeemed at Slot Machine #1234 for a Cash In value of $4,970. At step 2510, a gaming session commences at Slot Machine #1234, which gaming session involves the play of 10 games at $1 each for a net loss of $5. At step 2512, a full Cash Out request results in the issuance of Voucher #2 in the amount of $4,965 at Slot Machine #1234. During the gaming session and/or Cash Out at Slot Machine #1234, an Analyze Voucher Sequence may be performed at step 2516. After the Cash Out at step 2512, Voucher #2 is then redeemed at Cashier's Cage #5 for its full value of $4,965 in cash. An Analyze Voucher Sequence may also be performed with respect to this transaction at step 2516.

Step 2516 represents an Analyze Voucher Sequence that may be performed with respect to any or all transactions regarding the redemption or issuance of a voucher. At step 2518, an inquiry is made as to whether any potential fraud or other suspicious activity is detected with respect to any patterns in the data associated with the analyzed transaction. In no suspicious activity pattern is detected, then the Voucher Sequence Data is simply logged at step 2520. This data is then available for data structures and historical records for the subject voucher and any related or linked vouchers. In the event that suspicious activity is detected, however, then a suspicious activity alert (e.g., AML alert) is generated and sent to the appropriate personnel. In addition, a report can also be generated, stored, and sent as desired or required according to system protocols.

For the foregoing flowcharts, it will be readily appreciated that not every method step provided is always necessary, and that further steps not set forth herein may also be included. For example, added steps to involve further player tracking or suspect gaming activity pattern detection may be added. Furthermore, the exact order of steps may be altered as desired, and some steps may be performed simultaneously. In addition, while the provided examples are with respect to gaming monetary instrument tracking, it will be readily understood that such steps can also be adapted to apply to RFID casino chip tracking, cash transactions, player tracking, resort transactions, and the like.

It should be understood that the devices, systems and methods described herein may be adapted and configured to function independently or may also interact with other systems or applications, such as for example, a casino management system or player tracking system. As such, gaming cash instrument tracking data may be recorded and stored in connection with casino or resort management data, player information, or other data retrieved from a table, terminal or other pertinent location. It should also be readily apparent that additional computerized or manual systems may also be employed in accordance with the disclosure in order to achieve its full implementation as a system, apparatus or method.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as an existing electronic gaming machine, portable computing device or electronic platforms with multiple player positions. In addition, the system of the disclosure may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the disclosure so long as players and operators thereof are provided with useful access thereto or the opportunity to play the game as described herein.

The various aspects, embodiments, implementations or features of the described embodiments can be used separately or in any combination. Various aspects of the described embodiments can be implemented by software, hardware or a combination of hardware and software. Computer readable medium can be any data storage device that can store data which can thereafter be read by a computer system. Examples of computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A gaming monetary instrument system for detecting a fraudulent activity in a monetary instrument transaction, the gaming monetary instrument system comprising:

a plurality of devices including a first device of the plurality of devices being operable to issue a first monetary instrument, and a second device of the plurality of devices being operable to receive the first monetary instrument; and a server operable to be coupled to one or more of the plurality of devices via a network, and having one or more processors and a memory storing a plurality of instructions, which, when executed, cause the one or more processors to at least:

control the first device to issue the first monetary instrument having a first monetary value and a first data structure linking the first device to transactions occurred at one or both the first device and the second device, access the memory to store a first record generated for the first monetary instrument including the first data structure and the first monetary value, which allows tracking across multiple different transactions over time, retrieve from the memory a first pattern associated with the fraudulent activity, control the second device to analyze the first monetary instrument, when received at the second device, for the fraudulent activity based on the first pattern established for at least one of the second device, the first record generated, and the first data structure on the first monetary instrument received, access the memory to store one or more activities tracked at the second device when the first monetary instrument is analyzed with respect to the first pattern, control the second device to issue a second monetary instrument with a second data structure linking the first monetary instrument analyzed, the activities tracked at the second device, the first monetary value, and the first data structure to the second device, and control the second device to generate a second record for the second monetary instrument based on second monetary instrument including the second data structure, the first record, the first monetary instrument analyzed, the activities logged at the second device, the first monetary value, and the first data structure.

2. The gaming monetary instrument system of claim 1, wherein the instructions, when executed, cause the one or more processors to analyze the second record for the fraudulent activity with respect to one or more predefined gaming activity patterns.

3. The gaming monetary instrument system of claim 2, wherein the instructions, when executed, cause the one or more processors to provide a reward when the second record is analyzed to include a rewardable activity pattern.

4. The gaming monetary instrument system of claim 1, wherein the instructions, when executed, cause the one or more processors to:

analyze the second record with respect to a suspicious activity pattern; and provide an alert when the second record is analyzed to include the suspicious activity pattern.

5. The gaming monetary instrument system of claim 1, wherein the activities further include an acceptance of a third monetary instrument having a third monetary value at the second device, the third monetary instrument having been created at a third device from the plurality of devices.

6. The gaming monetary instrument system of claim 5, wherein the second record further includes a third record associated with the third monetary instrument.

7. The gaming monetary instrument system of claim 6, wherein the second record identifies the first device and the third device.

8. A method for detecting a fraudulent activity in a gaming monetary instrument system, the gaming monetary instrument system having a plurality of devices including a first device of the plurality of devices being operable to issue a first monetary instrument, and a second device of the plurality of devices being operable to receive the first monetary instrument, and a server operable to be coupled to one or more of the plurality of devices via a network, and having one or more processors and memory storing instructions, which, when executed, cause the processor to at least initiate a transaction, the method comprising:

issuing at the first device the first monetary instrument having a first monetary value and a first data structure linking the first device to transactions occurred at one or both the first device and the second device;

accessing the memory to store a first record generated for the first monetary instrument including the first data structure and the first monetary value allows tracking across multiple different transactions over time;

accessing the memory for a first pattern associated with the fraudulent activity;

analyzing at the second device the first monetary instrument, when received at the second device, for the fraudulent activity based on the first pattern established for at least one of the second device, the first record generated, and the first data structure on the first monetary instrument received;

controlling the second device to issue a second monetary instrument with a second data structure linking the first monetary instrument analyzed with respect to the first pattern, one or more activities logged at the second device when the first monetary instrument is analyzed, the first monetary value, and the first data structure to the second device; and controlling the second device to generate a second record for the second monetary instrument based on the second monetary instrument including the second data structure, the first record, the first monetary instrument analyzed, the activities logged at the second device, the first monetary value, and the first data structure.

9. The method of claim 8, further comprising analyzing the second record for the fraudulent activity with respect to one or more predefined gaming activity patterns, and providing a reward when the second record includes a rewardable activity pattern.

10. The method of claim 8, further comprising:

analyzing the second record with respect to a suspicious activity pattern; and providing an alert when the second record is analyzed to include the suspicious activity pattern.

11. The method of claim 8, wherein the activities further include an acceptance of a third monetary instrument having a third monetary value at the second device, the third monetary instrument having been created at a third device from the plurality of devices.

12. The method of claim 11, wherein the second record further includes a third record associated with the third monetary instrument.

13. The method of claim 12, wherein the second record identifies the first device and the third device.

14. A non-transitory computer-readable medium comprising one or more sequences of instructions, for detecting a fraudulent activity in a monetary instrument transaction on a gaming monetary instrument system including a plurality of devices including a first device of the plurality of devices being operable to issue a first monetary instrument, and a second device of the plurality of devices being operable to receive the first monetary instrument, and a server operable to be coupled to one or more of the plurality of devices via a network, and having one or more processors, the one or more sequences of instructions, which, when executed, cause the one or more processors to perform the steps of:

controlling the first device to issue the first monetary instrument having a first monetary value and a first data structure linking the first device to transactions occurred at one or both the first device and the second device;

storing a first record generated for the first monetary instrument including the first data structure and the first monetary value allows tracking across multiple different transactions over time;

retrieving a first pattern associated with the fraudulent activity;

analyzing at the second device the first monetary instrument, when received at the second device, for the fraudulent activity based on the first pattern established for at least one of the second device, the first record generated, and the first data structure on the first monetary instrument received;

controlling the second device to issue a second monetary instrument with a second data structure linking the first monetary instrument analyzed with respect to the first pattern, one or more activities tracked at the second device, the first monetary value, and the first data structure to the second device; and controlling the second device to generate a second record for the second monetary instrument based on second monetary instrument including the second data structure, the first record, the first monetary instrument analyzed, the activities logged at the second device, the first monetary value, and the first data structure.

15. The non-transitory computer-readable medium of claim 14, wherein the one or more sequences of instructions, when executed, cause the one or more processors to perform the step of analyzing the second record for the fraudulent activity with respect to one or more predefined gaming activity patterns.

16. The non-transitory computer-readable medium of claim 15, wherein the one or more sequences of instructions, when executed, cause the one or more processors to perform the step of providing a reward when the second record include a rewardable activity pattern.

17. The non-transitory computer-readable medium of claim 14, wherein the one or more sequences of instructions, when executed, cause the one or more processors to perform the step of:

analyzing the second record with respect to a suspicious activity pattern; and providing an alert when the second record is analyzed to include the suspicious activity pattern.

18. The non-transitory computer-readable medium of claim 14, wherein the activities further include an acceptance of a third monetary instrument having a third monetary value at the second device, the third monetary instrument having been created at a third device from the plurality of devices.

19. The non-transitory computer-readable medium of claim 18, wherein the second record further includes a third record associated with the third monetary instrument.

20. The non-transitory computer-readable medium of claim 19, wherein the second record identifies the first device and the third device.

* * * * *